US005937244A

United States Patent [19]

Yoda et al.

[11] Patent Number: 5,937,244

[45] Date of Patent: Aug. 10, 1999

[54] IMAGE FORMING APPARATUS HAVING A FLEXIBLE CYLINDRICAL THIN IMAGE CARRIER

[75] Inventors: Kaneo Yoda; Nobumasa Abe; Yujiro Nomura; Saburo Furukawa; Kuniaki Tanaka, all of Nagano, Japan

[73] Assignee: Seiko Epson Corporation, Tokyo, Japan

[21] Appl. No.: 08/878,102

[22] Filed: Jun. 18, 1997

[30] Foreign Application Priority Data

| | | | |
|---|---|---|---|
| Jun. 18, 1996 | [JP] | Japan | 8-177501 |
| Oct. 30, 1996 | [JP] | Japan | 8-304087 |
| Oct. 30, 1996 | [JP] | Japan | 8-304088 |
| Oct. 30, 1996 | [JP] | Japan | 8-304089 |
| Jan. 6, 1997 | [JP] | Japan | 9-011830 |
| Jan. 23, 1997 | [JP] | Japan | 9-024424 |
| Feb. 12, 1997 | [JP] | Japan | 9-042993 |

[51] Int. Cl.[6] ..... G03G 15/00

[52] U.S. Cl. ..... 399/159; 430/69

[58] Field of Search ..... 399/159, 116, 399/117, 162; 430/56, 69

[56] References Cited

U.S. PATENT DOCUMENTS

| | | | |
|---|---|---|---|
| 3,536,397 | 10/1970 | Van Wagner | 399/117 |
| 4,326,793 | 4/1982 | Buholtz | 399/159 X |
| 4,601,963 | 7/1986 | Takahashi et al. | 430/69 |
| 4,823,160 | 4/1989 | Ikuta et al. | 399/117 |
| 4,895,784 | 1/1990 | Shirai | 430/69 |
| 5,151,737 | 9/1992 | Johnson et al. | 399/117 |
| 5,669,045 | 9/1997 | Swain | 399/159 |

FOREIGN PATENT DOCUMENTS

| | | |
|---|---|---|
| 0 698 828 A1 | 2/1996 | European Pat. Off. . |
| 58-86550 | 5/1983 | Japan . |
| 58-90655 | 5/1983 | Japan . |
| 59-192260 | 10/1984 | Japan . |
| 3-33768 | 2/1991 | Japan . |
| 4-69383 | 11/1992 | Japan . |

*Primary Examiner*—Arthur T. Grimley
*Assistant Examiner*—Sophia S. Chen
*Attorney, Agent, or Firm*—Sughrue, Mion, Zinn Macpeak & Seas, PLLC

[57] ABSTRACT

An image carrier device which includes a flexible cylindrical thin image carrier, a support member for supporting both ends of the image carrier and a cylindrical member having an outer diameter smaller than an inner diameter of the image carrier. The cylindrical member is disposed inside of the image carrier, wherein the cylindrical member is disposed at an interval between an outer peripheral surface of the cylindrical member and an inner peripheral surface of the image carrier, such that the interval is smaller than the allowable deformation of the image carrier.

46 Claims, 27 Drawing Sheets

IMAGE FORMING APPARATUS HAVING A FLEXIBLE CYLINDRICAL THIN IMAGE CARRIER

BACKGROUND OF THE INVENTION

1. Field of the Invention

The present invention relates to an image forming apparatus that forms an image using electrophotography, such as a printer, a facsimile machine or a copying machine.

2. Related Art

In general, an image forming apparatus using electrophotography includes a photoreceptor having a photosensitive layer on an outer peripheral surface thereof, charging means for uniformly charging the outer peripheral surface of the photoreceptor, exposing means for selectively exposing the outer peripheral surface which is uniformly exposed by the charging means to form an electrostatic latent, developing means for giving toners that serve as a developer to the electrostatic latent image formed by the exposing means to form a visual image (a toner image), and transfer means for transferring the toner image developed by the developing means onto a transfer medium such as a sheet.

The photoreceptors as generally known are a hard photosensitive drum on an outer peripheral surface of which a photosensitive layer is formed, and a flexible photosensitive belt on a surface of which a photosensitive layer is formed.

Also, as the charging means, the developing means and the transfer means, there have been known what are in the form of a roller which is in contact with the surface of the photoreceptor, respectively, and as its roller, there have been known a hard roller and a soft roller.

In the case where a hard photosensitive drum is used as the photoreceptor, and also a hard roller is used as the roller which is brought in contact with the hard photosensitive drum, there is naturally the limit of a high accuracy in manufacturing the photosensitive drum and the hard roller, and since an error always occurs in the accuracy, it is difficult to bring both the members in uniform contact with each other. If both the them are not in uniform contact with each other, there arises such problems that a gap is partially produced between the photosensitive drum and the developing roller to occur the ununiformity of charging, development and transfer and that these members are brought in press contact with each other stronger than a required pressure to wound the photosensitive drum or the developing roller.

From the above viewpoints, the structure in which both of the photoreceptor and the developing roller which is in contact with the photoreceptor are made of hard material is normally applied. In the case of using the hard photosensitive drum as the photoreceptor, the roller is formed of an elastic body, whereas in the case of using the hard roller as the roller, the flexible photosensitive belt is used as the photoreceptor.

However, in the case where the roller which is in contact with the photoreceptor is made of soft rubber, there arise problems stated below.

In the case where the charging roller or the like which is in contact with the photoreceptor is formed of a rubber roller, in order to give conductivity to the charging roller, conductive particles such as carbon are diffused in the charging roller. However, the hardness of the rubber is varied depending on the ununiformity or the dispersion of the degree of diffusion of carbon so that the hardness on the surface of the roller is dispersed. This causes such a problem that an excellent close contact state of the roller with the photoreceptor cannot be obtained.

On the contrary, when the amount of diffusion of carbon is reduced to obtain the excellent close contact state of the roller with the photoreceptor, there arises such a problem that the conductivity is dispersed to make charging ununiform.

Also, when, in order to enhance the flexibility, a carbon to which a plasticizer is added as a compound agent is used, there is a case in which the plasticizer is exuded from the surface of the roller. This causes a problem in which the plasticizer is stuck to the photoreceptor to change the characteristics of the photoconductive material in the photoreceptor, or a problem in which the photoreceptor is stuck to the roller to peel off the surface of the photoreceptor from the photoreceptor.

The above problems can be solved by using a hard roller as the roller and using a flexible photosensitive belt as the photoreceptor.

However, in the case of using the photosensitive drum as the photoreceptor, at least two rollers are required to support the photosensitive belt. This leads to such problems not only that the structure is complicated, but also that the device is increased in size.

In order to solve all of the above problems, up to now, there has been known a photosensitive drum disclosed in Japanese Patent Examined Publication No. Hei 4-69383 (Japanese Patent Unexamined Publication No. Sho 59-192260).

The photosensitive drum disclosed in Japanese Patent Examined Publication No. Hei 4-69383 are shown in FIGS. 1 to 3.

A photosensitive drum 1 includes a rotary shaft 2, an elastically deformable elastic material layer 3 which is supported by the rotary shaft 2 and is of a cylindrical shape in a free state, and an outer layer 4 fitted on the periphery of the elastic material layer 3. The outer layer 4 includes an elastically deformable photoreceptor support layer 5, and a photosensitive layer 6 supported by a surface of the support layer 5. The elastic material layer 3 is filled between the rotary shaft 2 and the outer layer 4 substantially without the formation of a gap therebetween.

Since the photosensitive drum 1 includes the elastically deformable outer layer 4 and the elastic material layer 3 as described above, the surface of the photosensitive drum 1 can be elastically deformed with the application of an external force to the surface.

In FIG. 1, reference numeral 7 denotes a charging charger; 10, a developing roller; and 13, a transfer charger.

In forming an image, the photosensitive drum is rotationally driven clockwise in FIG. 1, and the photosensitive layer 6 of the drum 1 is charged to a predetermined polarity by the charging charger 7. An electrostatic latent image is formed on the drum 1 by the application of a light 8 onto a charged portion. The latent image is developed by toners carried by the developing roller 10 that rotates in a direction indicated by an arrow in the figure into a visual image, and is then transferred to a transfer sheet 12 by the transfer charger 13.

It should be noted that in FIG. 1, reference numeral 14 denotes a separation charger; 15, a cleaning blade; and 16, an electrically neutralizing charger.

According to the above structure, because the surface of the photosensitive drum 1 is elastically deformable, the developing roller 10 is pushed against the photosensitive drum 1 so that the surface of the photosensitive drum 1 can be elastically deformed in a radical direction thereof. For that reason, even though the peripheral surfaces of the photosensitive drum 1 and the developing roller 10 are slightly eccentric with respect to their central axial lines, their outer diameters are slightly dispersed in a manufacturing process, or at least the surface of the developing roller 10 is formed of a rigid body, the toners on the developing roller 10 can be brought in contact with the photosensitive drum 1 in a firm and stable state in comparison with the prior art without such inconvenience that the surface of the drum or the developing roller is wounded, thereby being capable of restraining the deterioration of the quality of a visual image which is caused by the occurrence of a large gap between the toners on the developing roller 10 and the surface of the drum 1. Also, when the developing roller 10 is not abutted against the surface of the drum 1 through the toners, but the former is disposed opposite to the latter at a fine interval, the interval between the developing roller 10 and the surface of the drum 1 can be prevented from becoming excessive. This is because when the photosensitive drum 1 and the developing roller 10 are disposed close to each other, even though parts of them are in contact with each other through toners, the photosensitive drum 1 is merely elastically deformed without the photosensitive drum 1 or the developing roller 10 being wounded.

In other words, the photosensitive drum 1 thus structured can prevent the photosensitive drum or the developing roller from being wounded and also the device from being increased in size even though hard developing roller is used.

It should be noted that the photosensitive drum like the above photosensitive drum is also disclosed in Japanese Patent Unexamined Publication No. Sho 58-90655.

On the other hand, Japanese Patent Unexamined Publication No. Sho 58-86550 discloses a drum-shaped image carrier member in which, as shown in FIG. 4, an endless belt made of non-magnetic metal and 0.01 to 2 mm in thickness, which has been prepared through electroforming is used as a drum base substance 31, an image carrier layer (photoconductive material layer) 32 is formed on the drum base substance 31, and both ends of the drum base substance 31 are supported by disc-shaped end plates 33, for the purpose of lighting the device in weight and preventing an inductive eddy current from occurring.

The photosensitive drum 1 disclosed in the above-mentioned Japanese Patent Examined Publication No. Hei 4-69383(refer to FIGS. 1 to 3) is structured such that the elastic material layer 3 fills between the rotary shaft 2 and the outer layer 4 substantially without forming a gap therebetween. As a result, the photosensitive drum 1 suffers from problems stated below.

Since the photosensitive layer 6 is formed on the elastic material layer 3, the photosensitive layer 6 is deviated along the axial direction by receiving very small force. Since the developing roller 10 and the pressure member such as the cleaning blade 15, which are pressed by the photosensitive layer 6, are arranged on the photosensitive layer 6, when the rotation shaft of the photosensitive layer 6 and the shaft of the pressure member are inclined, or the pressure force becomes ununiform along the shaft direction, then the photosensitive layer 6 receives the thrust force along the axial direction, and thus the photosensitive layer 6 is deviated by this thrust force along the axial direction. Then, since this thrust force is varied, the image formed on the photosensitive layer 6 is also deviated along the axial direction. As a result, there is a problem that the positional precision of the image along the axial direction is deteriorated. In particular, when the multiple color overlapping operation is carried out, deterioration in the color overlapping precision may cause shifts in color hue. Therefore, there is another problem that the image is considerably deteriorated.

That is, as a method of manufacturing the photosensitive drum 1 thus structured, there are proposed the following three methods.

(1) A method of manufacturing the photosensitive drum 1 in which the outer layer 4 having the photosensitive layer 6 formed on the photoreceptor support layer 5 is first prepared, the shaft 2 and the outer layer 4 are then disposed at a given interval, and thereafter a heated elastic material is made to flow in a space between the shaft 2 and the outer layer 4 to form the elastic material layer 3.

(2) A method of manufacturing the photosensitive drum 1 in which the shaft 2 and the photoreceptor support layer 5 are first disposed at a given interval, a heated elastic material is made to flow in a space between the shaft 2 and the photoreceptor support layer 5 to form the elastic material layer 3, and thereafter the photosensitive layer 6 is formed on the photoreceptor support layer 5.

(3) A method of manufacturing the photosensitive drum 1 in which a cylindrical elastic member is prepared which has an outer diameter slightly larger than an inner diameter of the outer layer 4, and the cylindrical elastic member is inserted into the interior of the outer layer 4 in a state where it is compressed radially to form the elastic material layer 3.

However, the above method (1) suffers from such a problem that the photoreceptor characteristics are deteriorated by heat and so on since a work is conducted to make the heated elastic material flow into the interior of the outer layer 4 in a state where the photosensitive layer 6 is formed on the surface of the outer layer 4. Also, there is a case in which the surface of the photosensitive layer 6 is wounded, or a foreign material (a foreign material such as an elastic material) is stuck onto the surface of the photosensitive layer 6.

In the above method (2), since the photosensitive layer 6 is formed after the elastic material layer 3 is formed, the elastic material layer 3 is swelled, melted or hardened by a cleaning solvent or a coating solvent which is used during a photosensitive layer coating process, resulting in a case where the function of the elastic material layer is deteriorated.

Therefore, the above methods (1) and (2) make it very difficult to obtain a desired photosensitive drum 1.

On the other hand, in the above method (3), there is a case where during a process in which the cylindrical elastic member is expanded toward the outer layer 4 after it is released from the compressed state, the cylindrical elastic member is ununiformly expanded. As a result, the coaxial degree of the shaft 2 and the outer layer 4 becomes poor so that a shake of the photosensitive drum 1 when the photosensitive drum 1 rotates may become very large. In the image forming apparatus, because abutment members that abut against the photoreceptor, such as the charging means, the developing means, the transfer means and the cleaning means are disposed in the periphery of the photoreceptor, when the shake of the photoreceptor becomes large, a contact state of the photoreceptor with the abutment members is unstabilized, with the result that there arises a problem that an image is blurred.

On the other hand, the drum-shaped image carrier member disclosed in Japanese Patent Unexamined Publication No. Sho 58-86550(refer to FIG. 4) suffers from such a problem that because the thickness of its drum base substance 31 is thin to the degree of 0.01 to 2 mm, if an operator erroneously presses its central portion, the drum base substance 31 is damaged. Because the image carrier of this type is normally of exchangeable parts, if the image carrier may be damaged depending on its handling manner, it is extremely difficult to conduct an exchange work.

On the other hand, it is conceivable that if in the drum-shaped image carrier member (see FIG. 4) described in the above-described Japanese Laid-open Patent Application 58-86550, the drum base body 31 thereof can be easily flexed inside, this drum base body 31 may be utilized as the quasi-soft material. It can be expected to solve the problems involved in the photosensitive drum 1 (see FIG. 1 to FIG. 3) as described in the above-explained Japanese Patent Publication No. 4-69383.

However, no description about utilizations of the drum base body 31 as the quasi-soft material in this Japanese Laid-open Patent Application No. 58-86550. Moreover, conventionally, it is very difficult to fix the drum base body 31 manufactured by the electroforming method in the thinner cylindrical shape capable of readily flexing this base body inwardly by using the disk-shaped edge plate 33 in such a manner that a sectional shape thereof becomes round.

The reason is given as follows. In general, in a cylindrical body formed by way of the electroforming, thicknesses of both end portions become considerably unequal to each other, and the surfaces thereof become concave/convex. Under such conditions, first of all, a cylindrical body results whose length is longer than that of an actually used cylindrical body. Subsequently, both end portions of this cylindrical body are cut out by a cutter and the like, and thus only a central portion thereof is required to be used. Conventionally, generally speaking, when the cylindrical body is cut out, this cylindrical body is cut out while the cutter abuts against the out side of the cylindrical body. Therefore, burrs are produced on the inner circumferential side of the cylindrical body when the cylindrical body is cut out. When the cylindrical body (namely, drum base body 31) is fixed on the edge plate 33 while the burrs are being formed on the side of the inner circumferential surface of the cylindrical body, since the burrs are present between the inner circumferential surface of the base body 31 and the outer circumferential surface of the edge plate 33, it is impossible to fix the drum base body 31 on the edge plate 33 in such a manner that the sectional shape of this drum base body 31 becomes round, or circular. To achieve this fixing operation, the burrs must be removed. However, if the burrs are mechanically removed, then there are risks that the base body 31 is deformed. Also, when the burrs are removed by way of the electrolytic grinding, or polishing, the thicknesses of the both end portions becomes unequal. As a consequence, there is no meaning why the both end portions should be previously cut out.

As previously explained reasons, it is very difficult in the prior art to fix the drum base body 31 formed by way of the electroforming method by using the disk-shaped edge plate 33 in the thinner cylindrical shape capable of being easily flexed inwardly in such a manner that the sectional shape thereof becomes round.

In the case that the drum base body 31 can be readily flexed inwardly in the above-explained drum-shaped image carrier member (see FIG. 4), there is another problem that the center portion thereof is mistakenly depressed by an operator. Usually, since this sort of an image carrier is a replaceable product, when this image carrier is damaged due to a handling problem, the replacement work would become very difficult.

However, no description about utilizations of the drum base body 31 as the quasi-soft material in this Japanese Laid-open Patent Application No. 58-86550. Moreover, since this drum-shaped image carrier member (see FIG. 4) is constructed in such a way that both ends of the drum base body 31 are directly supported by the simple disk-shaped edge plate 33, the following problems will occur:

That is to say, since the fitting tolerance exists in the drum base body 31 and the disk-shaped edge plate 33, the drum base body 31 is floated from the circumferential plane of the edge plate 33 by this fitting tolerance, so that the roundness, or circularity of the drum base body 31 is deteriorated, and then the vibrations in the image carrier layer (photoconductive material layer) 32 are increased. If the fitting tolerance is reduced as much as possible, then this problem may be more or less improved. If so, then it is very difficult to fit the drum base body 31 into the edge plate 33, namely it is considerably difficult to manufacture the fitting components.

In the case that the drum base body 31 can be readily flexed inwardly, there is another problem that is the center portion thereof is mistakenly depressed by an operator, then it is destroyed. Usually, since this sort of an image carrier is a replaceable product, when this image carrier is damaged due to a handling problem, the replacement work would become very difficult.

However, since this drum-shaped image carrier (see FIG. 4) is structured by that both ends of the drum base body 31 made of Cu, Al, W, and Mo are fixed on the shaft 34 made of iron by employing the disk-shaped edge plate 33, there are the following problems.

That is to say, since the drum base body 31 is fixed on the edge plate 33 fixed on the shaft 34, and also both the shaft 34 and the drum base body 31 are constituted by the above-explained different sorts of materials, a large thermal distortion will occur inside the drum-shaped image carrier member when the temperatures are changed in the use environment and the transport environment.

As a result, the cylindrical drum base body 31 made of the thin body is distorted and deformed, resulting in vibrations. As a consequence, the intervals among the respective process members such as the developing roller are varied due to the temperature environments. Thus, it is not possible to achieve the stable/firm contact condition, or the gap management. There are risks that the image qualities are deteriorated due to fluctuations in the charging operation, the developing failure, and the transferring failure.

Also, the thinner cylindrical drum base body 31 is bent, broken, or permanently deformed due to the thermal distortion.

Furthermore, there is another risk that the fixing portions of the constructive components are destroyed due to the thermal stress.

Also, when the drum base body 31 can be readily flexed inwardly, if the central portion thereof is mistakenly depressed by the operator, then this drum base body 31 would be destroyed. Since this sort of image carrier is usually the replacement part, if this replaceable image carrier is destroyed due to poor handling, then the replacement work can be very hardly carried out.

SUMMARY OF THE INVENTION

The present invention has been made to solve the above-mentioned various problems, and therefore an object of the present invention is to provide an image forming apparatus which is capable of obtaining a firm and stable contact state of the photoreceptor with a hard roller, which is excellent in handling and which is capable of being downsized.

Further another object of the present invention, is to provide an image carrier unit made in a simple manner, and capable of obtaining stable/firm contact conditions with respect to an abutting member such as a hardness roller without occurrences of destruction even when temperatures are varied under use environments and transport environments.

In order to achieve the above object, according to another aspect of the present invention, an image carrier unit comprises: a flexible cylindrical thin image carrier; a pair of support members which support both ends of said image carrier; and a rigid cylindrical member having an outer diameter smaller than an inner diameter of said image carrier, which is disposed inside of said image carrier; wherein said cylindrical member is disposed at an interval smaller than an allowable deformation between an outer peripheral surface of said cylindrical member and an inner peripheral surface of said image carrier.

In order to achieve the above object, according to the present invention, an image forming apparatus comprises: a flexible cylindrical thin image carrier on an outer peripheral surface of which a photosensitive layer is formed; a pair of support members for supporting both ends of said image carrier; a rigid cylindrical member having an outer diameter smaller than an inner diameter of said image carrier, which is disposed inside of said image carrier; charging means for uniformly charging the outer peripheral surface of said image carrier; exposing means for selectively exposing the outer peripheral surface of said image carrier which has been uniformly charged by said charging means to form an electrostatic latent image; developing means for developing the electrostatic latent image formed by said exposing means; and transfer means for transferring the image developed by said developing means onto a transfer medium;

wherein said cylindrical member is disposed at an interval smaller than an allowable deformation of said image carrier between an outer peripheral surface of said cylindrical member and an inner peripheral surface of said image carrier; and wherein at least one of said charging means, said developing means and said transfer means is in contact with said image carrier so that said image carrier is bent inwardly until the inner peripheral surface of said image carrier is abutted against the outer peripheral surface of said cylindrical member, and is formed of a hard roller that rotates at a peripheral velocity identical with a peripheral velocity of said image carrier.

To achieve the above-described object, an image forming apparatus, according to the present invention, comprises: a cylindrical image carrier made of a thin body and having a flexibility characteristic,. in which a photosensitive layer is formed on an outer circumferential surface thereof; one pair of supporting members for supporting both end portions of this image carrier; a rigid cylindrical member having an outer diameter smaller than an inner diameter of the image carrier, and arranged inside the image carrier; charging means for uniformly charging the outer circumferential surface of the image carrier; exposing means for selectively exposing the outer circumferential surface uniformly charged by this charging means to thereby form an electrostatic latent image; developing means for developing the electrostatic latent image formed by this exposing means; and transferring means for transferring an image developed by this developing means to a transfer medium; wherein:

the cylindrical member is arranged between an outer circumferential surface thereof and an inner circumferential surface of the image carrier with maintaining an interval therebetween which is smaller than an allowable deformation amount of the image carrier, and the cylindrical member owns a projection portion which is projected toward both sides of the image carrier along an axial line direction thereof;

at least one of the charging means, the developing means, and the transferring means is constructed of a hardness roller which is made in contact with the image carrier and flexes the image carrier inwardly within a range where the inner circumferential surface of the image carrier does not abut against the outer circumferential surface of the cylindrical member; and interval defining members are provided at both end portions of a shaft of this hardness roller, and the interval defining members directly abut against outer circumferential surfaces of the projection portions projected toward the both sides of the image carrier in the cylindrical member, whereby the interval defining members define an interval between a shaft line of the roller and an axial line of the image carrier.

To achieve the above-described object, an image carrier unit of the present invention comprises: a cylindrical image carrier made of a thin body and having a flexibility characteristic; a rigid cylindrical member having an outer diameter of this image carrier and arranged inside the image carrier; and one pair of supporting members positioned between this cylindrical member and the image carrier, for supporting both end portions of the image carrier; wherein:

this supporting member includes a spacer having an elastic portion for elastically and uniformly supporting the image carrier from an inside thereof; and a fixing member for fixing the image carrier supported by this spacer and the cylindrical member; and the image carrier is supported by this supporting member between an inner circumferential surface thereof and an outer circumferential surface of the cylindrical member with maintaining an interval smaller than an allowable defomation amount of the image carrier.

To achieve the above-described objects, an image carrier unit of the present invention comprisies: cylindrical image carrier made of a thin body and having a flexibility characteristic; a supporting member for supporting inwardly both end portions of the image carrier, which is arranged inside the image carrier and has an outer diameter smaller than an inner diameter of this image carrier; and fixing means for fixing the both end portions of said image carrier on this supporting member; wherein:

a burr formed when member longer than a cylindrical member made of a thin body for constituting the image carrier is formed on an outer circumferential surface of the cylindrical member made of the thin body.

To achieve the above-described object, an image carrier unit of the present invention comprises:

a cylindrical image carrier made of a thin body and having a flexibility characteristic, in which burrs are formed inwardly at both end portions thereof;

a supporting member having an outer diameter smaller than and inner diameter of this image carrier by at least a value equal to a height of the butts and arranged inside the image carrier, for inwardly supporting the both end portions of the image carrier; and adhesive agent for adheres the both end portions of the image carrier and the supporting member while using the burrs as an adhesive base.

To achieve the above-described object, an image carrier unit of the present invention comprises: a cylindrical image carrier made of a thin body and having a flexibility characteristic; a rigid cylindrical member having an outer diameter smaller than an inner diameter of this image carrier, and arranged inside the image carrier; and a fixing member for fixing both end portions of said image carrier on this cylindrical member; wherein: a coefficient of linear expansion of said image carrier is substantially equal to that of said cylindrical member.

Since the image carrier unit according to the present invention is structured such that both ends of the flexible cylindrical thin image carrier are supported by a pair of support members, the central portion of the image carrier which is not supported by the support members is deformable inwardly.

Therefore, because the central portion of the image carrier can be used as a so-called artificial soft material, even though a member that is abutted against the central portion is hard (for example, a hard roller), a firm and stable contact state can be obtained, and an image can be surely formed or carried on the image carrier.

Also, since the image carrier unit can be manufactured by disposing the cylindrical member inside of the image carrier and supporting both ends of the image carrier by a pair of support members, it is unnecessary that the elastic material layer fills as in the photosensitive drum 1 disposed in the above-mentioned Japanese Patent Examined Publication No. Hei 4-69383 (refer to FIGS. 1 to 3), thereby being capable of simply manufacturing the image carrier unit.

Further, the rigid cylindrical member is disposed inside of the image carrier so that the outer peripheral surface of the cylindrical member and the inner peripheral surface of the image carrier are apart from each other at an interval smaller than the allowable deformation of the image carrier. With this structure, for example, even though an operator erroneously strongly presses the central portion of the image carrier during an exchange work of the image carrier unit, etc., the image carrier is supported by the cylindrical member before the image carrier becomes damaged, with the result that the image carrier is not damaged. Therefore, the image carrier unit is excellent in handling in comparison with the drum-shaped image carrier member disclosed in the above-mentioned Japanese Patent Unexamined Publication No. Sho 58-86550.

Furthermore, since the image carrier is not damaged even though it is strongly pressed, for example, an abutment member such as a cleaning blade can be strongly abutted against the image carrier.

In other words, the image carrier unit according to the present invention can obtain such effects that it can provide the firm and stable contact state of the image carrier with abutment member such as a hard roller, and also that it is simple in manufacture and excellent in handling.

Since the image carrier unit according to the present invention is structured such that both ends of the flexible cylindrical thin image carrier are supported by a pair of support members, the central portion of the image carrier which is not supported by the support members can be deformed inwardly.

Therefore, because the central portion of the image carrier can be used as a so-called artificial soft material, even though a member that is abutted against the central portion is hard (for example, a hard roller), a firm and stable contact state can be obtained, and an image can be surely formed or carried on the image carrier.

Also, since both ends of the image carrier are structured to be supported by the tapered surfaces of the support members, even though a manufacturing error exists between the image carrier and the tapered surfaces of the support members, the error is absorbed with the tapered surfaces, thereby being capable of strictly bringing both ends of the image carrier in close contact with the tapered surfaces. Therefore, the coaxial degree of the image carrier and the support members can be readily ensured with the result that the shake of the image carrier when the image carrier rotates is small, thereby making it difficult to blur an image.

Further, since the image carrier unit can be manufactured by supporting both ends of the image carrier by the tapered surfaces of the paired support members, the manufacture can be simplified.

In other words, the image carrier unit according to the present invention can obtain such effects that it can provide a firm and stable contact state of the image carrier with an abutment member such as a hard roller, that the shake of the image carrier when the image carrier rotates is small, and that the image carrier unit is simple in manufacture.

Since the image carrier unit according to the present invention is structured such that a pair of support members support both ends of the image carrier at their tapered surfaces, the operation and effects obtained by the image carrier unit according to the invention and those according to the invention can be obtained together.

In other words, the image carrier unit according to the present invention can obtain such effects that it can provide a firm and stable contact state of the image carrier with an abutment member such as a hard roller, that the shake of the image carrier when the image carrier rotates is small, and that the image carrier unit is simple in manufacture and excellent in handling.

The image carrier unit according to the present invention is structured such that, in the image carrier unit according to the invention, one of said pair of support members supports one end of said image carrier and one end of said cylindrical member integrally, and the other support member is slidable axially with respect to the other end of said cylindrical member. With this structure, even though the image carrier and the cylindrical member are different in the coefficient of linear expansion in their axial direction, a difference of expansion of both the members is absorbed by the axial movement of the other support member with respect to the other end of the cylindrical member.

Therefore, the undesired thermal stress or deformation of the image carrier is prevented, to thereby hold a uniform cylindrical state.

The image carrier unit according to the present invention is designed such that, in the image carrier unit according to the invention, said pair of support members include flanges larger in outer diameter than said image carrier, respectively. With this structure, for example, even though an operator puts the image carrier unit on a desk, the image carrier is not in direct contact with the desk or the like and not damaged, thereby further improving in handling.

Furthermore, when the abutment member is abutted against the image carrier, the flanges can be used as the interval regulating means that regulates an interval between the image carrier and the abutment member.

The image carrier unit according to the present invention is designed such that, in the image carrier unit according to the invention, the air vent is defined in at least one of said pair of support members. With this structure, the deformation of the image carrier caused by a change in atmospheric pressure can be prevented.

The image forming apparatus according to the present invention includes the image carrier unit having a photosensitive layer formed on the outer peripheral surface of the image carrier; the charging means for uniformly charging the outer peripheral surface of the image carrier; the exposing means for selectively exposing the outer peripheral surface of the image carrier which has been uniformly charged by the charging means to form an electrostatic latent image; the developing means for developing the electrostatic latent image formed by the exposing means; and the transfer means for transferring the image developed by the developing means to the transfer medium. With this structure, the image can be formed or carried on the image carrier to form a final image.

Then, since at least one of the charging means, the developing means and the transfer means is made up of a hard roller, the costs of the apparatus can be made low.

Also, since the image carrier is cylindrical, the apparatus can be downsized in comparison with the structure in which a belt is supported by two rollers as in the conventional apparatus.

In other words, with the image forming apparatus according to the present invention, the firm and stable contact state of the image carrier with the hard abutment member can be obtained by using the above image carrier unit, and also the apparatus can be downsized and reduced in the price.

Further, the image forming apparatus according to the present invention is designed such that the flange of the image carrier unit constitutes the interval regulating means for regulating an interval between an axis of the roller and an axis of the image carrier. With this structure, the deformation of the image carrier which is caused by the abutment of the roller is held constant so that the roller can be abutted against the image carrier in a more stable state, with the result that a more stable image can be formed.

The image forming apparatus according to the present invention includes the cleaning means for removing the developer which remains on the outer peripheral surface of the image carrier after the image has been transferred by the transfer means. With this structure, the image carrier is cleaned so that a clearer image can be formed.

Then, the cleaning means includes the cleaning member which is in contact with the image carrier and presses the image carrier until the inner peripheral surface of the image carrier is abutted against the outer peripheral surface of the cylindrical member to remove the developer on the outer peripheral surface of the image carrier. With this structure, the image carrier can be more surely cleaned.

Since there are provided the image carrier on the outer peripheral surface of which the photosensitive layer is formed, the charging means for uniformly charging the outer peripheral surface of the image carrier, the exposing means for selectively exposing the outer peripheral surface of the image carrier which has been uniformly charged by the charging means to form the electrostatic latent image, the developing means for developing the electrostatic latent image formed by the exposing means, and the transfer means for transferring the image developed by the developing means onto a transfer medium, the image can be formed or carried on the image carrier to form a final image.

In the image forming apparatus according to the present invention, since at least one of the charging means, the developing means and the transfer means is formed of a hard roller which is in contact with the image carrier so that the image carrier is bent inwardly until the inner peripheral surface of the image carrier is abutted against the outer peripheral surface of the cylindrical member, at least the means which is formed of a hard roller can be brought in contact with the image carrier in a firm and stable state.

When the hard roller is in contact with the image carrier so that the image carrier is bent inwardly until the inner peripheral surface of the image carrier is abutted against the outer peripheral surface of the cylindrical member, the image carrier comes to a state in which it is held between the hard roller and the cylindrical member. In this state, the image carrier is in contact with the hard roller in a firm and stable state under an appropriate pressure contact force.

Further, since the hard roller rotates at the peripheral velocity identical with the peripheral velocity of the image carrier, no difference in relative velocity occurs between the hard roller and the image carrier on the contact portion thereof. Hence, since no friction occurs on the contact portion, and no vibrating movement caused by the friction also occurs, a stable contact rotation can be obtained.

Further, the rigid cylindrical member is disposed inside of the image carrier so that the outer peripheral surface of the cylindrical member and the inner peripheral surface of the image carrier are apart from each other at an interval smaller than the allowable deformation of the image carrier. With this structure, for example, even though an operator erroneously strongly presses the central portion of the image carrier during an exchange work of the image carrier, etc., the image carrier is supported by the cylindrical member before the image carrier comes to a damage, with the result that the image carrier is not damaged. Therefore, the image forming apparatus is excellent in handling in comparison with the drum-shaped image carrier member disclosed in the above-mentioned Japanese Patent Unexamined Publication No. Sho 58-86550.

Further, interval defining members are provided at both end portions of a shaft of this hardness roller, and the interval defining members directly abut against outer circumferential surfaces of the projection portions projected toward the both sides of the image carrier in the cylindrical member, whereby the interval defining members define an interval between a shaft line of the roller and an axial line of said image carrier. Thus, the amount of the deformation of the image carrier by contacting the roller is maintained in stable. Thus, the roller contact condition with respect to the image carrier is in more stable condition. As a result, more stable image could be obtained.

Namely, since the interval defining members are provided at both end portions of the shaft of this hardness roller and the interval defining members directly abut against outer circumferential surfaces of the cylindrical member, the tolerance between the roller and the cylindrical member becomes in small. Thus, the image carrier is deformed in stable condition.

Moreover, the supporting member includes a spacer having an elastic portion for elastically and uniformly supporting said image carrier from an inside thereof; and a fixing member for fixing the image carrier supported by this spacer and the cylindrical member. Accordingly, this image carrier unit can be easily manufactured, as compared with the drum-like image carrier member (FIG. 14) of Japanese Laid-open Patent Application No. 58-86550. Also, the image carrier supported by the spacer is fixed by the fixing member under such a condition that the intervals with respect to the cylindrical member are made equal to each other, namely substantially roundness condition. As a consequence, it is possible to obtain such a stable rotation condition that the deviation and the vibrations of the image carrier are very low (namely, high vibration precision).

According to the image carrier unit of the present invention, when the cylindrical member is positioned inside the image carrier, the spacer is compressed by the cylindrical member and the image carrier to thereby elastically support the image carrier. Therefore, the image carrier unit can be more simply manufactured by previously mounting this spacer on either the cylindrical member, or the image carrier.

In accordance with the image carrier unit of the present invention, the spacer elastically supports the image carrier in such a manner that an inside of the image carrier is supported at plural portions thereof in an equiinterval along a circumferential direction. Accordingly, the elastic force made by the spacer is distributed under better conditions over the circumferential direction of the image carrier, so that the image carrier can be more uniformly supported with respect to the cylindrical member.

In accordance with the image carrier unit of the present invention, the cylindrical member and the supporting members own electroconductivity. Thus, the electroconductivity required to form the image with respect to the image carrier can be obtained by way of these cylindrical member and supporting members. As a consequence, there is no need to separately employ the conducting means.

In accordance with the image carrier unit of the present invention, the supporting member is positioned slightly near a center side, rather than an edge portion of the image carrier. Since the image carrier is more uniformly supported with respect to the cylindrical member, higher vibration precision can be achieved.

Precisely speaking, for example, when the image carrier is constructed by way of the electroforming method, burr may be produced in the edge portions thereof due to the cutting work. If the edge portions of the image carrier are supported by the supporting members without eliminating the burr and the like, then there is a risk that the intervals of the image carrier with respect to the cylindrical member becomes unequal, which is caused by the adverse influences of the burr and the like. On the other hand, when the burr and the like are removed, there are problems that distortion is newly applied to the cylindrical image carrier made of the thin body, the deformation is increased, but also a large number of manufacturing stages are required.

Moreover, in this image carrier unit, the burrs are formed on the outer circumferential surface of the thinner cylindrical member when the member whose length is longer than that of the thinner cylindrical member is cut out to obtain this thinner cylindrical member for constituting this image carrier is supported inwardly by the supporting member, these burrs do not cause cumbersome works.

As a consequence, the image carrier can be readily supported on the supporting member in the roundness manner.

In other words, according to the image carrier unit of the present invention, there is such an effect that it is possible to obtain the stable/firm contact state with the abutting member such as the hardness roller, and also to make it simple.

According to the image carrier unit of the present invention, said fixing means is equipped with a spacer interposed between the image carrier and the supporting member and having an elastic portion for elastically and uniformly supporting said image carrier inwardly; and an adhesive agent for adhering the image carrier supported by this spacer to the supporting member. Therefore, the image carrier unit can be more simply manufactured.

The image carrier unit of the present invention, may be manufactured by that, for example, while the supporting member and the image carrier are properly held in the coaxial manner by a jig and the like, the adhesive agent functioning as the fixing means is injected into the space between the end portions of the image carrier and the supporting member. However, in this case, the relatively cumbersome work is required to hold the supporting member and the image carrier in the coaxial manner by properly using the jig.

To the contrary, in accordance with the image carrier unit of the present invention, the fixing means is equipped with a spacer interposed between the image carrier and the supporting member and having an elastic portion for elastically and uniformly supporting said image carrier inwardly. Accordingly, when the image carrier is mounted on the supporting member, this image carrier is held on the supporting member in the coaxial manner. At this time, since the burrs are formed on the outer circumferential surface of the thinner cylindrical member, the image carrier member can be uniformly supported without being adversely influenced by the burrs.

As a consequence, according to the image carrier unit of the present invention, no specific tool, i.e., jig is required which may hold the supporting member and the image carrier in the coaxial manner. The image carrier is mounted on the supporting member, and the end portion of the image carrier and the supporting member are fixed by using the adhesive agent, so that the image carrier unit can be more simply manufactured.

According to the image carrier of the present invention, said adhesive agent adheres both said spacer and an end portion of the image carrier to the supporting member. As a result, it is possible to obtain a further fixing condition of the end portion of the image carrier.

According to the image carrier of the present invention, said supporting member has a taper surface for supporting inwardly both end portions of the image carrier. As a consequence, even when there is a manufacturing error between the image carrier and the tape surface of the supporting member, this manufacturing error can be absorbed by the taper surface. At this time, since the burrs are formed on the outer circumferential surface of the thinner cylindrical member for constituting the image carrier, the burrs never disturbs that the image carrier abuts against the taper surface of the supporting member. As a consequence, the both end portions of the image carrier can be surely fitted to the taper surface, and the coaxial degree established between the image carrier and the supporting member can be easily secured. As a result, the vibrations produced while the image carrier is rotated are reduced, and thus the fluctuation in the image is lowered.

Furthermore, since this image carrier unit is manufactured by supporting the both end portions of the image carrier are supported by the taper surface of the supporting member and fixed by the fixing means, the image carrier unit can be simply manufactured.

According to the image carrier unit of the present invention, said fixing means is equipped with an adhesive agent for adhering the end portion of the image carrier to the supporting member while covering said burr. As a consequence, the burr may function as the adhesive agent, the adhesive area is increased, and therefore, the adhesive strength is increased. There are such effects that the durability and the reliability are increased.

According to the image carrier unit of the present invention, said supporting member owns a rigid cylindrical member whose length along an axial line direction is made longer than that of said image carrier; and said image carrier is arranged between an inner circumferential surface thereof and an outer circumferential surface of said cylindrical member with maintaining an interval smaller than an allowable deformation amount of the image carrier. For example, even when an operator mistakenly depresses the center portion of the image carrier with his strong force while, for example, the operator replaces the image carrier unit, the image carrier may be supported by the cylindrical member before being damaged. Accordingly, there is no risk that the image carrier is not destroyed. As a consequence, this image carrier unit can own the superior operability rather than the drum-shaped image carrier member (see FIG. 19) disclosed in the above-explained Japanese Laid-open Patent Application No. 58-86550.

Further, even when the image carrier is strongly depressed, since this image carrier is not destroyed, the abutting member can abut against the image carrier.

In other words, according to the image carrier unit of the present invention, it is possible to achieve the stable/firm contact condition with respect to the abutting member such as the hardness roller, and also there are such effects that the manufacture of the image carrier unit can be done simply, and the superior operability can be realized.

According to the image carrier unit of the present invention, said supporting member is equipped with a rigid cylindrical member having an outer diameter smaller than an inner diameter of the image carrier and arranged inside the image carrier; and said image carrier is arranged between an inner circumferential surface and the outer circumferential surface with maintaining a space smaller an allowable information amount of the image carrier. Similar to the image carrier unit as recited in claim 6, it is possible to achieve the stable/firm contact condition with respect to the abutting member such as the hardness roller, and also there are such effects that the manufacture of the image carrier unit can be done simply, and the superior operability can be realized.

According to the image carrier unit of the present invention, both said supporting member and said fixing member own electroconductivity. Accordingly, the electric conductivity required to form the image for the image carrier can be obtained via these supporting member and fixing means. As a consequence, there is no need to especially employ the conducting means.

In accordance with the image carrier of the present invention, the image carrier unit is equipped with a spacer interposed between the image carrier and the supporting member and having an elastic portion for elastically and uniformly supporting the image carrier inwardly inside the burr portion along the axial line direction. As a result, when the image carrier is mounted on this supporting member, the image carrier is held on the supporting member in the coaxial manner. It should be understood that since the elastic portion uniformly supports the image carrier inwardly inside the burr portion along the axial line direction, the image carrier can be uniformly supported without being adversely influenced by the burrs.

As a consequence, according to the image carrier unit of the present invention, no specific tool, i.e., jig is required which may hold the supporting member and the image carrier in the coaxial manner. The image carrier is mounted on the supporting member, and the end portion of the image carrier and the supporting member are fixed by using the adhesive agent, so that the image carrier unit can be more simply manufactured.

When the taper surface of the supporting member is lightly pressure-inserted into the both end portions of the image carrier, the edge portion of the image carrier is widened, and also the inside portion along the axial line direction thereof abuts against the taper surface of the supporting member and then is supported by this taper surface. Accordingly, the image carrier is supported by the supporting member in the coaxial manner without being adversely influenced by the burrs.

Moreover, in this image carrier unit, the burrs are formed inwardly on both ends of this image carrier. Since the both end portions of the image carrier are adhered to the supporting member by the adhesive agent while using this burr as the adhesive base, the adhesive area is increased. As a result, since the adhesive strength is increased, there are the effects that the durability and the reliability are improved.

In other words, according to the image carrier unit of the present invention, there is such an effect that it is possible to obtain the stable/firm contact state with the abutting member such as the hardness roller, and also to make it simple.

The image carrier unit of the present invention is constituted by that the both end portions of the thinner cylindrical-shaped image carrier having the flexibility characteristic are supported inwardly by the supporting member arranged inside the image carrier. Accordingly, the center portion of this image carrier which is not supported by the supporting members can be deformed inwardly.

As a result, since the central portion of this image carrier may be utilized as a so-called "quasi-soft material", even when a member which will abut against this quasi-soft material is made hard (for example, hardness roller), it is possible to achieve the stable/firm contact condition. Therefore, the image can be firmly formed on the image carrier, or the image can be surely carried.

Also, this image carrier unit may be arranged by that the supporting member is arranged inside the image carrier, and thus the both end portions of the image carrier are fixed to the supporting member by the fixing means. Since there is no need to fill therein the elastic material layer as in the photosensitive drum of the above-described Japanese Patent Publication No. 4-69383, it is possible to simply manufacture the image carrier unit.

Moreover, the fixing means has the ring-shaped elastic member into which the burr is embedded, and which is interposed between the image carrier and the supporting member. The image carrier is held on the supporting member in the coaxial manner by the elastic force of the ring-shaped elastic member, and also the burr is embedded in the elastic member. Thus, the coupling force between the image carrier and the elastic member is strengthened. Then, since this elastic member and the image carrier end portion are adhered to the supporting member by the adhesive agent, the image carrier unit can be simply manufactured without using the specific jig and the like, and also the strength fixing condition can be obtained.

In other words, according to the image carrier unit of the present invention, there is such an effect that it is possible to obtain the stable/firm contact state with the abutting member such as the hardness roller, and also to make it simple, and further the durability and the reliability are improved.

The image carrier unit of the present invention is constituted by that the both end portions of the thinner cylindrical-shaped image carrier having the flexibility characteristic are supported inwardly by the supporting member arranged inside the image carrier. Accordingly, the center portion of this image carrier which is not supported by the supporting members can be deformed inwardly.

As a result, since the central portion of this image carrier may be utilized as a so-called "quasi-soft material", even when a member which will abut against this quasi-soft material is made hard (for example, hardness roller), it is possible to achieve the stable/firm contact condition. Therefore, the image can be firmly formed on the image carrier, or the image can be surely carried.

Also, this image carrier unit may be arranged by that the both end portions of the image carrier are supported inwardly by the supporting member in such a way that the burr portions of the both end portions of the image carrier are deformed, so that both the image carrier and the supporting member are fixed by the recovery force exerted by the deformed burr portions. Therefore, the image carrier unit can be manufactured by supporting the both end portions of the image carrier by the supporting member in the above-described manner. Since there is no need to fill therein the elastic material layer as in the photosensitive drum 1 of the above-described Japanese Patent Publication No. 4-69383, it is possible to simply manufacture the image carrier unit.

It should be noted that since the burr portion of the image carrier is supported by the supporting member, the both end portions are distorted with being enlarged. As a consequence, the roundness degree in the both end portions is deteriorated. However, since the image carrier is made as the thinner cylindrical shape having the flexibility, the above-described distortion is reduced along the center portion of the image carrier, so that the roundness degree can be maintained without practical problem in the central portion except for the both end portions.

As previously explained, according to the image carrier unit of the present invention, there is such an effect that it is possible to obtain the stable/firm contact state with the abutting member such as the hardness roller, and also to make it simple.

According to the image carrier unit of the present invention, the image carrier unit is equipped with a spacer interposed between the image carrier and the supporting member, and having an elastic portion for elastically and uniformly the image carrier inwardly on an inner side from the burr portions along an axial line direction. As a result, such distortion that is produced in the both end portions of the image carrier and is decreased toward the central portion can be firmly removed in the spacer portion.

As a consequence, the roundness degree in the center portion of the image carrier can be surely obtained.

According to the image carrier unit of the present invention, the burr portion is further adhered to the supporting member by adhesive agent. Accordingly, the image carrier and the supporting member can be more firmly fixed.

According to the image carrier unit of the present invention, the supporting member owns a rigid cylindrical member whose length along an axial line direction is made longer than that of the image carrier; and the image carrier is arranged between an inner circumferential surface thereof and an outer circumferential surface of the cylindrical member with maintaining an interval smaller than an allowable deformation amount of the image carrier. For example, even when an operator mistakenly depresses the center portion of the image carrier with his strong force while, for example, the operator replaces the image carrier unit, the image carrier may be supported by the cylindrical member before being damaged. Accordingly, there is no risk that the image carrier is not destroyed. As a consequence, this image carrier unit can own the superior operability rather than the drum-shaped image carrier member disclosed in the above-explained Japanese Laid-open Patent Application No. 58-86550.

Further, even when the image carrier is strongly depressed, since this image carrier is not destroyed, the abutting member can abut against the image carrier.

In other words, according to the image carrier unit of the present invention, it is possible to achieve the stable/firm contact condition with respect to the abutting member such as the hardness roller, and also there are such effects that the manufacture of the image carrier unit can be done simply, and the superior operability can be realized.

According to the image carrier unit of the present invention, said supporting member is equipped with a rigid cylindrical member having an outer diameter smaller than an inner diameter of the image carrier and arranged inside the image carrier; and the image carrier is arranged between an inner circumferential surface and the outer circumferential surface with maintaining a space smaller an allowable information amount of the image carrier. It is possible to achieve the stable/firm constant condition with respect to the abutting member such as the hardness roller, and also there are such effects that the manufacture of the image carrier unit can be done simply, and the superior operability can be realized.

According to the image carrier unit of the present invention, both the supporting member and the fixing member own electroconductivity. Accordingly, the electric conductivity required to form the image for the image carrier can be obtained via these supporting member and fixing means. As a consequence, there is no need to especially employ the conducting means.

Then, since the linear expansion coefficient of the image carrier is made substantially equal to that of the cylindrical member, even when the temperatures are changed in the use environment and the transport environment, the thermal distortion caused by the temperature expansion difference will not occur inside the image carrier unit. Even when the thermal distortion will occur, this distortion is very low.

As a result, the distortion/deformation of the thinner cylindrical image carrier are prevented, and the occurrence of the vibrations is also avoided. Therefore, the intervals among the respective process members such as the developing roller are not varied by the temperature environment, and the stable/firm contact condition, or the gap management can be realized. It is therefore possible to obtain the better images without any charging fluctuation, developing failure, and transferring failure.

There is no risk that the image carrier is bent, cut, or permanently deformed due to the thermal distortion. Also, there is no risk that the fixing portions of the constructive component are destroyed by receiving the thermal stress. As a result, the mechanical reliability is increased.

In other words, according to the image carrier unit of the present invention, there is such an effect that it is possible to obtain the stable/firm contact state with the abutting member such as the hardness roller, and also to make it simple and even when the temperatures are changed in the use environment and the transport environment, the image carrier unit is not destroyed.

The image carrier unit of the present invention is constituted by that the both end portions of the thinner cylindrical-shaped image carrier having the flexibility characteristic are fixed by the fixing member on the cylindrical member having the outer diameter smaller than the inner diameter of the image carrier. Even when a member which will abut against this quasi-soft material is made hard (for example, hardness roller), it is possible to achieve the stable/firm contact condition. Therefore, the image can be firmly formed on the image carrier, or the image can be surely carried.

Then, since the image carrier and the cylindrical member are constituted by the same sort of materials, even when the temperatures are changed in the use environment and the transport environment, the thermal distortion caused by the temperature expansion difference will not occur inside the image carrier unit. Even when the thermal distortion will occur, this distortion is very low.

As a result, the distortion/deformation of the thinner cylindrical image carrier are prevented, and the occurrence of the vibrations is also avoided. Therefore, the intervals among the respective process members such as the developing roller are not varied by the temperature environment, and the stable/firm contact condition, or the gap management can be realized. It is therefore possible to obtain the better images without any charging fluctuation, developing failure, and transferring failure.

There is no risk that the image carrier is bent, cut, or permanently deformed due to the thermal distortion. Also, there is no risk that the fixing portions of the constructive component are destroyed by receiving the thermal stress. As a result, the mechanical reliability is increased.

In other words, according to the image carrier unit of the present invention, there is such an effect that it is possible to obtain the stable/firm contact state with the abutting member such as the hardness roller, and also to make it simple and even when the temperatures are changed in the use environment and the transport environment, the image carrier unit is not destroyed.

In accordance with the image carrier unit of the present invention, it is so arranged that the both end portions of the thinner cylindrical-shaped image carrier having the flexibility characteristic are fixed by the fixing member on the cylindrical member having the outer diameter smaller than the inner diameter of the image carrier. Even when a member which will abut against this quasi-soft material is made hard (for example, hardness roller), it is possible to achieve the stable/firm contact condition. Therefore, the image can be firmly formed on the image carrier, or the image can be surely carried.

Then, the image carrier unit is arranged as follows:

while a length between coupling portions with the fixing member in the image carrier along an axial line direction, and a coefficient of linear expansion thereof are "L1" and "$\alpha 1$"; a length between coupling portions with the fixing member in the image carrier, and a coefficient of linear expansion thereof are "L3" and "$\alpha 3$"; lengths of the fixing member between coupling portions with respect to the image carrier and the cylindrical member along an axial line direction are L2, L4, and coefficients of linear expansion are "$\alpha 2$", "$\alpha 4$";

assuming now that Young's modulus of the image carrier is "E1", and allowable stress is "$\sigma a$"; the following formula is satisfied:

$$\sigma a > E1 \times \sum_{i=1}^{n} Li \times (1 + \alpha i \cdot \Delta T) / L1$$

Li: length of i-th member $\alpha i$: i-th linear expansion coefficient $\Delta T$: temperature difference Accordingly, even when the temperatures are changed in the use environment and the transport environment, the thermal distortion caused by the temperature expansion difference will not occur inside the image carrier unit. Even when the thermal distortion will occur, this distortion is very low.

As a result, the distortion/deformation of the thinner cylindrical image carrier are prevented, and the occurrence of the vibrations is also avoided. Therefore, the intervals among the respective process members such as the developing roller are not varied by the temperature environment, and the stable/firm contact condition, or the gap management can be realized. It is therefore possible to obtain the better images without any charging fluctuation, developing failure, and transferring failure.

There is no risk that the image carrier is bent, cut, or permanently deformed due to the thermal distortion. Also, there is no risk that the fixing portions of the constructive component are destroyed by receiving the thermal stress. As a result, the mechanical reliability is increased.

In other words, according to the image carrier unit of the present invention, there is such an effect that it is possible to obtain the stable/firm contact state with the abutting member such as the hardness roller, and also to make it simple and even when the temperatures are changed in the use environment and the transport environment, the image carrier unit is not destroyed.

According to the image carrier unit of the present invention, the image carrier is supported by the fixing member with keeping an interval smaller than an allowable deformation amount of the image carrier. For example, even when an operator mistakenly depresses the center portion of the image carrier with this strong force while, for example, the operator replaces the image carrier unit, the image carrier may be supported by the cylindrical member before being damaged. Accordingly, there is no risk that the image carrier is not destroyed. As a consequence, this image carrier unit can own the superior operability rather than the drum-shaped image carrier member disclosed in the above-explained Japanese Laid-open Patent Application No. 58-86550.

Further, even when the image carrier is strongly depressed, since this image carrier is not destroyed, the abutting member can abut against the image carrier.

In other words, according to the image carrier unit of the present invention, it is possible to achieve the stable/firm contact condition with respect to the abutting member such as the hardness roller, and also there are such effects that the manufacture of the image carrier unit can be done simply, and the superior operability can be realized, and further even when the temperatures are changed in the use environment and the transport environment, the image carrier unit is not destroyed.

According to the image carrier unit of the present invention, both the cylindrical member and the fixing member own electroconductivity. As a consequence, the electroconductivity required to form the image with respect to the image carrier can be obtained via these cylindrical member and the fixing member. As a consequence, there is no need to separately provide another conducting means.

BRIEF DESCRIPTION OF THE DRAWINGS

FIG. 8 (*b*) and (*c*) are explanatory diagrams for explaining a method for cutting the image carrier; FIG. 8 (*a*) is a front view; and FIG. 8(*b*) is a side view;

FIG. 14 (*a*) is a side view of an upper half portion for indicating a cylindrical member and a spacer; and FIG. 14 (*b*) is a partial perspective view;

FIG. 15 (*a*) is a side view of an upper half portion for indicating a cylindrical member and a spacer; FIG. 15 (*b*) is a partial perspective view; FIG. 15 (*c*) is a partially enlarged view of FIG. 15 (*a*); and FIG. 15 (*d*) is an operation explanatory diagram;

FIG. 16 (*a*) is a side view of an upper half portion for indicating a cylindrical member and a spacer; and FIG. 16(*b*) is a sectional view; and FIG. 16 (*c*) is an operation explanatory diagram;

FIG. 17 (*a*) is a partial sectional view; and FIG. 17 (*b*) is a sectional view, taken along a line III—III of FIG. 17 (*a*);

FIG. 18 (*a*) is a partial sectional view; and FIG. 18 (*b*) is a sectional view, taken along a line IV—IV of FIG. 18 (*a*);

FIG. 19 (*a*) is a partial sectional view; and FIG. 19 (*b*) is a sectional view, taken along a line V—V of FIG. 19 (*a*);

FIG. 20 (*a*) is a partial sectional view; and FIG. 20 (*b*) is a sectional view, taken along a line VI—VI of FIG. 20 (*a*);

FIG. 21 (*a*) is a partial sectional view; and FIG. 21 (*b*) is a sectional view, taken along a ling VII—VII of FIG. 21 (*a*);

FIG. 22 (*a*) is a partial sectional view; and FIG. 22 (*b*) is a sectional view, taken along a line VIII—VIII of FIG. 22 (*a*);

FIG. 23 (*a*) is a partially omitted explanatory diagram; FIG. 23 (*b*) is a sectional view, taken along a line IX—IX of FIG. 23 (*a*); and FIG. 23 (*c*) is a sectional view, taken along a line X—X of FIG. 23 (*a*);

FIG. 24(*b*) is a left side view of FIG. 23(*a*);

DETAILED DESCRIPTION OF THE PREFERRED EMBODIMENTS

Hereinafter, a description will be given of embodiments of the present invention with reference to the drawings.

First Embodiment

Figure 5:
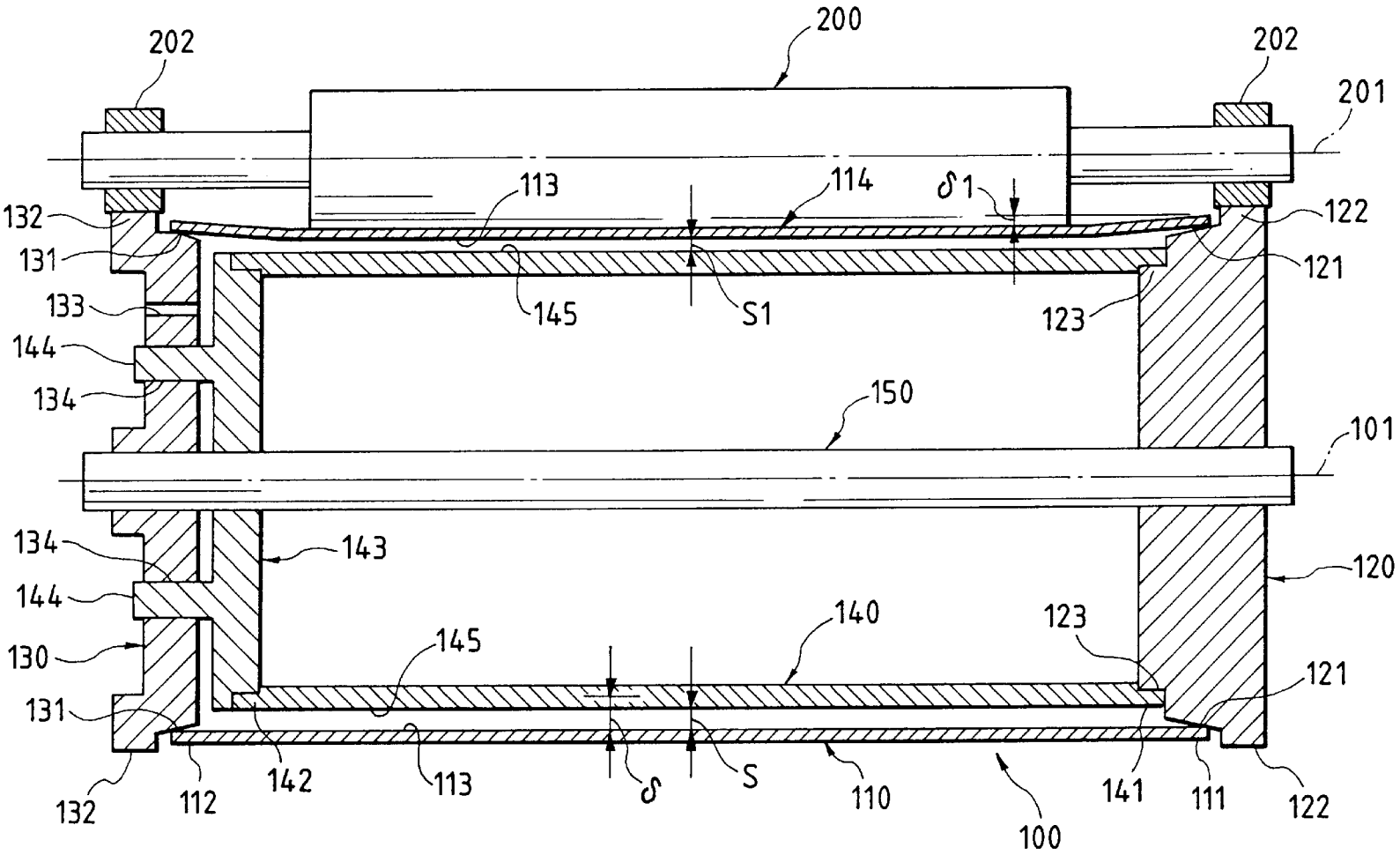
FIG. 5 is a cross-sectional view showing an image carrier unit in accordance with a first embodiment of the present invention, in which a roller as an abutment member is also drawn.

FIG. 5 is a cross-sectional view showing an image carrier unit in accordance with a first embodiment of the present invention, in which a roller is also drawn as an abutment member.

In FIG. 5, reference numeral 100 denotes an image carrier unit which is structured as a photoreceptor unit for use in an electrophotographic image forming apparatus in this embodiment.

The photoreceptor unit 100 includes an image carrier 110, a pair of support members 120 and 130 which support both ends 111 and 112 of the image carrier 110, and a cylindrical member 140 disposed inside of the image carrier 110. The image carrier includes an inner peripheral surface 113 and an outer peripheral surface 114.

The image carrier 110 is disposed in the form of a flexible thin cylinder and structured by forming a photosensitive layer on a surface of a flexible base substance. For example, the base substance may be formed of a nickel seamless tube. The photosensitive layer can be formed by a so-called OPC (organic photoreceptor) through the dipping method. Since the flexibility, that is, the softness of the image carrier 110 thus structured can be determined by the adjustment of the thickness and the diameter of the base substance, it can be appropriately set according to an image forming apparatus in use. For example, the flexibility of the image carrier 110 is appropriately set so that the quantity 81 of deformation which will be described later becomes about 20 to 500 $\mu$m within the limits that the thickness of the base substance is 20 to 200μm, and the diameter of the base substance is 100 to 300 mm. It should be noted that since OPC is mainly composed of resin, it is excellent in flexibility, however it is desirable that an under layer is formed between the base substance and the OPC in order to ensure the adhesion of the base substance to the OPC to take a countermeasure against an interference of a laser beam. The under layer is suitably formed of a layer in which grains that can absorb a laser beam such as zinc oxide grains or titanium oxide grains are dispersed in a resin such as a nylon resin.

The respective support members 120 and 130 are structured such that their overall shape are cylindrical, and include tapered surfaces 121 and 131 that support the end portions 111 and 112 of the image carrier 110, and flanges 122 and 132 larger in outer diameter than the image carrier 110. Those support members 120 and 130 are made of a high-rigid material such as a metal or a synthetic resin which is remarkably difficult to deform.

One support member 120 is fixed to a shaft 150 whereas the other support member 130 is slidably fitted to the shaft 150. Shaft 150 includes a longitudinal axis 101. An air vent 133 is defined in the other support member 130.

The cylindrical member 140 has an outer diameter smaller than an inner diameter of the image carrier 110 and is disposed inside of the image carrier 110. One end 141 of the cylindrical member 140 is fixed to a ring-shaped step 123 which is formed on one support member 120, and the other end 142 thereof is fixed to a disc-shaped side plate 143. The side plate 143 is fixed to the shaft 150. An outer side surface of the side plate 143 is provided with a plurality of pins 144 that penetrate corresponding holes 134 defined in the other support member 130. The pins 144 and the holes 134, that is, the support member 130 are relatively slidable in their axial direction (the right and left direction in FIG. 5). With this structure, one support member 120 integrally supports one end 111 of the image carrier 110 and one end 141 of the cylindrical member 140, whereas the other support member 130 is movable axially with respect to the other end 142 of the cylindrical member 140. It should be noted that the cylindrical member 140 and the side plate 143 are made of a high-rigid material such as a metal or a synthetic resin which is remarkably difficult to deform.

An interval S is defined between an outer peripheral surface 145 of the cylindrical member 140 and an inner peripheral surface 113 of the image carrier 110. The interval S is set to be smaller than an allowable deformation of the image carrier 110, that is, the quantity 6 of deformation with which the image carrier 110 is destroyed when the image carrier 110 is deformed inwardly.

The image carrier unit 100 thus structured can be assembled, for example, in the following manner.

That is, first, one support member 120 is fixed to the shaft 150, and one end 141 of the cylindrical member 140 is fixed to the support member 120. Also, the side plate 143 is fixed to the other end 142 of the cylindrical member 140, and the side plate 143 is fixed to the shaft 150. Subsequently, one end 111 of the image carrier 110 is fitted onto the tapered surface 121 of the support member 120, and the pins 144 of the side plate 143 are inserted into the holes 134 of the other support member 130 so that the tapered surface 131 of the other support member 130 is fitted onto the other end 112 of the image carrier 110. In this situation, even though a manufacturing error exists in dimensions between the inner diameter of the image carrier 110 and the tapered surfaces 121, 131 of the support members 120, 130, the error is absorbed with the tapered surfaces 121 and 131. As a result, both the ends 111 and 112 of the image carrier 110 are surely in close contact with the tapered surfaces 121 and 131, respectively. Thereafter, both the ends 111 and 112 of the image carrier 110 are fixed to the tapered surfaces 121 and 131, to thereby complete the final image carrier unit 100. It should be noted that the fixing of the above respective members can be conducted by appropriate means, for example, by adhesive or shrinkage fitting, or the like, and the fixing of the image carrier 110 to the support members 120 and 130 can be also conducted by taping.

Figure 6:
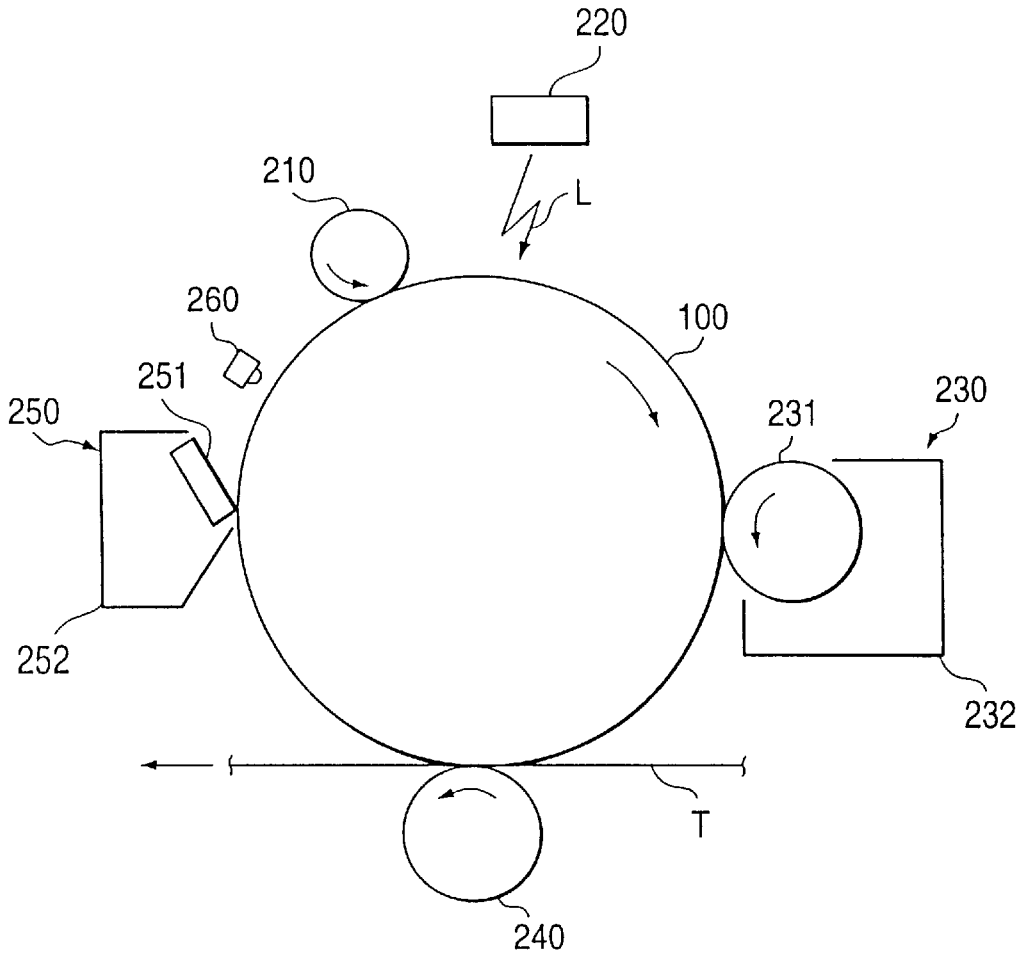
FIG. 6 is a schematic diagram showing a main portion of an image forming apparatus including the image carrier unit as shown in FIG. 5.

FIG. 6 is a schematic diagram showing a main portion of an image forming apparatus in accordance with another embodiment of the present invention.

In FIG. 6, reference numeral 100 denotes a photoreceptor unit as described above, which is so designed as to be rotationally driven by appropriate drive means not shown in a direction indicated by an arrow (clockwise).

Around the photoreceptor unit 100 are disposed charging means 210, exposing means 220, developing means 230, transfer means 240, cleaning means 250 and electrically neutralizing means 260 along its rotating direction.

The charging means 210 is made up of a high-resistant hard resin roller which rotates while it is abutted against the outer peripheral surface of the image carrier 110, or a metal roller having a high-resistant layer on a surface thereof. The charging means 210 is so designed as to uniformly charge the outer peripheral surface of the image carrier 110 in the photoreceptor unit 100.

The exposing means 220 is so designed as to scan the outer peripheral surface of the image carrier 110 by a laser beam L, to thereby form an electrostatic latent image on the image carrier 110.

The developing means 230 includes a hard developing roller which rotates while it is abutted against the outer peripheral surface of the image carrier 110, and sticks toners onto the outer peripheral surface of the image carrier 110 to form a toner image, and a toner storage chamber 232 that accommodates the toners which are supplied to the developing roller 231. The developing roller 231 is made up of a metal roller having a surface roughened, or a hard resin roller.

The transfer means 240 is made up of a high-resistant hard resin roller, or a metal roller having a high-resistant layer on a surface thereof. The transfer means 240 is so designed as to transfer the toner image formed on the image carrier 110 onto a transfer medium (a recording medium such as a sheet or an intermediate transfer belt) T.

The cleaning means 250 includes a cleaning blade 251 that functions as a cleaning member which is abutted against the outer peripheral surface of the image carrier 110, and scraps off and removes residual toners that remain on the outer peripheral surface of the image carrier 110 after the toner image has been transferred by the transfer means 240, and a toner collection chamber 252 that collects the toners which have been scrapped off by the blade 251.

The electrically neutralizing means 260 is made up of an electrically neutralizing lamp, and is so designed as to uniformly irradiate a light onto the surface of the image carrier 110 to electrically neutralize the surface of the image carrier 110.

Of the above-mentioned respective means, all of the charging roller 210, the developing roller 231 and the transfer roller 240 which are made up of a hard roller in contact with the image carrier 110 are in contact with the image carrier 110 while the image carrier 110 is bent inwardly in such a manner that the inner peripheral surface 113 of the image carrier 110 is not abutted against the outer peripheral surface 145 of the cylindrical member 140, as indicated by the roller 200 shown in FIG. 5. Roller 200 is mounted on a shaft which has longitudinal axis 201. Also, each of those rollers includes a bearing member as in the bearing member 202 of the roller 200 shown in FIG. 5, and the bearing member is abutted against the flanges 122 and 132 of the photosensitive unit 100, to thereby regulate an interval to the image carrier 110. In FIG. 5, symbol S denotesan interval between the inner peripheral surface 113 of the image carrier 110 which is bent inwardly at a portion abutted against the roller and the outer peripheral surface 145 of the cylindrical member 140.

The cleaning blade 251 of the cleaning means 250 presses the image carrier 110 until the inner peripheral surface 113 of the image carrier 110 is abutted against the outer peripheral surface 145 of the cylindrical member 140 so that it removes the toners on the outer peripheral surface of the image carrier 110. Since the inner peripheral surface 113 of the image carrier 110 and the outer peripheral surface 145 of the cylindrical member 140 are in contact with each other at the cleaning position, the coefficient of friction between both the members is desirably set as small as possible.

The image forming operation of the image forming apparatus thus structured is stated below.

The photoreceptor unit 100 is rotationally driven by drive means not shown, which also permits the image carrier 110 to be rotationally driven.

During the above process, the image carrier 110 is uniformly charged by the charging means 210 after it has been first electrically neutralized by the electrically neutralizing means 260.

Subsequently, a laser beam L is irradiated onto the image carrier 110 by the exposing means to form an electrostatic latent image on the image carrier 110, and the electrostatic latent image is developed by the developing means 230 into a toner image.

The toner image is transferred onto a transfer medium T which is supplied between the transfer roller 240 and the image carrier 110 by the transfer roller 240.

In this situation, the toners that remain on the surface of the image carrier 110 without being perfectly transferred is scrapped off by the cleaning blade 251 of the cleaning means 250.

Thereafter, the image carrier 110 is again electrically neutralized by the electrically neutralizing means 260 so that a next image is formed on the image carrier 110.

Second Embodiment

Figure 7:
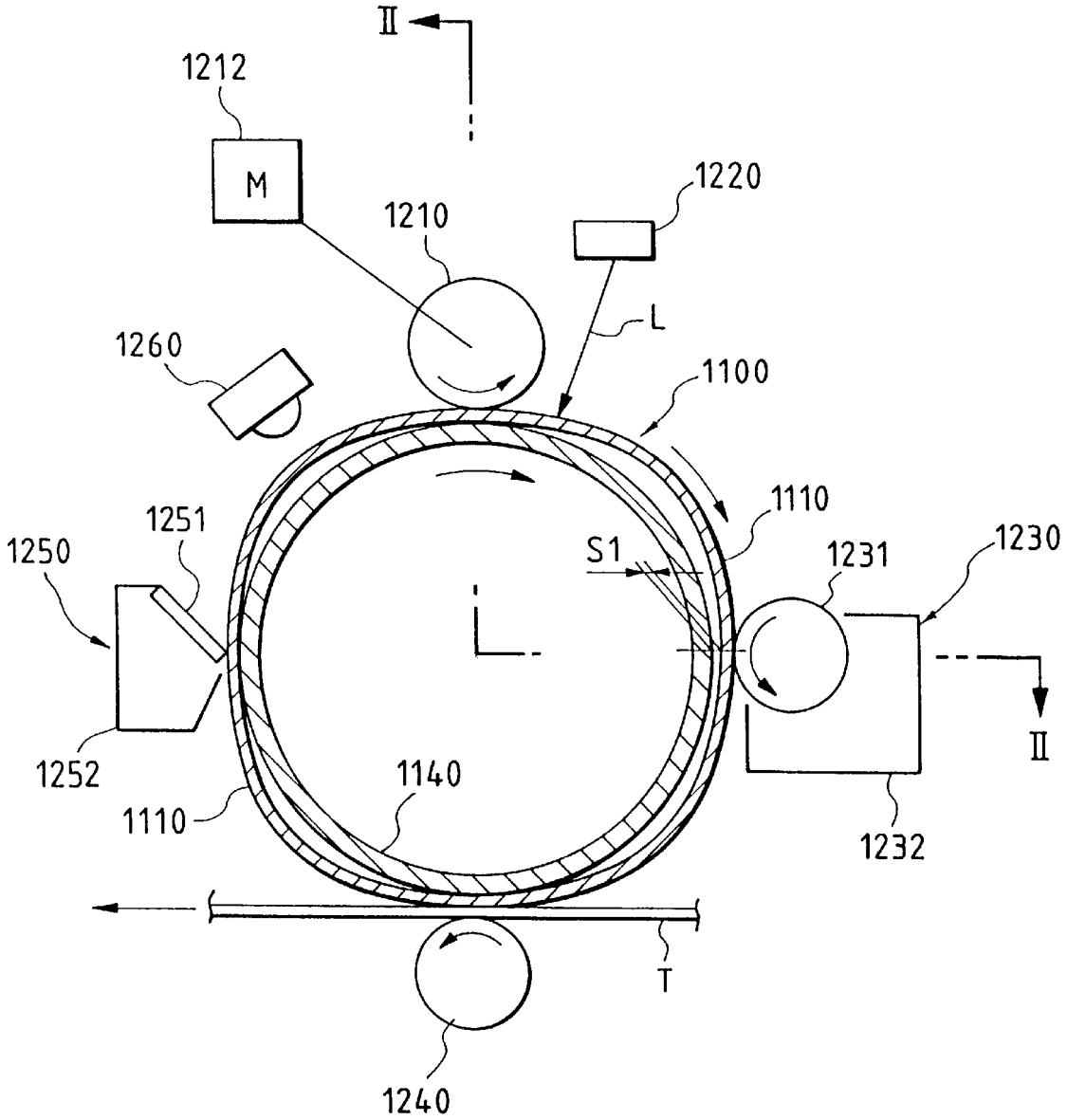
FIG. 7 is a schematic diagram showing a main portion of an image forming apparatus in accordance with a second embodiment of the present invention.
Figure 8A:
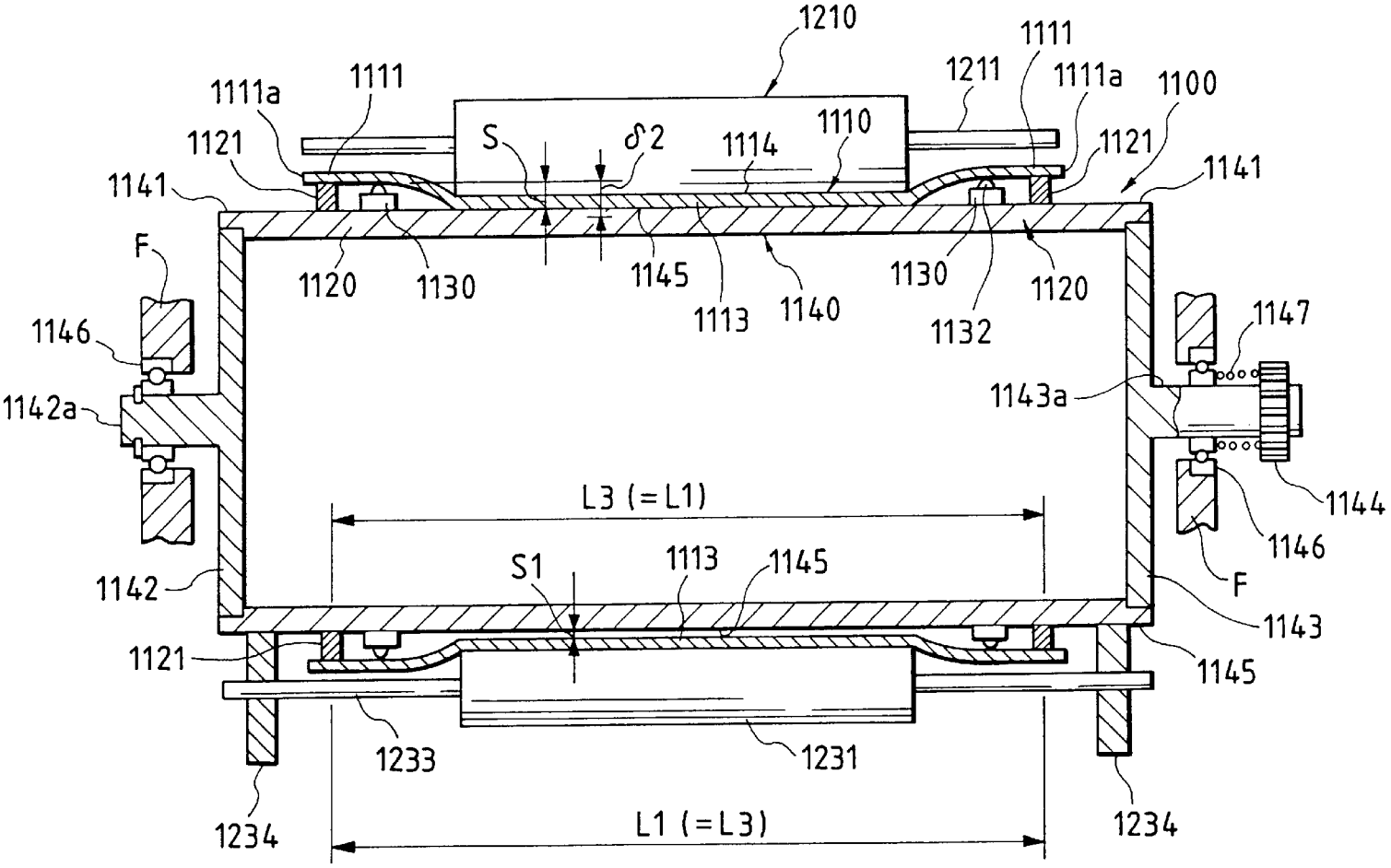
FIG. 8 (*a*) is a cross-sectional view taken along a line II—II in FIG. 7.

FIG. 7 is a perspective view showing a main portion of an image forming apparatus in accordance with a second embodiment of the present invention, and FIG. 8*a* is a cross-sectional view taken along a line II—II in FIG. 7.

In those figures, reference numeral 1100 denotes a photoreceptor unit which is designed such that it is rotationally driven by an appropriate drive means not shown in a direction (clockwise) indicated by an arrow in FIG. 7.

A photosensitive unit 1100 is equipped with a thinner cylindrical image carrier 1110 having a flexibility characteristic, in which a burr 1111*b* is formed on an outer circumferential surface at both edges thereof; a supporting member 1120 having an outer diameter of this image carrier 1110 and arranged inside the image carrier 1110, for supporting both end portions 1111 of the image carrier 1110 inwardly; and a fixing means for fixing both end portions 1111 of the image carrier on this supporting member 1120. The fixing means of this embodiment is equipped with a spacer 1130 interposed between the image carrier 1110 and the supporting member 1120 and having an elastic portion for elastically and uniformly supporting said image carrier 1110 inwardly; and an adhesive agent 1121 for adhering the image carrier 1110 supported by this spacer 1130 to the supporting member 1120.

The image carrier 1110 is constructed by forming a photosensitive layer on a surface (outer circumferential surface) of a thinner cylindrical-shaped base member having flexibility.

Figure 8:
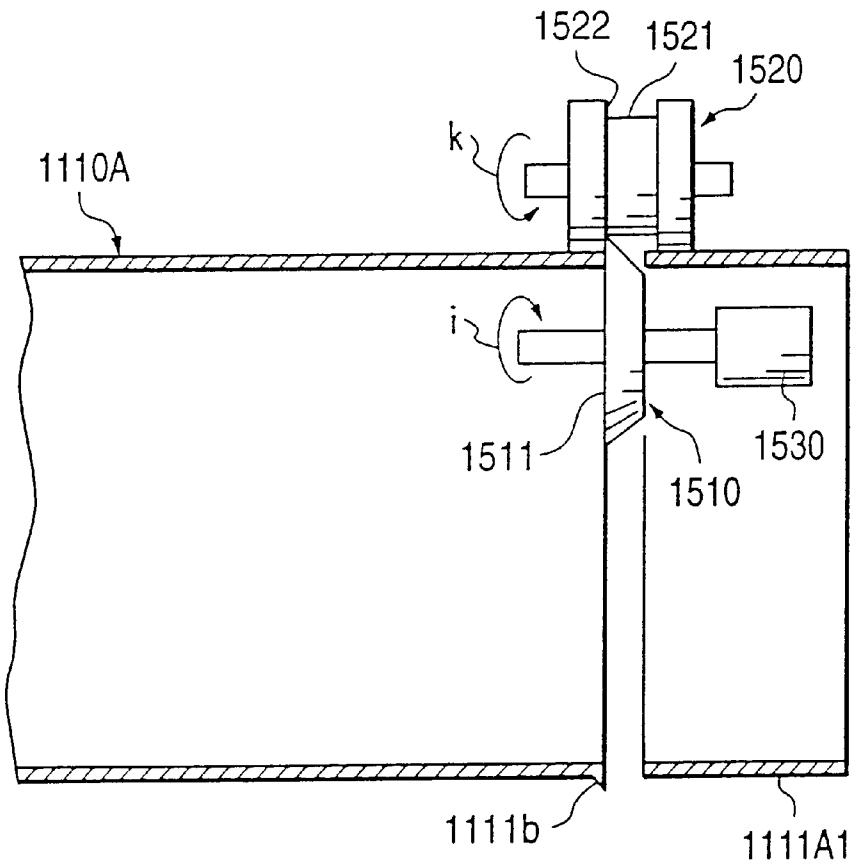
Figure 8:
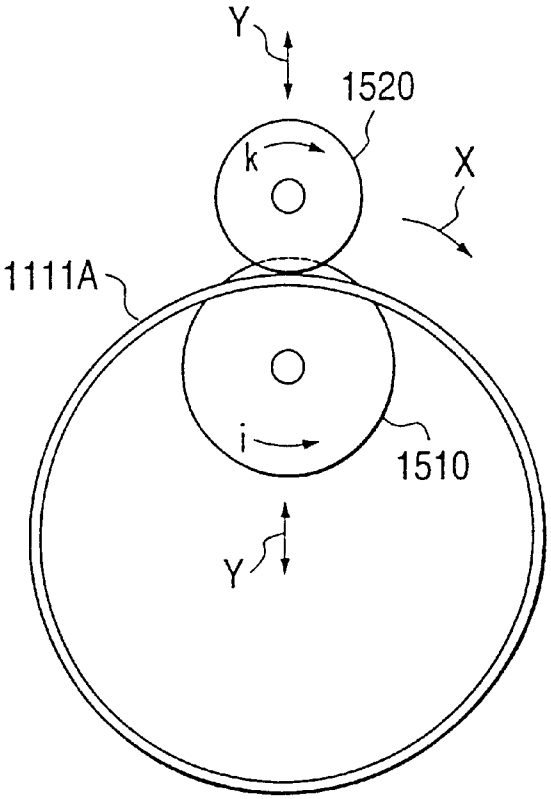
Figure 9A:
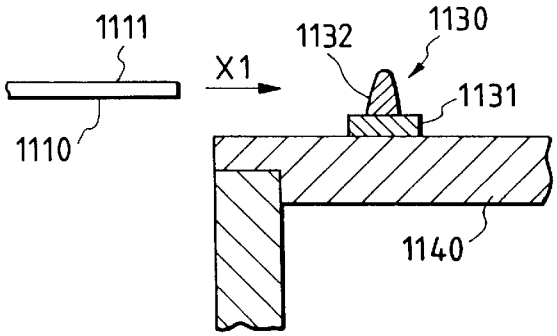
FIGS. 9(*a*) to 9(*f*) are schematic diagrams mainly showing an example of the spacer, in which FIG. 9 (*a*) is a front partial cross-sectional view showing a state of the spacer before the image carrier a 1110 is installed, FIG. 9 (*b*) is a partial left side view of FIG. 9 (*a*), FIG. 9 (*c*) is a partial cross-sectional diagram for explaining its operation, FIG. 9 (*d*) is a front cross-sectional view showing a state of the spacer after the image carrier 1110 has been installed, FIG. 9 (*e*) is a partial left side view of FIG. 9 (*d*), and FIG. 9 (*f*) is a left side view showing a state of the spacer after the image carrier 1110 has been installed.
Figure 9D:
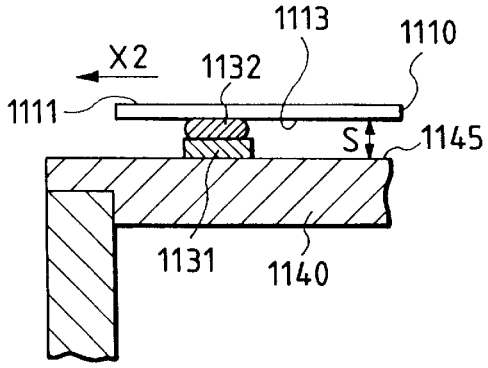
Figure 9B:
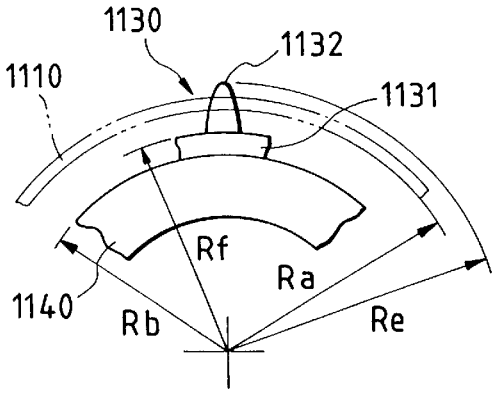
Figure 9E:
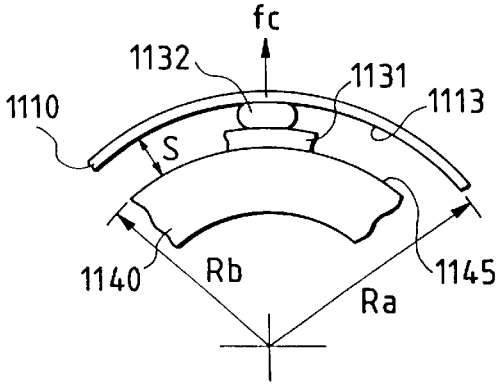
Figure 9C:
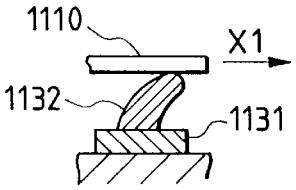
Figure 9F:
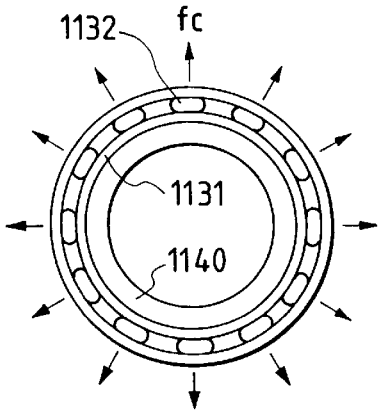

The base member is formed in such a manner that, as shown in FIGS. 8 (*b*) and (*c*), both end portions 1111A (only one end portion is shown in FIG. 8 (*b*) and (*c*) of a seamless tube (for example, nickel seamless tube manufactured by electroforming method) 1110A whose length is longer than that of the base member for constituting the image carrier is cut out by employing a slitter (or rolling cutter) 1510 and a back-up roller 1520, and the burr 1111*b* is formed on an out side thereof.

The slitter 1510 has a blade plane 1511, and is rotary-driven by a drive means 1530 such as a motor along an arrow "i" direction.

The back-up roller 1520 has a groove portion 1521 for accepting the slitter 1510 and a blade plane 1522, and is rotated along an arrow "k" direction in following to the slitter 1510.

These slitter 1510 and the back-up roller 1520 can be slit along an arrow "Y" direction shown in FIG. 8 (*b*), respectively, (note that only one of them may be relatively slit with respect to seamless tube 1110A).

As a consequence, the seamless tube 1110 is rotated by sandwiching this seamless tube 1110 by the slitter 1510 and the back-up roller 1520, and also these slitter 1510 and back-up roller 1520 are relatively moved along an arrow "X" direction with respect to the seamless tube 110A, so that the seamless tube 1111A can be cut out. In this case,the burr 1111*b* is formed on the out side of the tube.

The photosensitive layer may be formed by a so-called "OPC (organic photosensitive material)" by way of the dipping method.

Since the above-explained flexibility of the image carrier 1110 may be determined by controlling the thickness and diameter of the base material, this flexibility may be properly set in accordance with the image forming apparatus under use. For instance, the flexibility may be properly set within a range that the thickness of the base member is 20 to 200 $\mu$m, and the diameter of the base member is 10 to 300 $\mu$m, and then an allowable deformation amount 82 become 20 to 500 $\mu$m (will be explained later). It should be noted that since OPC is mainly made of resin, it contains the supreme flexibility. However, in order that the fitting characteristic with respect to the base member is maintained and the interference caused by the laser light is avoided, it is preferable to use such a layer into which grains such as titanium oxide and zinc oxide capable of absorbing the laser light are dispersed into resin such as nylon resin.

As shown in FIG. 8 (*a*), the supporting member 1120 is equipped with a cylindrical member 1140, and disk-shaped side plates 1142, 1143 fixed on both end portions 1141, 1141 of this cylindrical member 1140. The cylindrical member 1140 and the side plates 1142, 1143 are made of either a very difficult deformable metal or a high rigid material such as synthetic resin. When these members are made of synthetic resin, a metal such as aluminum, nickel, copper is vapor-deposited thereon, otherwise an electric conductive layer is formed by way of plating. Or, an electric conductive material such as carbon is contained in the resin to obtain the electroconductivity.

The cylindrical member 1140 is fixed on the side plates 1142 and 1143 by employing such proper means as adhering, pressure insertion, and pressure adhesion. Shafts 1142*a* and 1143*a* are formed on the side plates 1142, 1143 in an integral form. A gear 1144 is fixed on one shaft 1143*a*.

The spacer 1130 is located near a center side, rather than the edge portion 1111*a* of the image carrier 1110. The spacer 1130 is arranged in a toroidal-shape on the outer circumferential surface of the cylindrical member 1140, and is interposed between the cylindrical member 1140 and the image carrier 1110.

In this embodiment, the fixing member 1121 is made of an electrically conductive adhesive, for example, an electrically conductive adhesive obtained by diffusing electrically conductive particles in an epoxy, cyano or acrylic resin adhesive. The electrically conductive particles may be made of metal (silver, aluminum, etc.), carbon or the like.

The fixing member 1121 has a short length capable of being unaffected by the thermal expansion itself, and supports the image carrier 1110 and the cylindrical member 1140 near both end portions thereof and couples them. Now, as shown in FIG. 8 (*a*), assuming that a length between coupling portions with the fixing member 1121 in the image carrier 1110 along an axial line direction is "L1", and another length between coupling portions with the fixing member 1121 in the cylindrical member 1140 is "L3", it becomes L1=L3.

As a consequence, even when the temperature surrounding the photosensitive unit 1100 is changed and thus the temperature difference is produced, as will be explained later, the linear expansion coefficient of the image carrier 1110 is made substantially equal to that of the cylindrical member 1140. Otherwise, these members are constituted by the same sort of materials, so that the change in the length L1 is made substantially equal to the change in the length L3. Then, the distortion and the deformation occurred in the image carrier 1110 are reduced, and the mechanical precision can be maintained under better conditions.

FIGS. 9 (*a*) to (*f*) are schematic diagrams mainly showing an example of the spacer, in which FIG. 9 (*a*) is a front cross-sectional view showing a state of the spacer before the image carrier 1110 is installed, FIG. 9 (*b*) is a partial left side view of FIG. 9 (*a*), FIG. 9 (*c*) is a diagram for explaining its operation, FIG. 9 (*d*) is a front cross-sectional view showing a state of the spacer after the image carrier 1110 has been installed, FIG. 9 (*e*) is a partial left side view of FIG. 9 (*d*), and FIG. 9 (*f*) is a left side view showing a state of the spacer after the image carrier 1110 has been installed.

As shown in those figures, the spacer 1130 in this embodiment includes a thin ring-shaped base portion 1131 fixed to the outer peripheral surface 1145 of the cylindrical member 1140, and elastic protrusions 1132 protruding from the outer peripheral surface of the base portion 1131. The base substance 1131 is made of, for example, metal or synthetic resin, and the elastic protrusions 1132 are made of, for example, silicon rubber. As shown in FIG. 9 (*f*), multiple elastic protrusions 1132 (12 in the figure) are disposed at regular intervals circumferentially of the base portion 1131. As shown in FIG. 9 (*b*), an outer diameter Rf of the base portion 1131 is set to be smaller than an inner diameter Ra of the image carrier 1110, and a radius Re of a circle linking the tips of the elastic protrusions 1132 before the image carrier 1110 is installed (a distance from the center of the image carrier 1110 to the tips of the elastic protrusions 1132 is set to be larger than the inner diameter Ra of the image carrier. Also shown is outer diameter Rb of the cylindrical member 1140. It should be noted that the thickness of the base portion 1131 is about 100 $\mu$m and similarly the height of the elastic protrusion 1132 is about 100 $\mu$m in a state where the image carrier 1110 is installed as shown in FIGS. 9 (*d*) and 9 (*e*). The elastic protrusion 1132 can be formed by, for example, printing a silicon rubber paint on the surface of the base portion 1131.

The image carrier 1110 is fixed onto the cylindrical member 1140 by injecting an adhesive fixing member 1121 between its both ends 1111 and the outer peripheral surface of the cylindrical member 1140 after the cylindrical member 1140 has been covered with the image carrier 1110 (after the cylindrical member 1140 has been inserted into the image carrier 1110).

In this situation, the spacer 1130 acts as follows:

At a stage where the image carrier 1110 is covered on the cylindrical member 1140as indicated by an arrow Xl in FIG. 9 (*a*) (namely, cylindrical member 1110 is inserted into image carrier 1140), a tip portion of the spacer 1130 is made in contact with the inner surface of the image carrier 1110 to be depressed along an arrow X1 direction. Then, as indicated in FIG. 9(*c*), this tip portion is temporarily deformed along the arrow X1 direction. It should be noted that when the cylindrical member 1140is inserted into the image carrier 1110,since the burr 1111*b* is present outwardly, this burr never disturbs the insertion of the cylindrical member 1140.

Thereafter, when the cylindrical member 1140 is perfectly inserted into the image carrier 1110, and an external force that is exerted in the direction indicated by the arrow X1 disappears, the spacer 1130 comes to a state in which it is crushed as shown in the figure while it slightly pushes back the image carrier 1110 by its elastic force (restoring force) in a direction indicated by an arrow X2 as shown in FIG. 9 (*d*). Thus, the spacer 1130 supports the image carrier 1110 from the inside by its elasticity.

In this example, since the multiple elastic protrusions 1132 are, as shown in FIG. 9 (*f*), disposed at regular intervals circumferentially of the base portion 1131, the elastic force (restoring force) "fc" of the elastic protrusions 1132 are substantially uniformly exerted on the image carrier 1110, with the result that as shown in FIG. 9 (*e*), the image carrier 1110 is installed on the cylindrical member 1140 in a state where an interval S between the image carrier 1110 and the cylindrical member 1140 is made substantially uniform (that is, substantially cylindrical state). In such a state, the adhesive fixing member 1121 (refer to FIG. 8) is injected between both ends 1111 of the image carrier 1110 and the outer peripheral surface of the cylindrical member 1140 so that the image carrier 1110 is fixed onto the cylindrical member 1140. At that time, a burr 1111*b* of the image carrier 1110 serves as an adhesive width.

The interval S between the outer peripheral surface 1145 of the cylindrical member 1140 and the inner peripheral surface 1113 of the image carrier 1110 is set to be smaller than the allowable deformation, that is, the qunatity $\delta 2$ of deformation (refer to FIG. 8*a*) with which the image carrier 1110 is destroyed when it is deformed inwardly.

As shown in FIG. 8 (*a*), the cylindrical member 1140 has both ends 1141 thereof fixed to disc-shaped side plates 1142 and 1143, respectively. The cylindrical member 1140 and the side plates 1142, 1143 are made of a high rigid material such as metal or synthetic resin that is difficult to deform. In the case where they are made of synthetic resin, metal such as aluminum, nickel or copper is deposited on the synthetic resin, an electrically conductive layer is formed thereon by plating or the like, or an electrically conductive material such as carbon is mixed into the synthetic resin to provide the electrical conductivity.

As indicated in FIG. 8 (*a*), both end portions 1141 of the cylindrical member 1140 are fixed on the disk-shaped side plates 1142, 1143 respectively. There cylindrical member 1140 and the side plates 1142, 1143 are made of either a very difficult deformable metal or a high rigid material such as synthetic resin. When these members are made of synthetic resin, a metal such as aluminum, nickel, copper is vapor-deposited thereon, otherwise an electric conductive layer is formed by way of plating. Or, an electric conductive material such as carbon is contained in the resin to obtain the electroconductivity.

The cylindrical member 1140 is fixed on the side plates 1142 and 1143 by employing such proper means as adhering, pressure insertion, and pressure adhesion. Shafts 1142*a* and 1143*a* are formed on the side plates 1142, 1143 in an integral form. A gear 1144 is fixed on one shaft 1143*a*.

The above-described photoreceptor unit 1100 is constituted by employing any one of the following items (A) and (B).

(A) It is so arranged that the linear expansion coefficient of the image carrier 1110 is made substantially equal to the linear expansion coefficient of the cylindrical member 1140.

For example, in the case that the base material of the image carrier 1110 is a nickel seamless tube (linear expansion coefficient is from $12.8\times10^{-6}/°$ C. to $13.4\times10^{-6}/°$ C.), the cylindrical member 1140 is constituted by PET (polethyleneterephthalate) containing an inorganic material (mineral) such as a fiber or mica. When the glass containing rate is selected to be 55% (weight ratio), the linear expansion coefficient may be selected to be from $11.0\times10^{-6}/°$ C. to $14.0\times10^{-6}/°$ C.

(B) Both the image carrier 1110 and the cylindrical member 1140 are made of the same sort of materials.

For instance, in the case that the base member of the image carrier 1110 is made of a nickel seamless tube, the cylindrical member 1140 is constituted by either nickel or stainless steel.

Next, a description will now be made of one example of the image forming apparatus. As indicated in FIG. 8 (*a*), for instance, in the above-described photoreceptor unit 1100, the shafts 1142*a* and 1143*a* are rotatably supported on the frame of the apparatus. Reference numerals 1146 are bearings. A compression spring 1147 is provided between the gear 1144 and the bearing 1146 so as to prevent play.

As described above, the photoreceptor unit 1100 is rotatably supported on the frame "F", and is rotary-driven along an arrow direction (clockwise direction) of FIG. 7 by a proper drive means (not shown).

As indicated in FIG. 7, the charging means 1210, the exposing means 1220, the developing means 1230, the transferring means 1240, and the cleaning means 1250 are arranged around the photosensitive member unit 1100 along the rotation direction thereof.

The fixing of the cylindrical member 1140 onto the side plates 1142 and 1143 can be conducted by an appropriate means, for example, adhesive, press fitting, press contact, etc. The side plates 1142 and 1143 are integral with shafts 1142*a* and 1143*a*, and those shafts 1142*a* and 1143*a* are rotatably supported by a flame F of the apparatus. Reference numeral 1146 denotes a bearing. One shaft 1143*a* is fixed with a gear 1144, and a compression spring 1147 for preventing the rickets is disposed between the gear 1144 and the bearing 1146.

In the above manner, the photoreceptor unit 1100 is so designed as to be rotationally supported by the flame F and rotationally driven by an appropriate drive means not shown in a direction indicated by an arrow (clockwise) in FIG. 7.

As shown in FIG. 7, around the photoreceptor unit 1100 are disposed charging means 1210, exposing means 1220, developing means 1230, transfer means 1240, cleaning means 1250 and electrically neutralizing means 1260 along its rotating direction.

The charging means 1210 is made up of a high-resistant hard resin roller which rotates while it is abutted against the outer peripheral surface of the image carrier 1110, or a metal roller having a high-resistant layer on a surface thereof. The charging means 1210 is so designed as to uniformly charge the outer peripheral surface of the image carrier 1110 in the photoreceptor unit 1100.

The exposing means 1220 is so designed as to scan the outer peripheral surface of the image carrier 1110 by a laser beam L, to thereby form an electrostatic latent image on the image carrier 1110.

The developing means 1230 includes a hard developing roller which rotates while it is abutted against the outer peripheral surface of the image carrier 1110, and sticks toners onto the outer peripheral surface of the image carrier 1110 to form a toner image, and a toner storage chamber 1232 that accommodates the toners which are supplied to the developing roller 1231. The developing roller 1231 is made up of a metal roller having a surface roughened, or a hard resin roller.

The transfer means 1240 is made up of a high-resistant hard resin roller, or a metal roller having a high-resistant layer on a surface thereof. The transfer means 1240 is so designed as to transfer the toner image formed on the image carrier 1110 onto a transfer medium (a recording medium such as a sheet or an intermediate transfer belt) T.

The cleaning means 1250 includes a cleaning blade 1251 that functions as a cleaning member which is abutted against the outer peripheral surface of the image carrier 1110, and scraps off and removes residual toners that remain on the outer peripheral surface of the image carrier 1110 after the toner image has been transferred by the transfer means 1240, and a toner collection chamber 1252 that collects the toners which have been scrapped off by the blade 1251.

The electrically neutralizing means 1260 is made up of an electrically neutralizing lamp, and is so designed as to uniformly irradiate a light onto the surface of the image carrier 1110 to electrically neutralize the surface of the image carrier 1110.

Of the above-mentioned respective means, both of the charging roller 1210 and the transfer roller 1240 are in contact with the image carrier 1110 so that the image carrier 1110 is bent inwardly until the inner peripheral surface 1113 of the image carrier 1110 is abutted against the outer peripheral surface 1145 of the cylindrical member 1140, and they rotate at a peripheral velocity identical with a peripheral velocity of the image carrier 1110. Since the inner peripheral surface 1113 of the image carrier 1110 and the outer peripheral surface of the cylindrical member 1140 are thus in contact with each other at the charging position and the transfer position, the frictional coefficient between them is desirably reduced as much as possible. The charging roller

1210 is driven by a motor 1212 (directly or through a gear, etc.,) as shown in FIG. 7 so that it rotates at a peripheral velocity identical with a peripheral velocity of the image carrier 1110, and the transfer roller 1240 is in contact with the image carrier (contact through the transfer medium T in the case where the transfer medium T exists) so that the transfer roller 1240 is driven by the image carrier 1110 to rotate at a peripheral velocity identical with the peripheral velocity of the image carrier 1110. It should be noted that the charging roller 1210 is rotationally supported at its shaft 1211 by a pair of bearing members not shown, and is urged toward the cylindrical member 1140 by known urging means (for example, a spring) not shown. The same are also applicable to the support structure and the urging structure for the transfer roller 1240.

The developing roller 1231 is in contact with the image carrier 1110 while the image carrier 1110 is bent inwardly in such a manner that the inner peripheral surface 1113 of the image carrier 1110 is not abutted against the outer peripheral surface 1145 of the cylindrical member 1140. Reference symbol S1 denotes an interval between the inner peripheral surface 1113 of the image carrier 1110 which is bent inwardly at a portion abutted against the roller and the outer peripheral surface 1145 of the cylindrical member 1140. The shaft 1233 of the developing roller 1231 is rotationally supported by a pair of bearing members 1234, and the bearing member 1234 is rotationally abutted against the outer peripheral surface 1145 of the cylindrical member 1140 on both sides of the image carrier 1110, whereby an interval between the developing roller 1231 and the cylindrical member 1140 is regulated. It should be noted that the shaft 1233 of the developing roller 1231 is urged toward the cylindrical member 1140 by an urging means not shown. Also, the developing roller 1231 is driven by a drive means not shown so as to be rotationally driven. The rotational velocity of the developing roller 1231 may be set such as its peripheral velocity is made identical with or different from (usually increased velocity) the peripheral velocity of the image carrier 1110.

The cleaning blade 1251 of the cleaning means 1250 presses the image carrier 1110 until the inner peripheral surface 1113 of the image carrier 1110 is abutted against the outer peripheral surface 1145 of the cylindrical member 1140 so that it removes the toners on the outer peripheral surface of the image carrier 1110. Since the inner peripheral surface 1113 of the image carrier 1110 and the outer peripheral surface 1145 of the cylindrical member 1140 are in contact with each other at the cleaning position, the coefficient of friction between both the members is desirably set as small as possible.

The image forming operation of the image forming device thus structured will be described below.

The photoreceptor unit 1100 is rotationally driven by drive means not shown, which also permits the image carrier 1110 to be rotationally driven.

During the above process, the image carrier 1110 is uniformly charged by the charging means 1210 after it has been first electrically neutralized by the electrically neutralizing means 1260.

Subsequently, a laser beam L is irradiated onto the image carrier 1110 by the exposing means to form an electrostatic latent image on the image carrier 1110, and the electrostatic latent image is developed by the developing means 1230 into a toner image.

The toner image is transferred onto a transfer medium T which is supplied between the transfer roller 1240 and the image carrier 1110 by the transfer roller 1240.

In this situation, the toners that remain on the surface of the image carrier 1110 without being perfectly transferred is scrapped off by the cleaning blade 1251 of the cleaning means 1250.

Thereafter, the image carrier 1110 is again electrically neutralized by the electrically neutralizing means 1260 so that a next image is formed on the image carrier 1110.

Third Embodiment

Figure 14A:
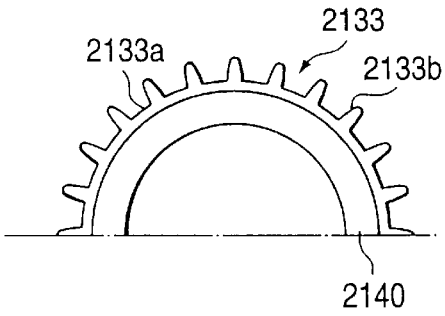
FIGS. 14(*a*) and 14(*b*) are schematic diagrams for showing a major portion of an image carrier unit according to a third embodiment of the present invention.
Figure 14B:
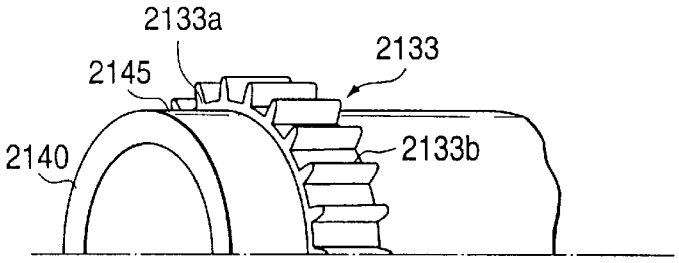
Figure 15A:
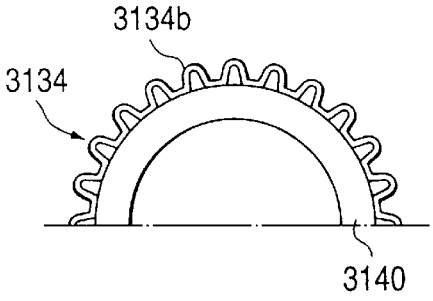
FIGS. 15(*a*)–15(*d*) are schematic diagrams for showing a major portion of an image carrier unit according to a fourth embodiment of the present invention.
Figure 15B:
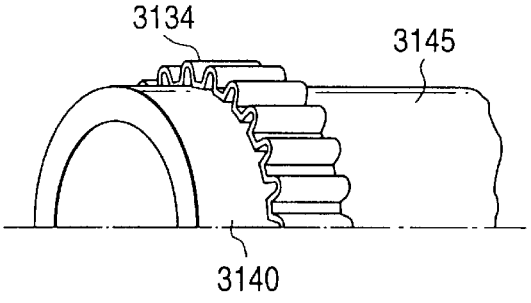
Figure 15C:
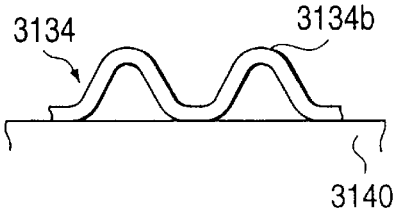
Figure 15D:
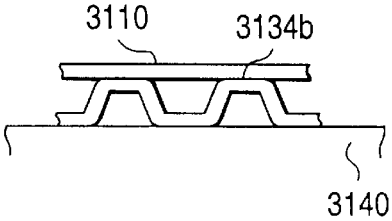

FIG. 14 is a schematic diagram for representing a major portion of an image carrier unit according to a third embodiment of the present invention. FIG. 14 (*a*) is a side view of an upper half portion for showing a cylindrical member and a spacer, and FIG. 14 (*b*) is a perspective view for partially showing these members.

This third embodiment has a different point from the above-described second embodiment, namely a structure of a spacer, whereas other structures of the third embodiment are identical to those of the second embodiment.

A spacer 2133 in this second embodiment is equipped with a thin ring-shaped base portion 2133*a* fixed to an outer circumferential surface 2145 of a cylindrical member 2140, and an elastic ridge 2133*b* functioning as an elastic portion projected from an outer circumferential surface of this base portion 2133*a*. The elastic portion of the spacer 2133 employed in the above-described second embodiment is made of 12 pieces of so-called "point-shaped" ridges 2132, whereas the elastic portion employed in the third embodiment is made of 24 pieces of elastic ridges 2133*b* having constant lengths along the axial line direction.

When the elastic member is such a ridge 2133*b*, the image carrier 1110 can be more stably supported.

Also, since the quantity of these ridges is large, the recovery force of the elastic portion may be more uniformly applied to the image carrier 1110. As a result, the intervals "S" between the image carrier 1110 and the cylindrical member 1140 can be more uniformly made.

Fourth Embodiment

FIG. 15 is a schematic diagram for representing a major portion of an image carrier unit according to a third embodiment of the present invention. FIG. 15 (*a*) is a side view of an upper half portion for showing a cylindrical member and a spacer, and FIG. 15 (*b*) is a perspective view for partially showing these members. FIG. 15 (*c*) is a partially enlarged view of FIG. 15 (*a*). FIG. 15 (*d*) is an operation explanatory diagram.

This fourth embodiment has a different point from the above-described second embodiment, namely a structure of a spacer, whereas other structures of the fourth embodiment are identical to those of the second embodiment.

A spacer 3134 in this fourth embodiment is constituted as an elastic portion itself by performing the emboss work on a metal tape fixed on an outer circumferential surface 3145 of a cylindrical member 3140. It should be noted that a total number of elastic ridges 3134*b* formed by way of the emboss work is 24.

When, as shown in FIG. 15 (*d*), the image carrier 3110 is mounted, the elastic ridge 3134*b* is brought into a depressed state, and thus the image carrier 3110 is supported from the inside thereof by the own elasticity of such a spacer 3134.

Such a spacer 3134 may be simply formed by performing the emboss work on the metal tape.

Also, since the image carrier 3110 can be conducted with the cylindrical member 3140 by the spacer 3134, adhesive fixing member 1121 need not require the electroconductivity in this embodiment.

Fifth Embodiment

Figure 16A:
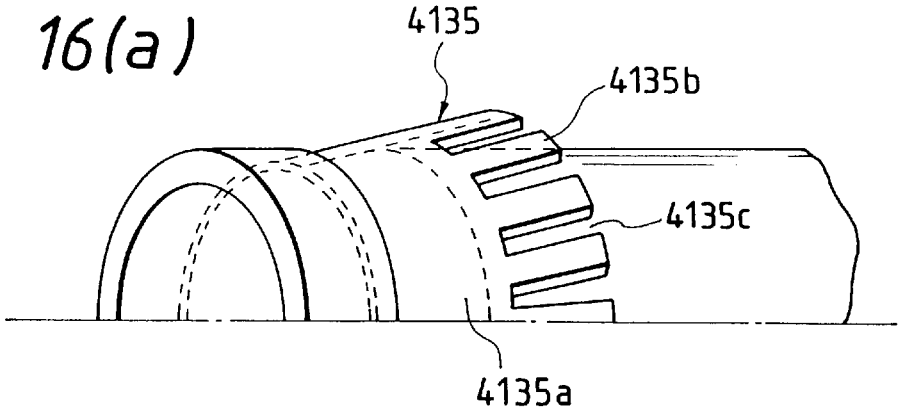
FIGS. 16(*a*)–16(*c*) are schematic diagrams for showing a major portion of an image carrier unit according to a fifth embodiment of the present invention.
Figure 16B:
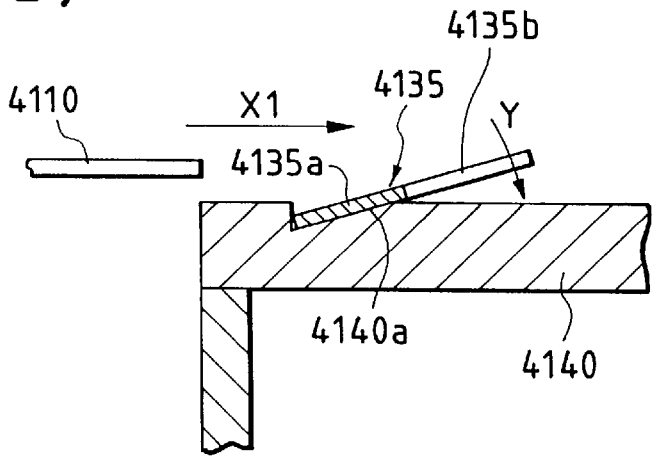
Figure 16C:
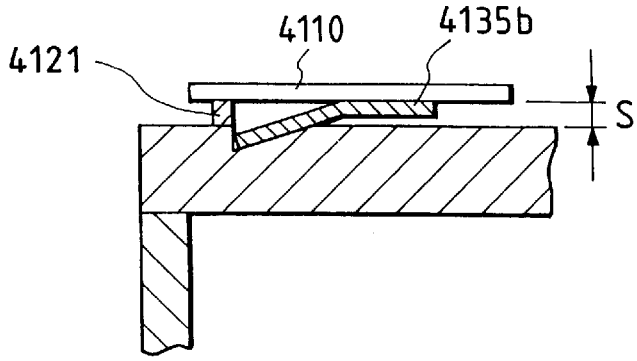

FIG. 16 is a schematic diagram for representing a major portion of an image carrier unit according to a fifth embodiment of the present invention. FIG. 16 (*a*) is a perspective view for partially showing an upper half portion for showing a cylindrical member and a spacer, and FIG. 16 (*b*) is a sectional view, and FIG. 16 (*c*) is an operation explanatory diagram.

This fifth embodiment owns a different point from the above-described first embodiment, namely a structure of a spacer, and other structures of the fifth embodiment are identical to those of the second embodiment.

A spacer 4135 in this fourth embodiment wholly owns a truncated conical shape, and is equipped with a thin ring-shaped base portion 4135*a* fixed on an outer circumferential surface of a cylindrical member 4140, and 24 sheets of flexible pieces 4135*b* functioning as an elastic portion fabricated from this base portion 4135*a* in a radial form in one body. It should be noted that a toroidal-shaped concave portion 4140*a* is preferably formed on the cylindrical member 4140 in order to surely fix the base portion 4135*a* of the spacer 4135.

When the image carrier member 4110 is covered on the cylindrical member 4140, as indicated by an arrow Xl in FIG. 16 (*b*) (when cylindrical member 4140 is inserted into image carrier 4110), the flexible pieces 4135*b* are flexed along a direction of an arrow Y, and the image carrier 4110 is supported from the inside thereof by the own recovery force of such a spacer 4135, as indicated in FIG. 16 (*c*).

Such a spacer 4135 may be simply manufactured in such a way that either a thin metal or synthetic resin is made in a truncated conical shape, and a slit 4135c is formed in this metal, or synthetic resin.

Also, in the case that the spacer 4135 is made of a metal, since the image carrier 4110 can be conducted with the cylindrical member 4140 by this metal spacer, the adhesive fixing member 4121 need not own the electric conductivity in this embodiment.

Sixth Embodiment

Figure 17B:
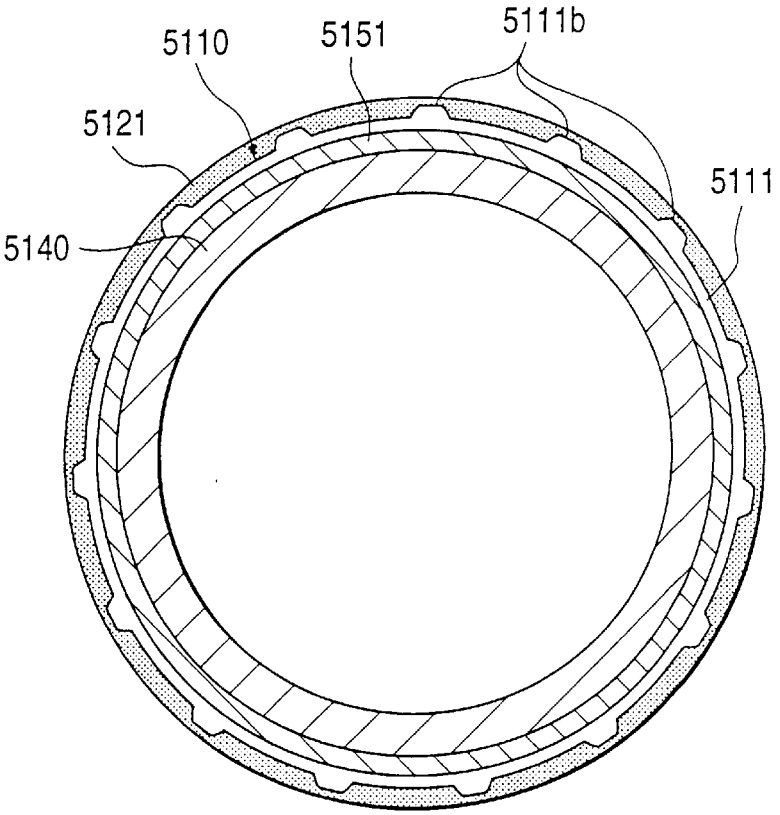
FIGS. 17(*a*) and 17(*b*) are schematic diagrams for showing a major portion of an image carrier unit according to a sixth embodiment of the present invention.
Figure 17A:
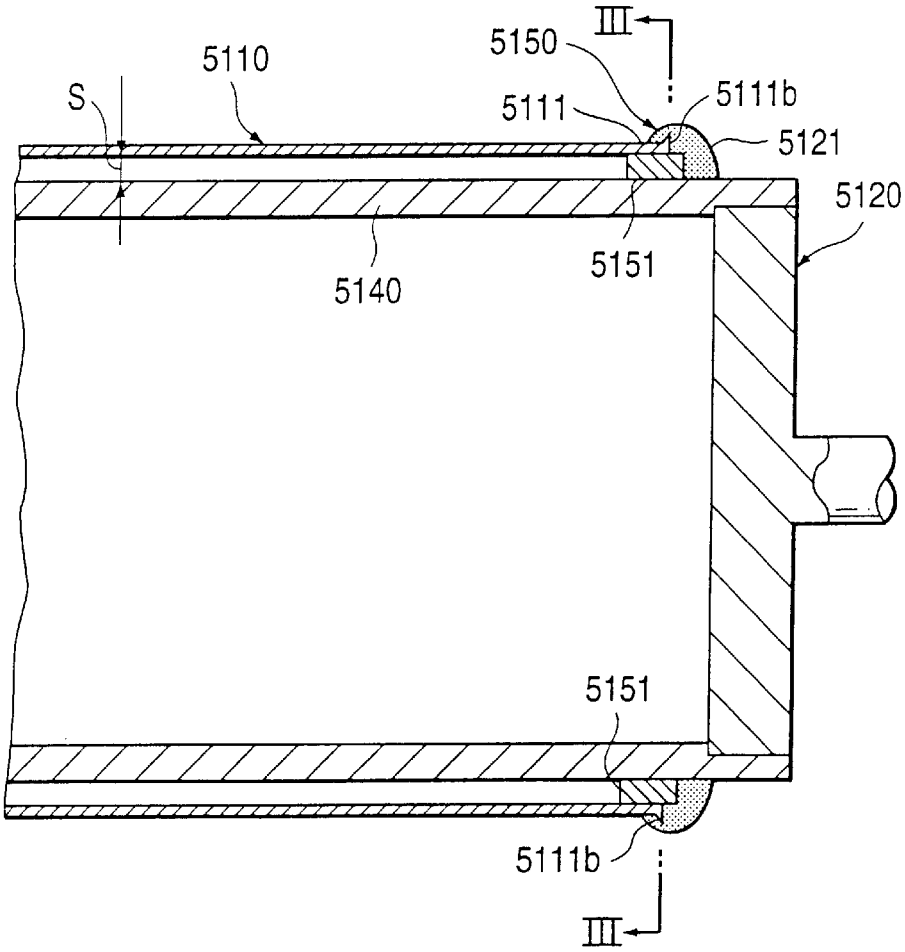

FIG. 17 is a schematic diagram for indicating a major portion of an image carrier unit according to a sixth embodiment of the present invention; FIG. 17 (*a*) is a partial sectional view; and FIG. 17 (*b*) is a sectional view, taken along a line III—III of FIG. 17 (*a*). It should be noted that FIG. 17 (*a*) is a sectional view for representing a right portion of the image carrier unit, and a left portion thereof is constituted in a symmetrical manner to the right portion.

This sixth embodiment has a different point from that of the above-explained second embodiment, namely, a fixing structure of the both end portions 5111 of the image carrier 5110, whereas other points thereof are identical to these of the second embodiment.

In this sixth embodiment, a fixing means 5150 for fixing the both end portions 5111 of the image carrier 5110 on the supporting member 5120 contains a spacer 5151 made of a ring-shaped elastic member and interposed between the image carrier 5110 and the cylindrical member 5140; and adhesive agent 5121 for adhering this spacer 5151 and the image carrier end portion 5111 to the cylindrical member 5140.

The elastic member for constituting the spacer 5151 is made of sponge. A thickness of this sponge under free state is made larger than the interval "S" between the image carrier 5110 and the cylindrical member 5140. As a result, this spacer 5151 has a similar function to that of the above-described spacer 1130, and the like.

The adhesive agent 5121 is mounted so as to cover the spacer 5151 and the burr 5111*b* of the image carrier end portion.

In accordance with such a fixing structure, the image carrier 5110 is held on the cylindrical member 5140 in the coaxial manner by the elastic force of the ring-shaped elastic member 5151, and the adhesive agent 5121 for adhering the image carrier end portion 5111 to the cylindrical member 5140 is provided over the burr 5111*b*. As a result, the burr 5111b may function as the adhesive base. The adhesive area is increased, so that since the adhesive strength is increased, the durability and the reliability are improved.

Seventh Embodiment

Figure 18B:
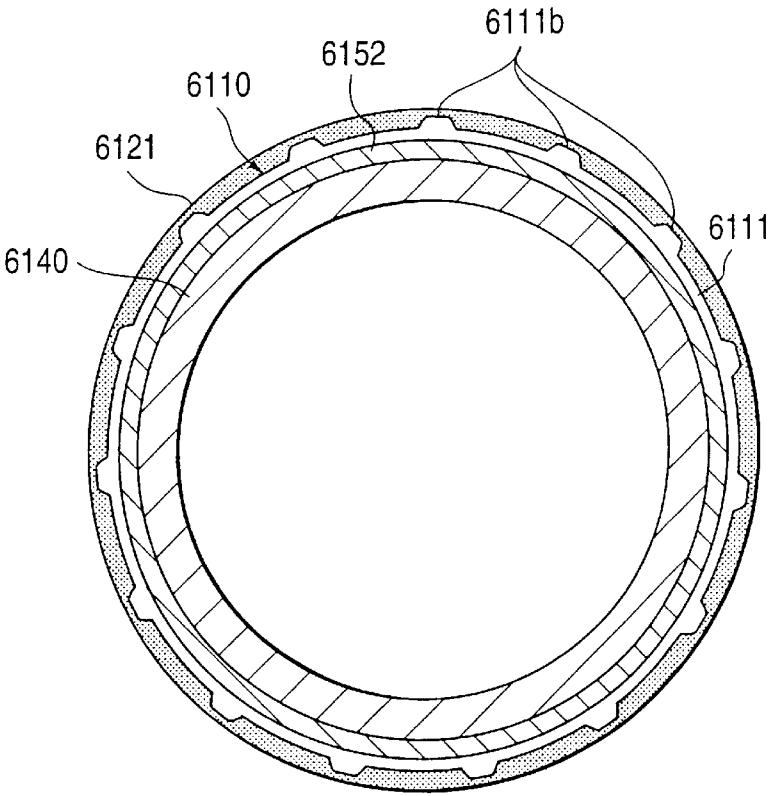
FIGS. 18(*a*) and 18(*b*) are schematic diagrams for showing a major portion of an image carrier unit according to a seventh embodiment of the present invention.
Figure 18A:
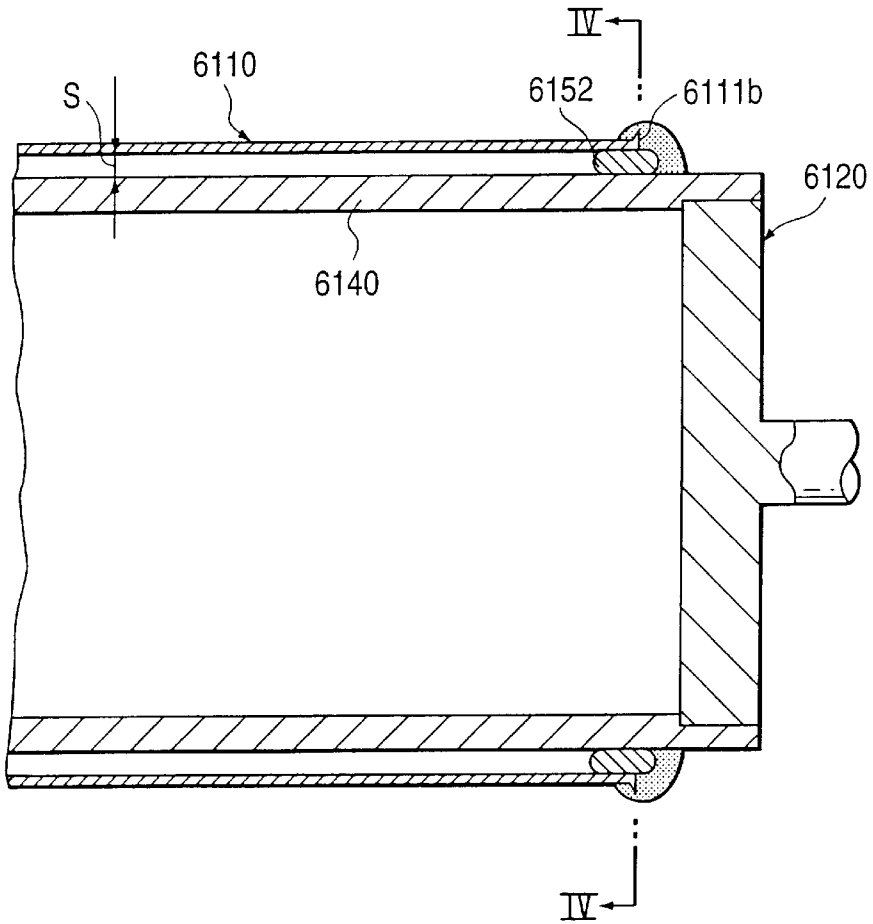

FIG. 18 is a schematic diagram for indicating a major portion of an image carrier unit according to a seventh embodiment of the present invention; FIG. 18 (*a*) is a partial sectional view; and FIG. 18 (*b*) is a sectional view, taken along a line IV—IV of FIG. 18 (*a*). It should be noted that FIG. 18 (*a*) is a sectional view for representing a right portion of the image carrier unit, and a left portion thereof is constituted in a symmetrical manner to the right portion.

This seventh embodiment has a different point from that of the above-described sixth embodiment, namely, a ring-shaped elastic member for constituting a spacer, an O-ring 6152 is employed instead of the sponge, whereas other points thereof are identical to those of the sixth embodiment.

A thickness of the O-ring 6152 under free state is made larger than the interval "S" between the image carrier 6110 and the cylindrical member 6140. The cylindrical member 6140 is supported on the ends by supporting member 6120.

A similar effect to that of the above-explained sixth embodiment can be achieved even by this seventh embodiment, in which an adhesive fixing member 6121 is adhered to the ends 6111 of the image carrier, including burrs 6111*b*, and to the cylindrical member 6140.

Eighth Embodiment

Figure 19B:
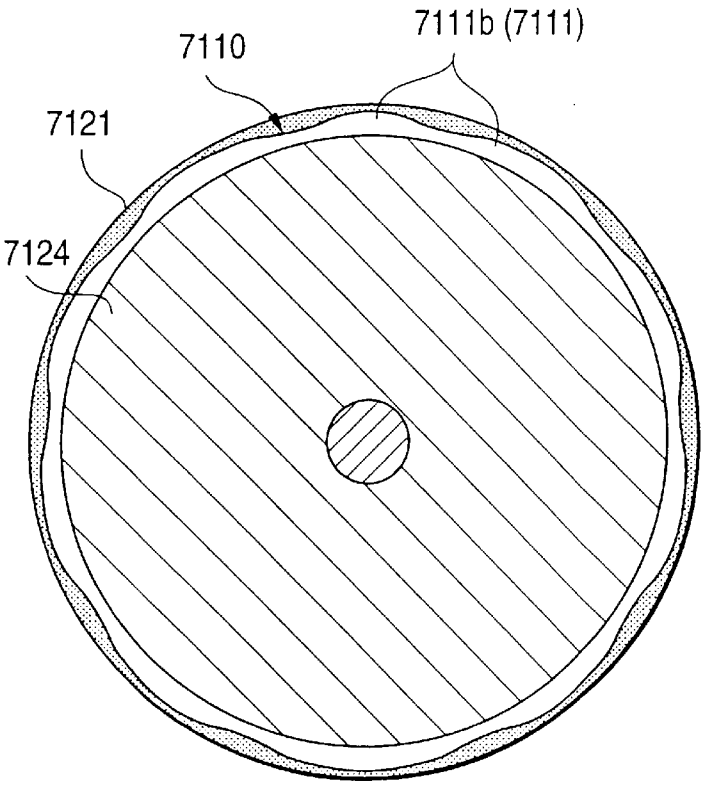
FIGS. 19(*a*) and 19(*b*) are schematic diagrams for showing a major portion of an image carrier unit according to a eighth embodiment of the present invention.
Figure 19A:
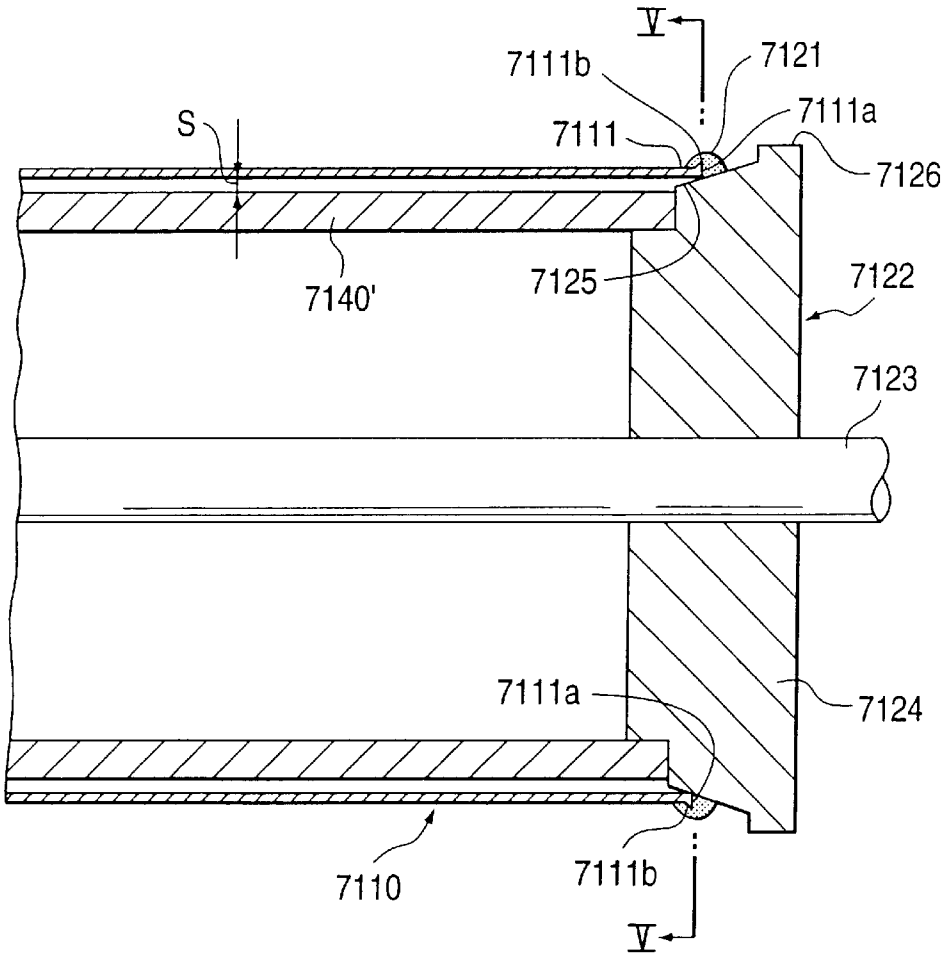

FIG. 19 is a schematic diagram for indicating a major portion of an image carrier unit according to an eighth embodiment of the present invention; FIG. 19 (*a*) is a partial sectional view; and FIG. 19 (*b*) is a sectional view, taken along a line V—V of FIG. 19 (*a*). It should be noted that FIG. 19 (*a*) is a sectional view for representing a right portion of the image carrier unit, and a left portion thereof is constituted in a symmetrical manner to the right portion.

This eighth embodiment has a different point from the above-explained first embodiment, namely, a supporting member and a supporting structure for the image carrier by this supporting member, whereas other structures thereof are the same as those of the first embodiment.

A supporting member 7122 according to this eighth embodiment is equipped with a shaft 7123, a disk-shaped supporting member 7124 fixed on this shaft 7123, and a cylindrical member 7140' fixed on this supporting member 7124. Similar to the above description of the first embodiment, the shaft 7123, supporting member 7124, and cylindrical member 7140' are made of either a metal or a high rigid material such as synthetic resin, which can be very hardly deformed. The cylindrical member 7140' has a similar structure to that of the cylindrical member 140 according to the first embodiment except that a length of this cylindrical member 7140' is shorter than the length of the image carrier 7110 along the axial direction.

The supporting member 7124 has a taper surface for supporting the end portion 7111 of the image carrier 7110 inwardly, and a flange portion 7126 having an outer diameter larger than that of the image carrier 7110.

An adhesive agent 7121 functioning as the fixing means adheres the end portion 7111 of the image carrier 7110 to the supporting member 7122 while using the burr 7111*b* of the image carrier 7110 as an adhesive base 7111*a*.

Figure 1:
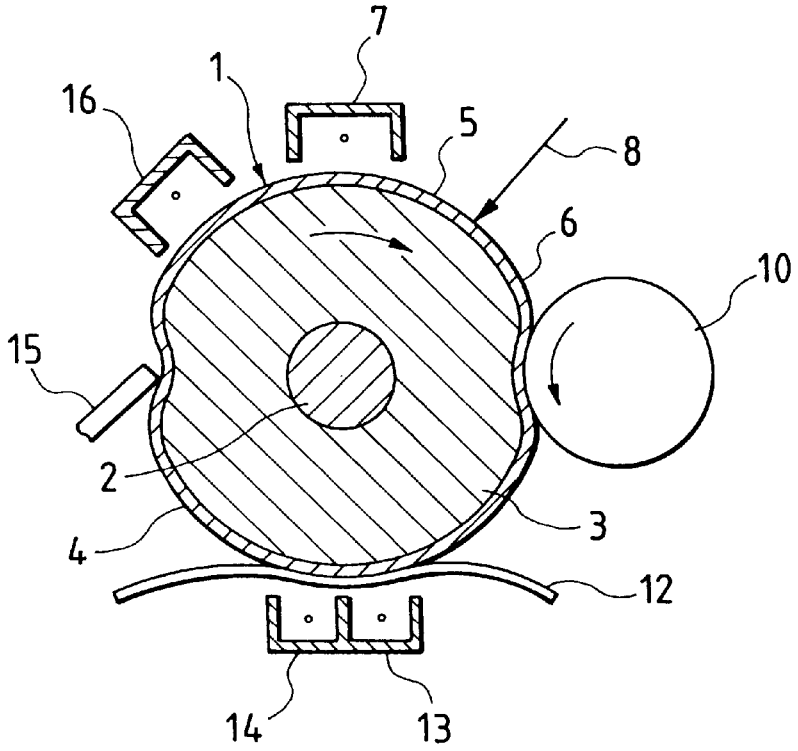
FIG. 1 PRIOR ART
FIG. 1 is an explanatory diagram showing one conventional apparatus.
Figure 2:
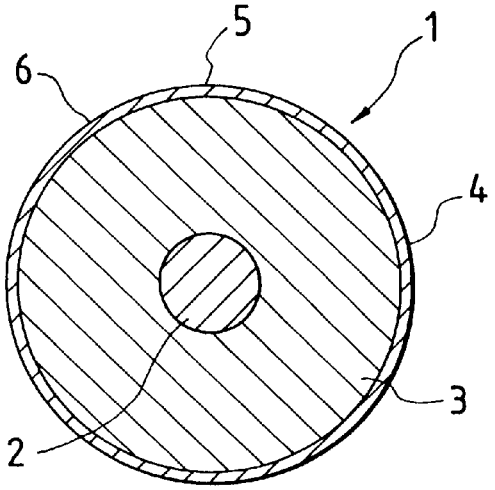
FIG. 2 PRIOR ART
FIG. 2 is an explanatory diagram showing the conventional apparatus.
Figure 3:
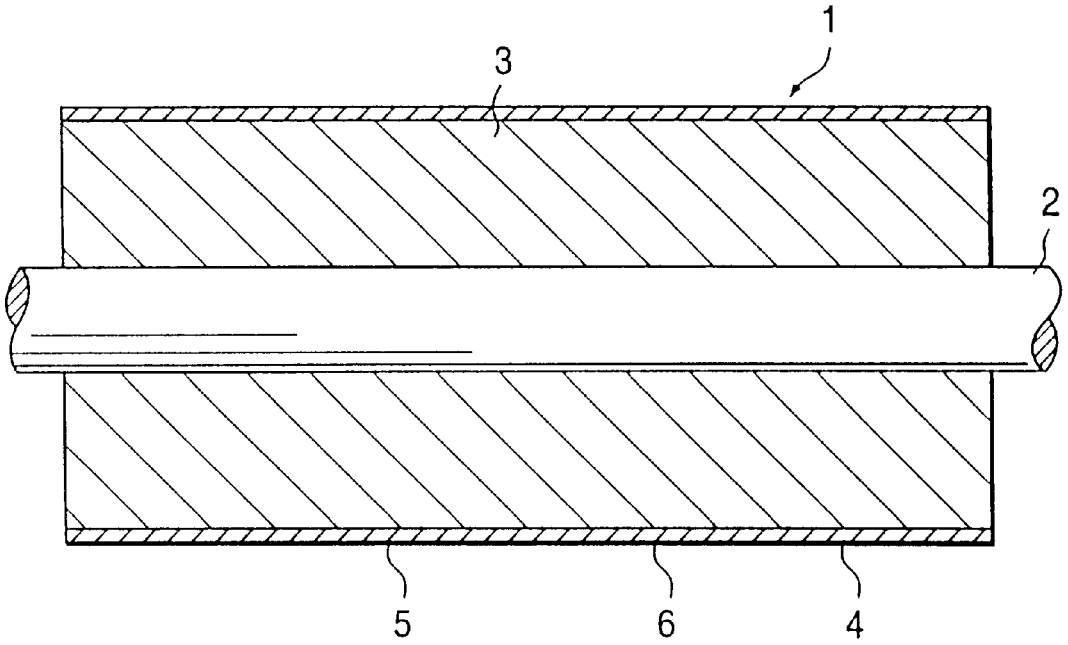
FIG. 3 PRIOR ART
FIG. 3 is an explanatory diagram showing the conventional apparatus.

Such an image carrier unit may be manufactured by way that the taper surface 7125 of the supporting member 7122 is lightly pressure-entered into the end portion 7111 of the image carrier 7110, and the edge portion 7111 of the image carrier 7110 is adhered to the supporting member 7122 by using the adhesive agent 7121. Since no longer the elastic material layer is filled as in the above-explained photosensitive drum 1 (see FIG. 1 to FIG. 3) of Japanese Patent Publication No. 4-69383, the image carrier unit can be simply manufactured.

Since the supporting member 7122 has the taper surface for supporting both end portions 7111 of the image carrier 7110, even when the manufacturing error is present between the image carrier 7110 and the taper surface 7125 of the supporting member, this error can be absorbed by the taper surface 7125. In this case, since the burr 7111*b* is formed on the outer circumferential plane of the image carrier 7110, this never disturbs the abutment between the image carrier 7110 and the taper surface 7125 of the supporting member. As a consequence, both end portions 7111 of the image carrier 7110 can be surely fitted to the taper surface 7125, so that the coaxial degree between the image carrier 7110 and the supporting member 7122 can be readily maintained. Accordingly, the vibrations occurred when the image carrier 7110 is rotated are reduced, and the image fluctuations are hardly produced.

Furthermore, since this image carrier unit can be manufactured by such a manner that both end portions 7111 of the image carrier 7110 are supported by the taper surface 7125 of the supporting member and are then fixed by the adhesive agent 7121, the image carrier unit can be more simply manufactured.

In the case that at least a surface of the supporting member 7124 is made of a metal, the electroconductivity between the image carrier 7110 and the supporting member 7124 can be established by the abutting portion with the image carrier 7110, so that the adhesive agent 7121 need not always have electroconductivity.

Furthermore, since the supporting member 7124 includes the flange portion 7126 having the larger outer diameter than the outer diameter of the image carrier 7110, for example, even when the operator puts this image carrier unit on a desk, the image carrier 7110 is not directly put in contact with the desk and the like, and therefore is not scratched. Thus, the operability of the image carrier unit can be further improved.

Moreover, when the abutting member abuts against the image carrier 7110, this flange unit 7126 may be employed as the interval defining means for defining the interval between the image carrier 7110 and the abutting member. For instance, the interval between the image carrier 7110 and the roller 200 may be defined by causing the bearing member 202 of the roller 200 shown in FIG. 5 to abut against the flange portion 7126.

Ninth Embodiment

Figure 20B:
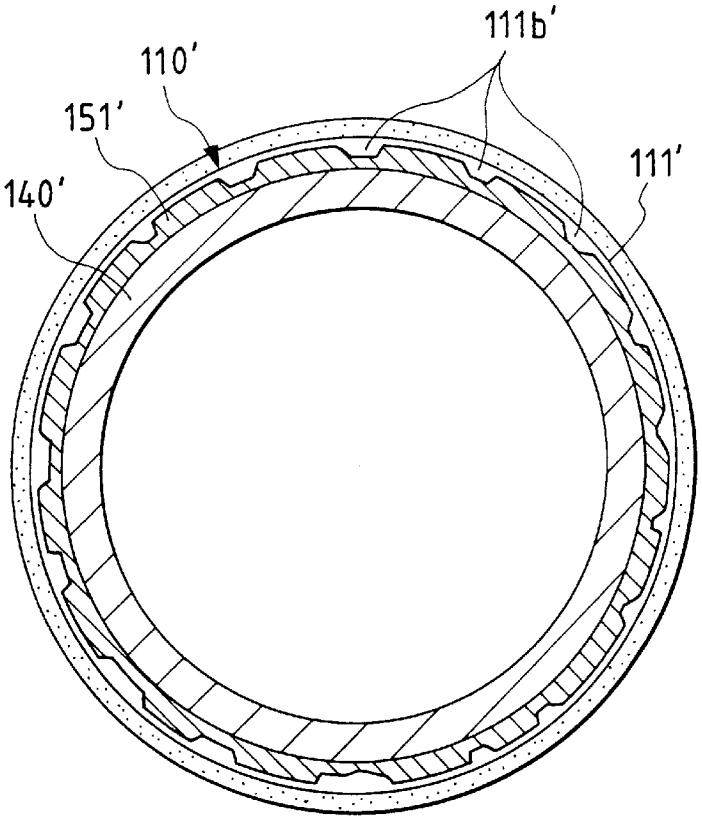
FIGS. 20(*a*) and 20(*b*) are schematic diagrams for showing a major portion of an image carrier unit according to an ninth embodiment of the present invention.
Figure 20A:
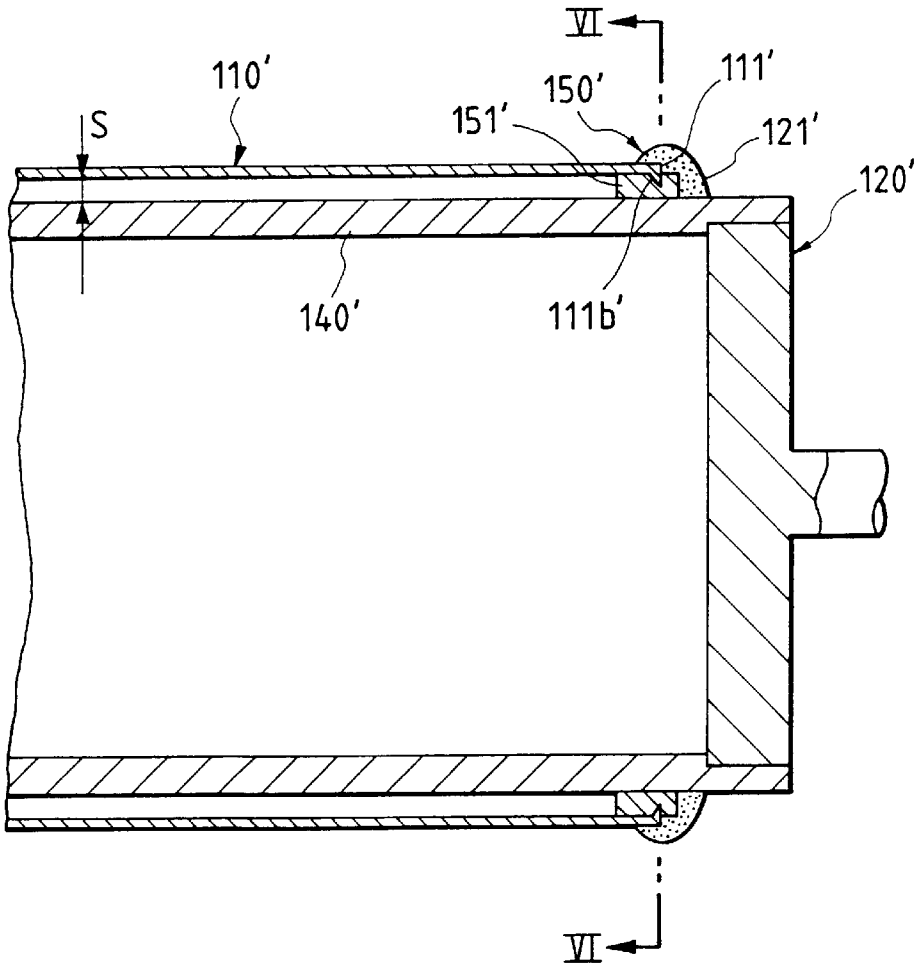

FIG. 20 is a schematic diagram for indicating a major portion of an image carrier unit according to a ninth embodiment of the present invention; FIG. 20 (*a*) is a partial sectional view; and FIG. 20 (*b*) is a sectional view, taken along a line VI—VI of FIG. 20 (*a*). It should be noted that FIG. 20 (*a*) is a sectional view for representing a right portion of the image carrier unit, and a left portion thereof is constituted in a symmetrical manner to the right portion.

This ninth embodiment has a different point from that of the above-explained second embodiment, namely, a fixing structure of the both end portions 111' of the image carrier 110', whereas other points thereof are identical to these of the second embodiment.

In this ninth embodiment, a fixing means 150' for fixing the both end portions 111' of the image carrier 110' on the supporting member 120' contains a spacer 151' made of a ring-shaped elastic member and interposed between the image carrier 110' and the cylindrical member 140'; and adhesive agent 121' for adhering this spacer 151' and the image carrier end portion 111' to the cylindrical member 140'.

The elastic member for constituting the spacer 151' is made of sponge. A thickness of this sponge under free state is made larger than the interval "S" between the image carrier 110' and the cylindrical member 140'. As a result, this spacer 151' has a similar function to that of the above-described spacer 1130, and the like.

The adhesive agent 121' is mounted so as to cover the spacer 151' and the burr 111*b'* of the image carrier end portion.

In the image carrier unit, for example, the spacer 151' is mounted at an inner end side of the image carrier with the burr 111*b'* of the image carrier being embedded and fitted in the spacer 151', and covers the cylindrical member 140' (The cylindrical member 140' is inserted into the image carrier. Then, the adhesive agent 121' is applied so as to be easily manufactured.

In accordance with such a fixing structure, the image carrier 110' is held on the cylindrical member 140' in the coaxial manner by the elastic force of the ring-shaped elastic member 151', and the burr 111*b'* is embedded in the elastic member 151' so that there is increased the fitting force between the image carrier 110' and the elastic member 151'. Then, the elastic member 151' and the both end portions 111' adhere on the cylindrical member 140'. As a result, the image carrier unit can be more simply manufactured to increase the adhesive strength without a jig for holding the image carrier 110' and the cylindrical member 140' in the coaxial condition.

Tenth Embodiment

Figure 21B:
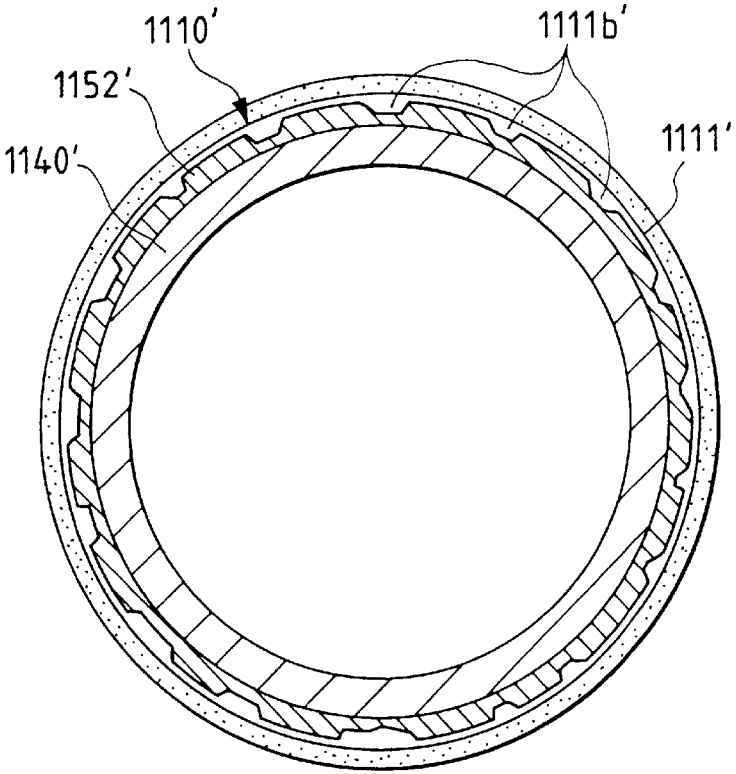
FIGS. 21(*a*) and 21(*b*) are schematic diagrams for showing a major portion of an image carrier unit according to a tenth embodiment of the present invention.
Figure 21A:
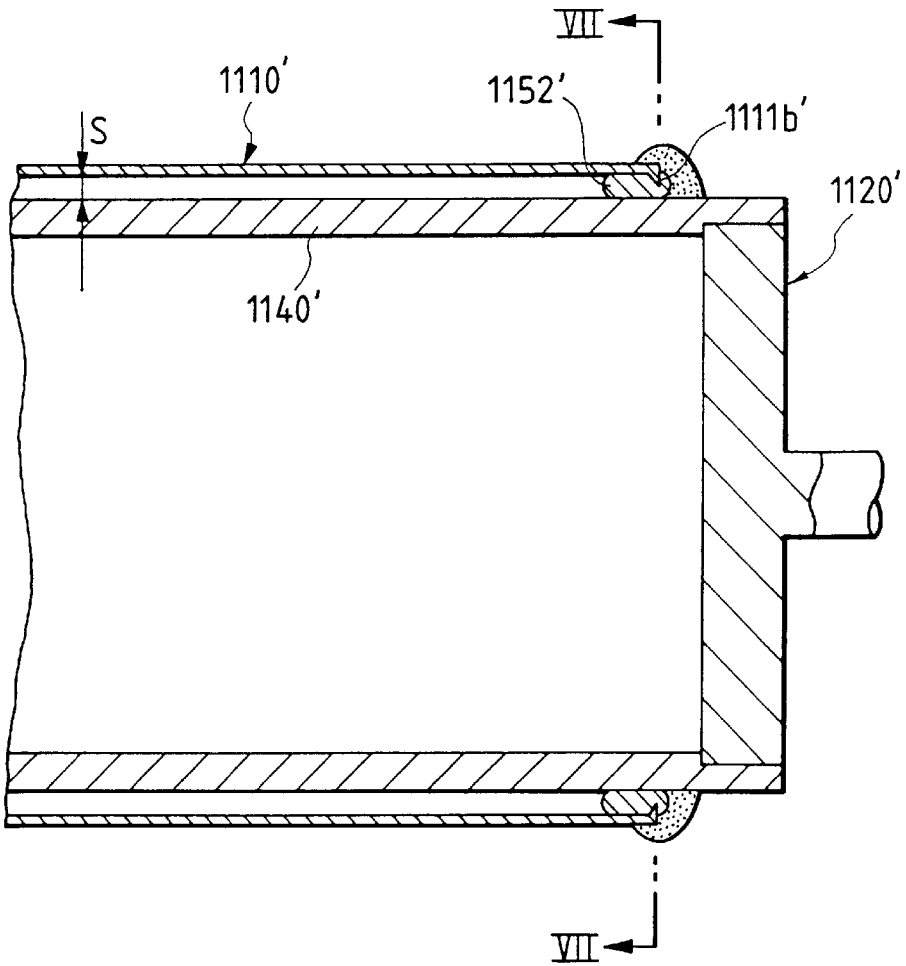

FIG. 21 is a schematic diagram for indicating a major portion of an image carrier unit according to a tenth embodiment of the present invention; FIG. 21 (*a*) is a partial sectional view; and FIG. 21 (*b*) is a sectional view, taken along a line VII—VII of FIG. 21 (*a*). It should be noted that FIG. 21 (*a*) is a sectional view for representing a right portion of the image carrier unit, and a left portion thereof is constituted in a symmetrical manner to the right portion.

This tenth embodiment has a different point from that of the above-described ninth embodiment, namely, a ring-shaped elastic member for constituting a spacer, an O-ring 1152' is employed instead of the sponge, whereas other points thereof are identical to those of the ninth embodiment.

A thickness of the O-ring 1152' under free state is made larger than the interval "S" between the image carrier 1110' and the cylindrical member 1140'. Burr 1111*b'*, on the end portion 11111' of image carrier 1110', embeds in O-ring 1152'.

A similar effect to that of the above-explained fifth embodiment can be achieved even by this tenth embodiment which includes support member 1120'.

Eleventh Embodiment

Figure 22B:
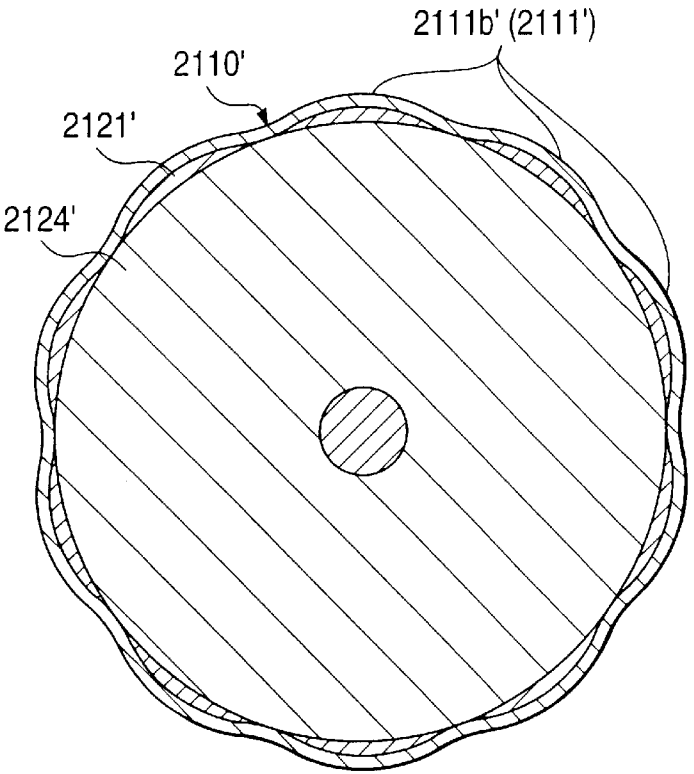
FIGS. 22(*a*) and 22(*b*) are schematic diagrams for showing a major portion of an image carrier unit according to an eleventh embodiment of the present invention.
Figure 22A:
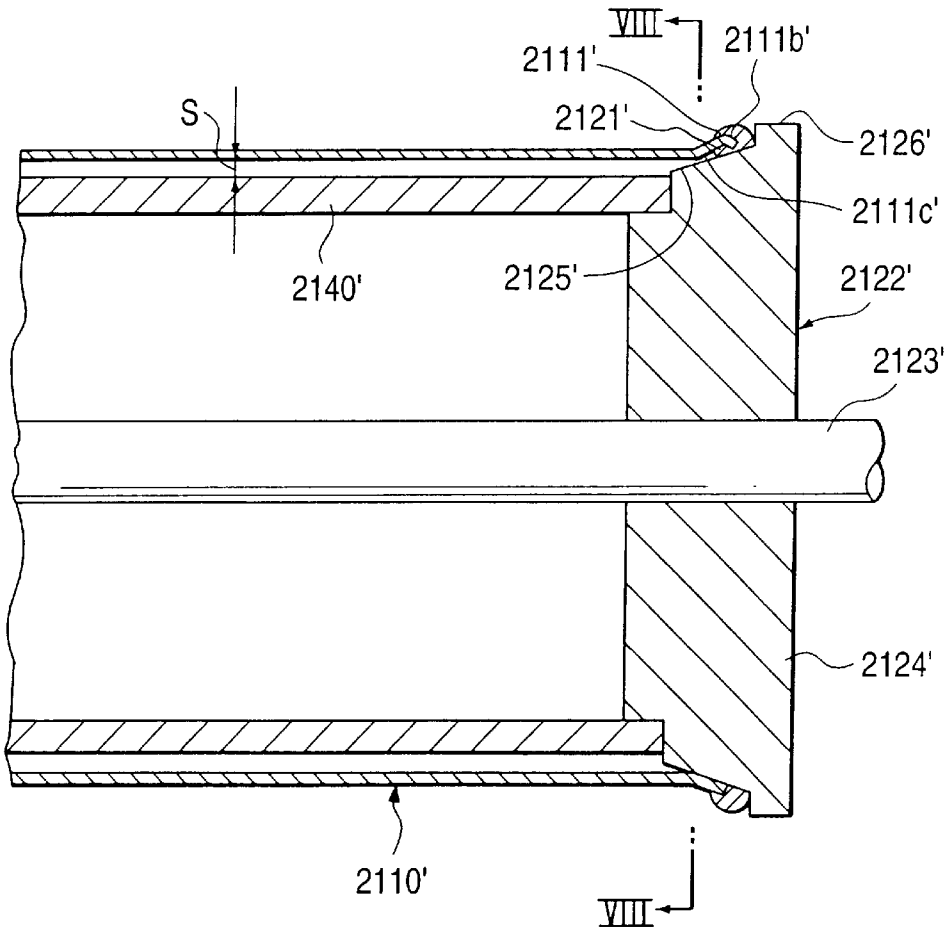

FIG. 22 is a schematic diagram for indicating a major portion of an image carrier unit according to an eleventh embodiment of the present invention; FIG. 22 (*a*) is a partial sectional view; and FIG. 22 (*b*) is a sectional view, taken along a line VIII—VIII of FIG. 22 (*a*). It should be noted that FIG. 22 (*a*) is a sectional view for representing a right portion of the image carrier unit, and a left portion thereof is constituted in a symmetrical manner to the right portion.

This eleventh embodiment has a different point from the above-explained first embodiment, namely, a supporting member and a supporting structure for the image carrier by this supporting member, whereas other structures thereof are the same as those of the first embodiment.

A supporting member 2122' according to this eleventh embodiment is equipped with a shaft 2123', a disk-shaped supporting member 2124' fixed on this shaft 2123', and a cylindrical member 2140' fixed on this supporting member 2124'. Similar to the above description of the first embodiment, these shaft 2123', supporting member 2124', and cylindrical member 2140l' are made of either a metal or a high rigid material such as synthetic resin, which can be very hardly deformed. The cylindrical member 2140' owns a similar structure to that of the cylindrical member 2140' according to the first embodiment except that a length of this cylindrical member 2140' is shorter than the length of the image carrier 2110' along the axial line direction.

The supporting member 2124' has a taper surface for supporting the end portion 2111' of the image carrier 2110' at an inner side from an axis direction, and a flange portion 2126' having an outer diameter larger than that of the image carrier 2110'.

An adhesive agent 2121' functioning as the fixing means adheres the end portion 2111' of the image carrier 2110' to the supporting member 2122' while using the burr 2111*b'* of the image carrier 2110' as the adhesive base.

Such an image carrier unit may be manufactured by way that the taper surface 2125' of the supporting member 2122' is lightly pressure-entered into the end portion 2111' of the image carrier 2110', and the edge portion 2111' of the image carrier 2110' is adhered to the supporting member 2122' by using the adhesive agent 2121'. Since no longer the elastic material layer is filled as in the above-explained photosensitive drum 1 (see FIGS. 1 to FIG. 3) of Japanese Patent Publication No. 4-69383, the image carrier unit can be simply manufactured.

When the taper surface 2125' of the supporting member is lightly pressure-inserted into the edge portion 2111' of the image carrier 2110', the edge portion of the image carrier 2110' is widened as shown in FIG. 22 (*a*), and also, the inside portion 2111*c'* along the axial line direction abuts against the taper surface 2125' of the supporting member. As a result, since this portion is supported, the image carrier 2110' is supported in the coaxial manner with the supporting member 2122' without being adversely influenced by the burr 2111*b'*.

In other words, it is possible to obtain the firm/stable contact condition with the abutment member such as the hardness roller even by the image carrier unit of this embodiment, and the manufacture of this image carrier unit can be made simple.

When at least the surface of the supporting member 2124' is made of a metal, the electroconductivity of the image carrier 2110' and the supporting member 2124' can be established by the above abutment portion (2111*c'*), so that the adhesive agent 2121' need not have conductivity.

In the case that at least a surface of the supporting member 2124' is made of a metal, the electroconductivity between the image carrier 2110' and the supporting member 2124' can be established by the abutting portion (2110*c'*), so that the adhesive agent 2121' need not always have the electroconductivity.

Furthermore, since the supporting member 2124' has the flange portion 2126' having the larger outer diameter than the outer diameter of the image carrier 2110', for example, even when the operator puts this image carrier unit on a desk, the image carrier is not directly made in contact with the desk and the like, and therefore is not scratched. Thus, the operability of the image carrier unit can be further improved.

Moreover, when the abutting member abuts against the image carrier 2110', this flange unit 2126' may be employed as the interval defining means for defining the interval between the image carrier 2110' and the abutting member. For instance, the interval between the image carrier 2110' and the roller 200 may be defined by causing the bearing member 202 of the roller 202 shown in FIG. 5 to abut against the flange portion 2126'.

Twelfth Embodiment

Figure 23A:
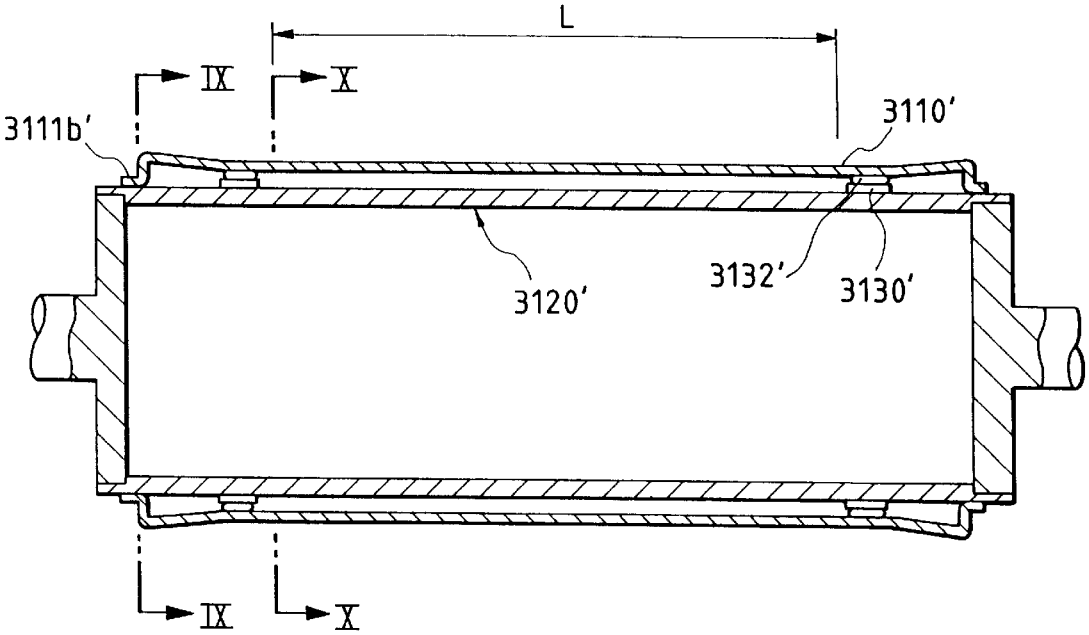
FIGS. 23(*a*) and 23(*b*) are diagrams for indicating an image carrier unit according to a twelfth embodiment of the present invention.
Figure 23B:
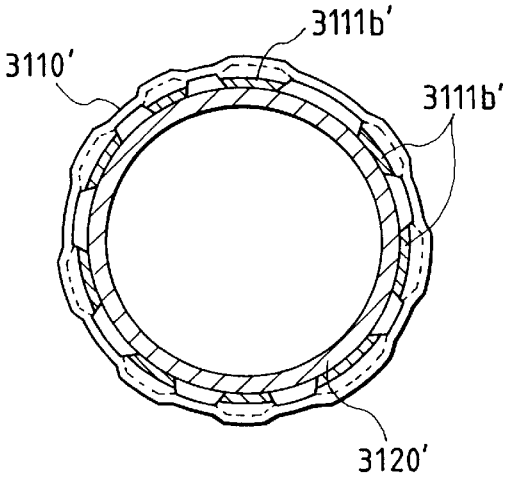
Figure 23C:
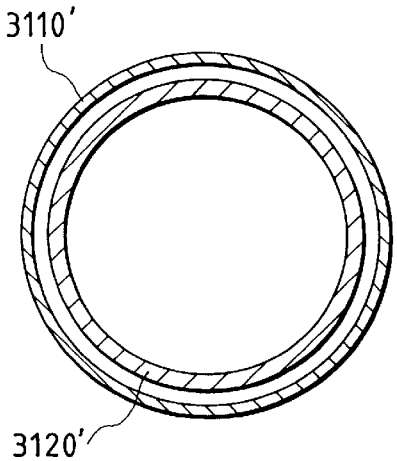

FIG. 23 is a schematic diagram for indicating an image carrier unit according to a twelfth embodiment of the present invention; FIG. 23 (*a*) is a partially omitted sectional view; FIG. 23 (*b*) is a sectional view, taken along a line IX—IX of FIG. 23 (*a*); and FIG. 23 (*c*) is a sectional view, taken along a line X—X of FIG. 23 (*a*).

Figure 24B:
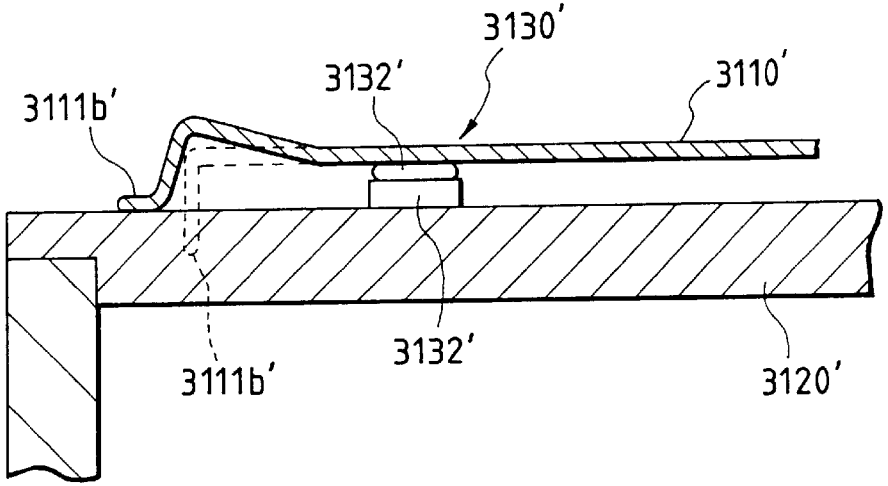
FIGS. 24(*a*) and 24(*b*) are enlarged diagrams of the image carrier edge portion shown in FIG. 23.
Figure 24A:
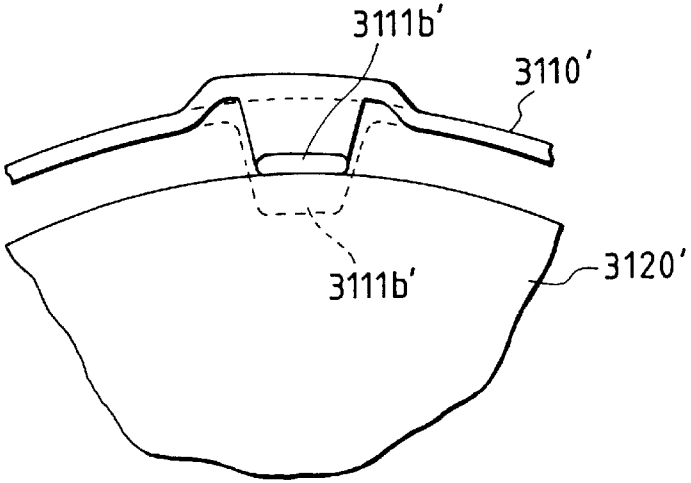

FIG. 24 (*a*) is an enlarged view for showing an image carrier end portion, and FIG. 24(*b*) is a left side view of FIG. 24(*a*).

This twelfth embodiment has a different point from the above-explained second embodiment, namely, an outer diameter dimension of the supporting body 3120', and a supporting structure, or a fixing structure of the image carrier by this supporting member 3120', whereas other points thereof are identical to those of the second embodiment.

An outer diameter of the supporting member 3120' in this twelfth embodiment is made slightly larger than that of the supporting member 1120 in the second embodiment. In other words, the outer diameter of the supporting member 3120' according to the twelfth embodiment is made smaller than the inner diameter of the image carrier 3110' by at least the value equal to the height of the burr 3111*b'*. To the contrary, the outer diameter of the supporting member 3120' according to this twelfth embodiment is made smaller than the inner diameter of the image carrier 3110', but is made small by a value less than the height of the burr 3111*b'*.

As a consequence, when the supporting member 3120' is inserted inside the image carrier 3110', the burr 3111*b'* abuts against the outer circumferential plane of the supporting member 3120', and the both end portions of the image carrier 3110' are deformed in such a manner that both end portions are expanded at this burr 3111*b'* portion. Conversely speaking, both the image carrier 3110' and the supporting member 3120' are fixed by the recovery force of the deformed burr 3111*b'* portion.

A spacer 3130' similar to that of the second embodiment is interposed between the image carrier 3110' and the supporting member 3120', and an elastic portion 3132' thereof elastically and equally supports the image carrier 3110' inwardly inside the burr 3111*b'* portion along the axial line direction. It should be noted that any one of the spacers shown in FIGS. 14 to FIG. 16 may be employed instead of this spacer 3130'.

First of all, in such an image carrier unit, the supporting member 3120' is inserted into the image carrier 3110'. At this time, the burr formed at one end of the image carrier 3110' is deformed inside along the axial line direction while the burr overrides the spacer 3130'. Therefore, after the supporting member 3120' has been inserted, the supporting member 3120' (or image carrier 3110') is reciprocated several times along the right/left direction in FIG. 23 (*a*), so that the abutting condition between the burr 3111*b'* and the supporting member 3120' is matched. As a consequence, the burr 3111*b'* portion is deformed as shown in FIG. 24(*a*) and FIG. 24(*b*), and also the image carrier 3110' is expanded outwardly at this burr 3111*b'* portion. Conversely, the image carrier 3110' and the supporting member 3120' are fixed by the recovery force of this burr 3111*b'* portion and the image carrier member 3110'.

That is to say, according to this embodiment, the image carrier unit can be manufactured in such a manner that the supporting member 3120' is merely inserted into the image carrier 3110' and these members are relatively reciprocated several times. Since the elastic material layer need not be filled as in the above-described photosensitive drum 1 (see FIGS. 1 to 3) of Japanese Patent Publication No. 4-69383, the image carrier unit can be simply manufactured.

It should be noted that since the burr 3111*b'* portion of the image carrier 3110' is supported by the supporting member 3120', the both end portions are deformed by being expanded, and therefore, the roundness degree at both end portions is deteriorated as shown in FIG. 23 (*b*). However, since the image carrier 3110' is made as a thinner cylindrical shape having flexibility, as indicated in FIGS. 23 (*a*) and (*c*), the above-described distortion is lowered toward the center portion of the image carrier 3110'. At the central portion other than the both end portions, the roundness degree can be maintained without any practical problem. As a result, this central portion (region indicated by "L" shown in FIG. 23 (*a*)) may be utilized as the image region. It should be noted that FIG. 23 and 24 (and all other drawings attached in this specification) are schematic diagrams. As a consequence, the dimension of the burr 3111b' and the deformation of the image carrier 3110' are shown in the exaggerated manner. In actually, the dimension of the burr 3111*b'* and the deformation of the image carrier 3110' are not so large. The expansion amount of the edge portion of the image carrier 3110' along the radial direction is normally 0.2 to 0.03 mm, and at maximum, about 0.05 mm, namely very small.

Also, in this embodiment, the image carrier unit is equipped with the spacer 3130' interposed between the image carrier 3110' and the supporting member 3120', and the elastic portion 3132' for elastically and equally supporting the image carrier 3110' inside the burr 3111*b'* portion along the axial direction. Accordingly, the distortion which is produced at the both end portion of the image carrier 3110' and is lowered toward the center portion can be firmly removed at the spacer portion 3130'.

Therefore, the roundness degree in the center portion "L" of the image carrier can be more firmly obtained.

In other words, even in this image carrier unit of this embodiment, the stable/firm contact condition with the abutment member such as the hardness roller can be obtained, and the image carrier unit can be simply made.

It should also be noted that since the burr 3111*b'* portion and the supporting member 3120' are fixed by the adhesive agent, the image carrier 3110' and the supporting member 3120' can be further firmly fixed. At this time, when at least the contact portion of the supporting member 3120' with respect to the burr 3111*b'* is made of a metal, since the electroconductivity can be established between the image carrier 3110' and the supporting member 3124', the adhesive agent need not have electroconductivity.

Thirteenth Embodiment

Figure 25:
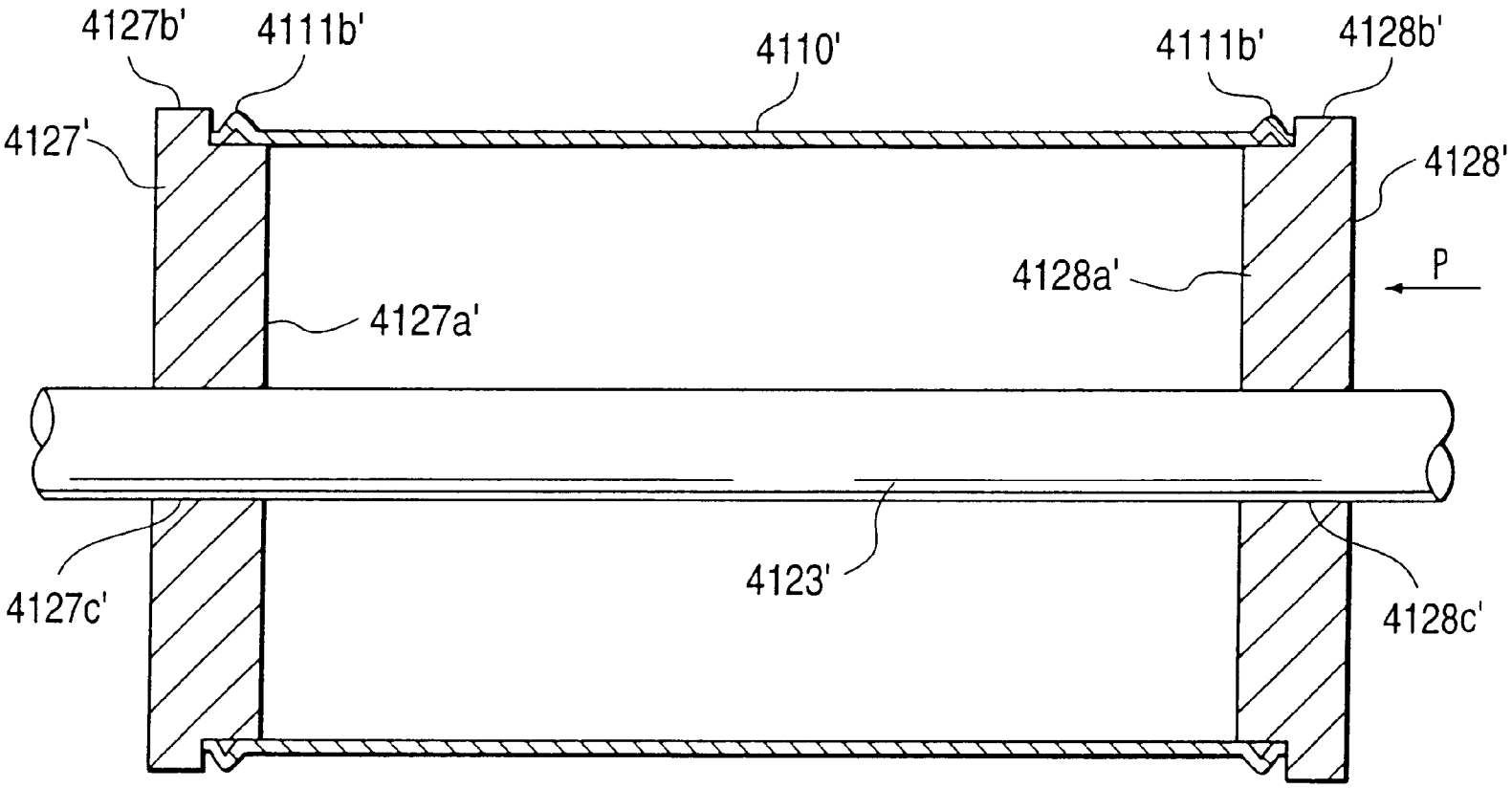
FIG. 25 is a sectional view for showing an image carrier unit according to an thirteenth embodiment of the present invention.
Figure 26:
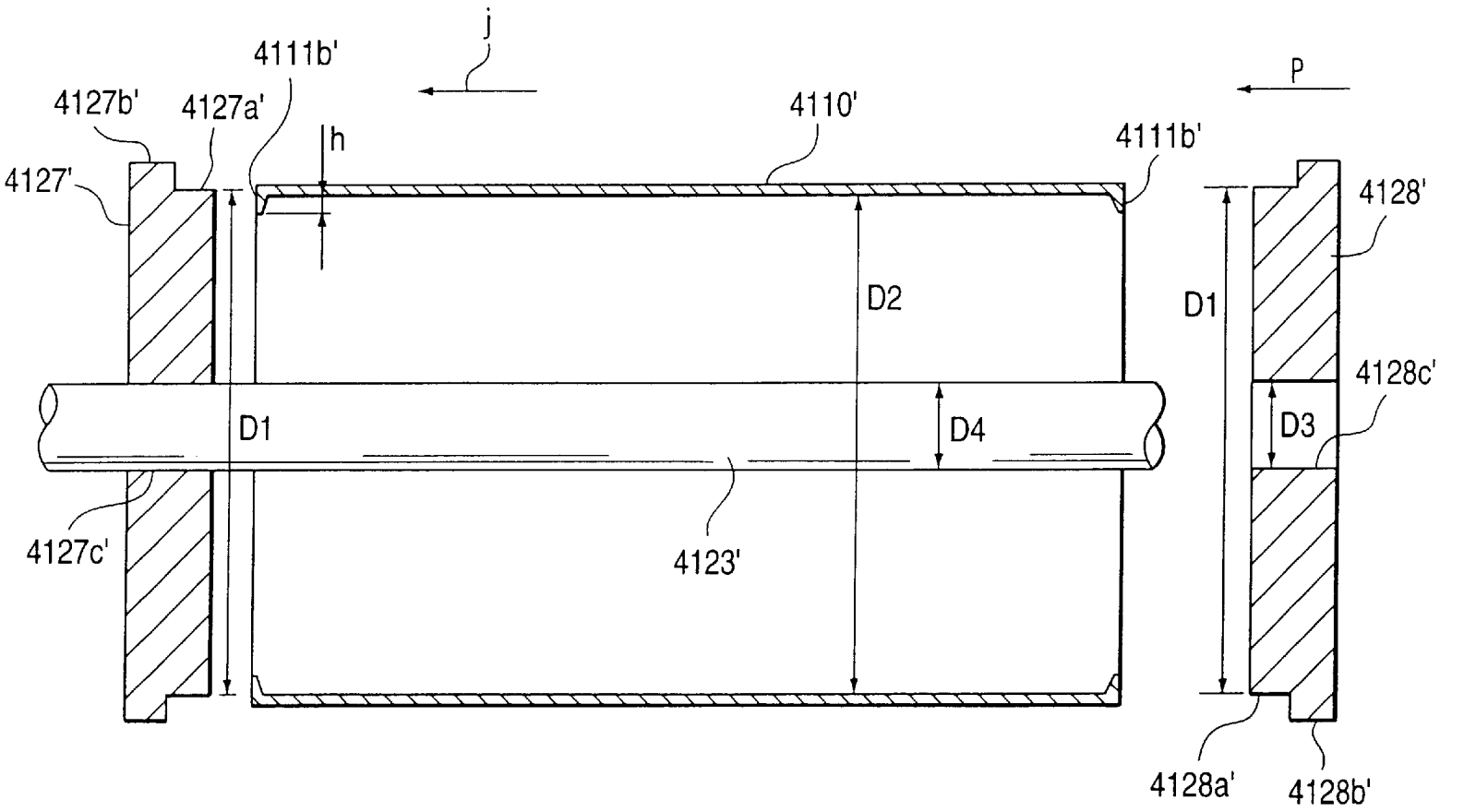
FIG. 26 is a disassembled view of the image carrier unit of FIG. 25.

FIG. 25 is a sectional view for indicating an image carrier unit according to a thirteenth embodiment of the present invention. FIG. 26 is a disassembled view.

This thirteenth embodiment has a different point from the above-explained second embodiment, namely, a supporting member is constituted by a shaft 4123', and one pair of disk-shaped supporting members 4127' and 4128' which are fixed on this shaft 4123', and a supporting structure, or a fixing structure of the image carrier 4110' by this supporting member, and other structures thereof are the same as those of the second embodiment.

Similar to the description about the second embodiment, the shaft 4123' and the supporting members 4127', 4128' according to this thirteenth embodiment are constructed of a hardly deformable metal, or a high rigid material such as synthetic resin.

The supporting members 4127' and 4128' have small-diameter portions 4127*a'*, 4128*a'*; large-diameter portions 4127*b'*, 4128*b'*; and holes 4127*c'*, 4128*c'* of center portions.

Outer diameters of the small-diameter portions 4127*a'*, 4128*a'* of the supporting members are made slightly larger than the outer diameter of the supporting member 1142 according to the second embodiment. In other words, the outer diameter of the supporting member 1142 according to the second embodiment is made smaller than the inner diameter of the image carrier 1110 only by the value equal to at least the height of the burr 1111*b*, whereas the outer diameters of the small-diameter portions 4127*a'*, 4128' of the supporting members according to the thirteenth embodiment are made smaller than the inner diameter of the image carrier 4110', but smaller by a value lower than the height of the burr 4111*b'*.

As a consequence, when the small-diameter portions 4127*a'*, 4128*a'*, of the supporting members are inserted into both edge portions of the image carrier 4110', the burr 4111*b'* abuts against outer circumferential planes of the small-diameter portions 4127*a'*, 4128*a'*, of the supporting members, and then the both edge portions of the image carrier 4110' are deformed to be expanded at this burr 4111*b'* portion. Conversely speaking, the image carrier 4110', and the supporting members 4127', 4128' are fixed by the recovery force of the deformed burr 4111*b'* portion.

Referring now to FIG. 26, a method for manufacturing this image carrier unit will be explained more in detail.

It is now assumed that the inner diameter of the image carrier 4110' is D2; the height of the burr 4111*b'* projected inwardly at the both end portions of the image carrier 4110' is "h"; the outer diameters of the small-diameter portions 4127*a'*, 4128*a'* of the supporting member are D1; the diameter of the hole 4128*c'* of one supporting member 4128' is D3; and the outer diameter of the shaft 4123' is D4.

As previously explained, the base member of the image carrier 4110' may be formed in high precision by a nickel electroforming tube, and the like, the tolerance of which may be on the order of ±0.01 mm.

The height "h" of the burr 4111*b*' is larger than the space between the inner circumferential plane of the image carrier 4110' and the outer circumferential planes of the small-diameter portions 4127*a*', 4128*a*' of the supporting member.

That is, h>(D2−D1)/2.

The supporting members 4127', 4128' may be cut-worked in high precision, the tolerance of which may be on the order of ±0.01 mm.

The outer diameters D1 of the small-diameter portions 4127*a*', 4128*a*' of the supporting member are set to be smaller than the inner diameter D2 of the image carrier 4110' only by this tolerance, and the tolerance of the image carrier 4110'.

In other words, D1=D2−0.02 mm.

Accordingly, there is a clearance of 0 to 0.04 mm between the inner circumferential plane of the image carrier 4110' and the small-diameter portion of the supporting member.

Also, the diameter D3 of the hole 4128*c*' of the supporting member 4128' is set to be larger than the outer diameter D4 of the shaft 4123' (D3>D4). A clearance between both members may be set to be smaller than, or equal to 0.01 mm.

To assemble the image carrier unit, one supporting member 4127' is fixed to the shaft 4123' by means of the pressure insertion in advance.

Then, first of all, as indicated by an arrow "j", one end of the image carrier 4110' is mounted with respect to the small-diameter portion 4127*a*' of one supporting member 4127', while deforming the burr 4111*b*'. Since the burr 4111*b*' is deformed, the supporting member 4127' is fixed with one end portion of the image carrier 4110' by this recovery force. It should be understood that when one end of the image carrier 4110' is mounted with respect to the small-diameter portion 4127*a*' of the supporting member 4127', the burr 4111*b*' may be reciprocated several times so as to be matched.

Next, as indicated by an arrow "p", while the other supporting member 4128' is mounted with respect to the shaft 4123', this small-diameter portion 4128*a*' is inserted into other end portion of the image carrier 4110'. At this time, the burr 4111*b*' of the other end portion of the image carrier 4110' is made in contact with the small-diameter portion 4128*a*' of the supporting member 4128', and then is enlarged/deformed. Thus, the supporting member 4128' is fixed with the other end portion of the image carrier 4110' by this recovery force. It should be noted that when the small-diameter portion 4128*a*' of the supporting member 4128' is inserted into the other end portion of the image carrier 4110, the burr 4111*b*' may be reciprocated several times so as to be matched.

Thereafter, in the hole 4128*c*' portion of the supporting member 4128', the supporting member 4128' is fixed with the shaft 4123' by way of adhesion.

In such an image carrier unit, the shaft 4123', the supporting members 4127', 4128', and the image carrier 4110' are made in one body, and can be rotated.

That is to say, according to this embodiment, the image carrier unit can be manufactured in such a manner that the supporting member 4127' with the shaft 4123', and the supporting member 4128' are merely inserted into the image carrier 4110'. Since the elastic material layer need not be filled as in the above-described photosensitive drum 1 (see FIGS. 1 to 3) of Japanese Patent Publication No. 4-69383, the image carrier unit can be simply manufactured.

It should be noted that since the burr 4111*b*' portion of the image carrier 4110' is supported by the supporting members 4127', 4128', the both end portions are deformed by being expanded, and therefore, the roundness degree at the both end portions is deteriorated. However, since the image carrier 4110' is made as a thinner cylindrical shape having flexibility, the above-described distortion is lowered toward the center portion of the image carrier 4110'. At the central portion other than both end portions, the roundness degree can be maintained without any practical problem. As a result, this central portion may be utilized as the image region.

In other words, even in this image carrier unit of this embodiment, the stable/firm contact condition with the abutment member such as the hardness roller can be obtained, and the image carrier unit can be simply made.

It should also be noted that since the burr 4111*b*' portion and the supporting members 4127' and 4128' are fixed by the adhesive agent, the image carrier 4110' and the supporting members 4127' and 4128' can be further firmly fixed. At this time, when at least the contact portions of the supporting members 4127' and 4128' with respect to the burr 4111*b*' is made of a metal, since the electroconductivity can be established between the image carrier 4110' and the supporting member 4124', the adhesive agent need not have electroconductivity.

Furthermore, since the supporting members 4127' and 4128' have large-diameter portions (flange portions) 4127*b*' and 4128*b*' having the outer diameters larger than those of image carrier 4110', even when the operator puts this image carrier unit on the desk, the image carrier 4110' is not directly put in contact with the desk and therefore is not scratched. Thus, the operability can be further improved.

Moreover, when the abutting member abuts against the image carrier 4110', these large-diameter portions 4127*b*' and 4128*b*' may be used as the interval defining means for defining the interval between the image carrier 4110' and the abutting member. For instance, the interval between the image carrier 4110' and the roller 1231 can be defined by such that the bearing member 1234 of the developing roller 1231 abuts against the large-diameter portions 4127*b*'.

Fourteenth Embodiment

Figure 27:
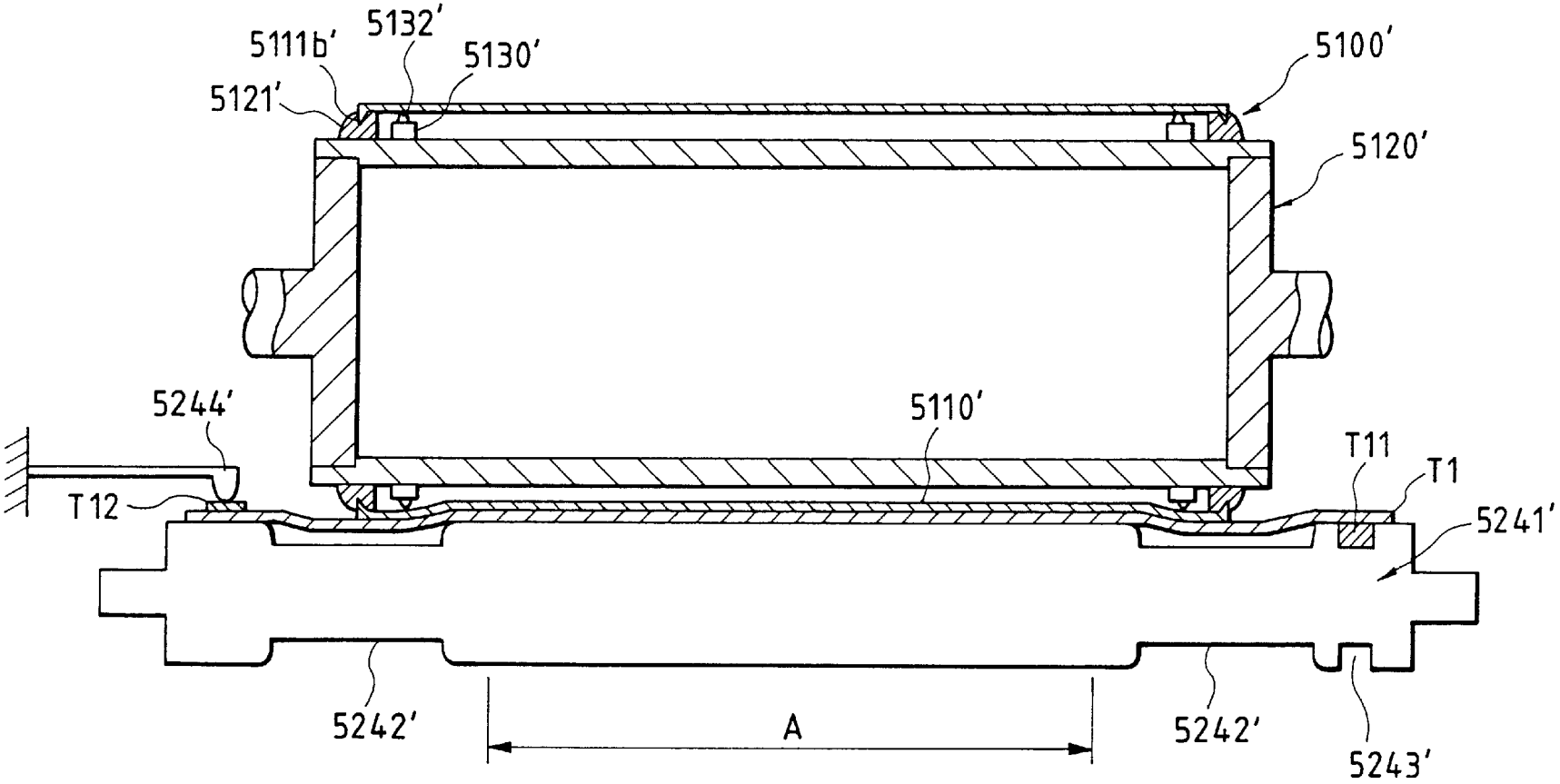
FIG. 27 represents fourteenth embodiment in which an intermediate transfer belt T1 is employed as a transfer medium T in the image forming apparatus shown in FIG. 7, namely a sectional view of this transfer unit.

FIG. 27 represents a fourteen embodiment in which an intermediate transfer belt T1 is employed as a transfer medium T in the image forming apparatus shown in FIG. 7. The fourteenth embodiment includes an image carrier 5100', support members 5120' and a spacer 5130' including an elastic protrusion 5132', similar to the second embodiment.

The intermediate transfer belt T1 is tensioned on a plurality of rollers containing a transfer roller 5241' shown in the drawing, and is driven at the same circumferential speed as that of the image carrier 5110' by a proper drive means. The intermediate transfer belt T1 with a width larger than at least an image region "A" is depressed against the image carrier 5110' by the transfer roller 5241' from a rear side thereof. In this depression portion, the toner on the image carrier 5110' is transferred onto the intermediate transfer belt T1 by the transfer electric field (bias electric field).

Escape grooves 5242' are formed in transfer roller 5241', which may cause the both edge portions (supporting portions) of the image carrier to escape along the radial direction, and may surely depress the intermediate transfer belt T1 against the image carrier 5110' in the image region A.

There is a risk that the intermediate transfer belt T1 is coasted while being rotated. To avoid this coasting, a railshaped bead Tll having a thick body is formed in an integral form on the rear surface of the intermediate transfer belt T1, and a bead guide groove 5243' is formed in the transfer roller 5241', which is engaged with this bead T11 in high precision.

To achieve the first depression condition between the intermediate transfer belt T1 and the image carrier 5110' in the image region A, the bead T11 and bead guide groove 5243' must be provided outside the image carrier 5110' along the axial line direction.

When the intermediate transfer belt T1 is made of a multilayer structure by forming a resistor layer on an insulating resin base body, an electrode portion T12 is provided outside the image region of the intermediate transfer belt T1 in order to produce the above-described transfer electric field. An electroconductor resin into which, for example, carbon and metal powder are dispersed is coated on this electrode portion T12. A fixed brush 5244' is made in contact with this electrode portion T12 to apply a bias voltage.

To achieve the first depression condition between the intermediate transfer belt T1 and the image carrier 5110' in the image region A, this electrode portion T12 must be provided outside the image carrier 5110' along the axial line direction.

If the burr 1111*b* of the image carrier is formed outside thereof, as in the above-explained image forming apparatus of the second embodiment, then there is a risk that the intermediate transfer belt T1 is scratched by the burr 1111*b*. However, according to the image carrier unit of this embodiment, since the burr 5111b' is formed inside the image carrier 5110', and is embedded in adhesive fixing member 5121', there is no risk that the intermediate transfer belt T1 is scratched by the burr 5111*b'*.

Fifteenth embodiment

Figure 28:
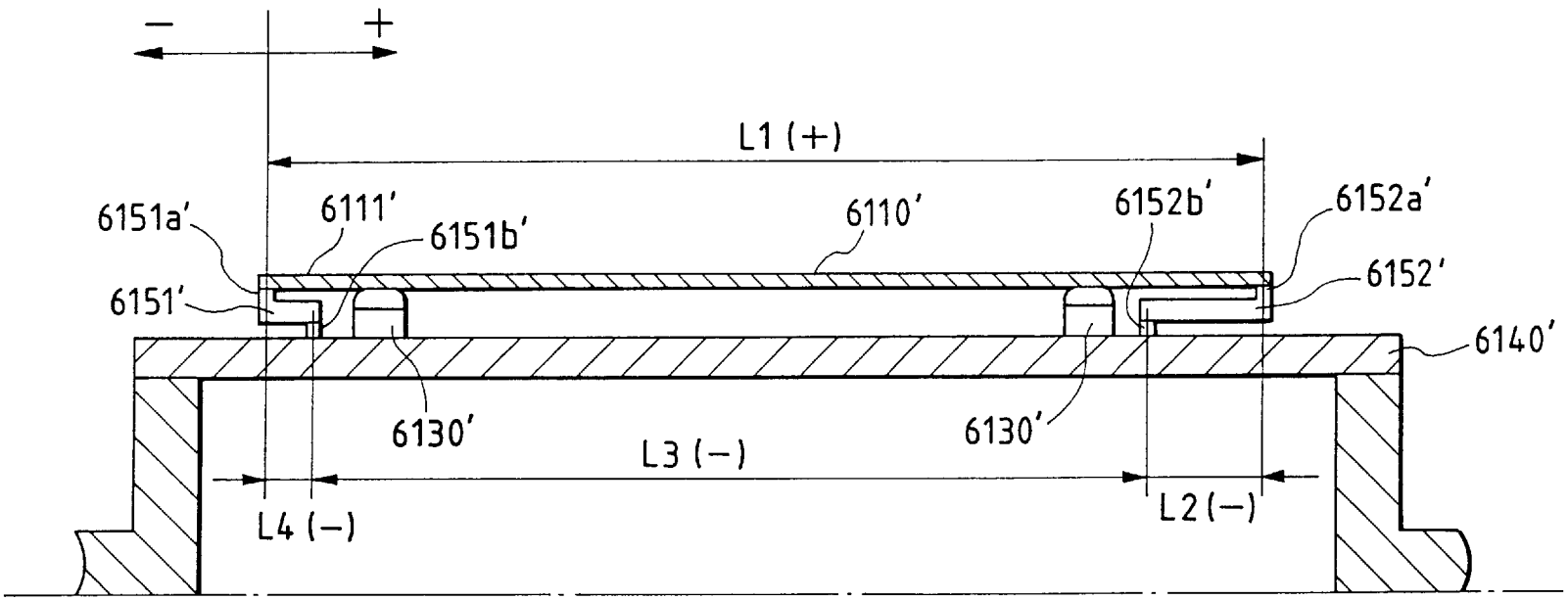
FIG. 28 is a schematic diagram for showing a major portion of an image carrier unit according to a fifteenth embodiment of the present invention, i.e., a view for indicating a section of an upper half portion thereof.

FIG. 28 is a schematic diagram for showing a major portion of an image carrier unit according to a fifteenth embodiment of the present invention, i.e., a view for indicating a section of an upper half portion thereof.

This fifteenth embodiment owns a different point from that of the above-explained second embodiment, namely, a fixing structure of both end portions 6111' of the image carrier 6110', whereas other points thereof are similar to those of the second embodiment, for example, spacer 6130'.

In this fifteenth embodiment, the fixing member 6151' and 6152' for fixing both end portions 6111' of the image carrier 6110' on the cylindrical member 6140' are circularly arranged between the image carrier 6110' and the cylindrical member 6140', and have connecting portions 6151*a'* and 6152*a'* for the image carrier 6110' (bonding portion for adhesive) and connecting portions 6151*b'* and 6152*b'* for the cylindrical member 6140'.

Then, the image carrier unit of this fifteenth embodiment is arranged by that:

while a length between coupling portions of the fixing members and the image carrier along an axial line direction, and a coefficient of linear expansion of the image carrier are "L1" and "α1"; a length between coupling portions of the fixing member and the cylindrical member, and a coefficient of linear expansion of the cylindrical member are "L3" and "α3"; lengths of the fixing member between coupling portions connected to the image carrier and the cylindrical member along an axial line direction are L2, L4, and coefficients of linear expansion of the fixing member are "α2", "α4";

assuming now that Young's modulus of the image carrier is "E1", and allowable stress is "δ"; the following formula is satisfied:

$$\sigma a > El \times \sum_{i=1}^{n} Li \times (1 + \alpha i \cdot \Delta T) / Ll$$

Li: length of i-th member
αi: i-th linear expansion coefficient
ΔT: temperature difference
n: total number (n=4) of coupled members
i: orders of coupled members (i=1 to n)

It should be noted that a concrete example is described in the below-mentioned embodiment.

First, definitions about the above-described formula will now be described with reference to FIG. 29 (*a*).

Figure 29A:
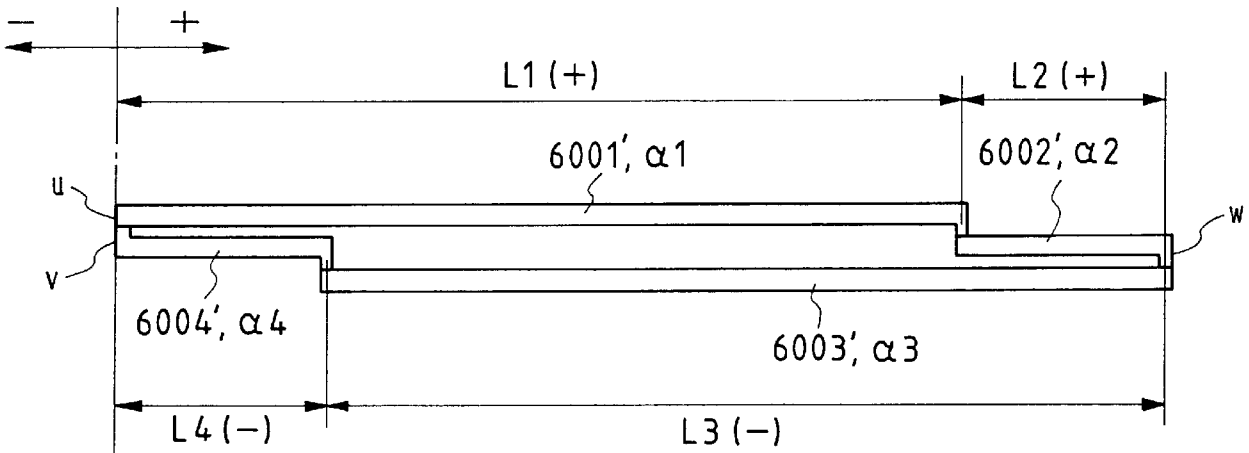
FIG. 29 (*a*) and FIG. 29 (*b*) are explanatory diagrams for explaining thermal expansion occurred in a structure where members having different lengths and the different thermal expansion coefficients are coupled to each other.
Figure 29B:
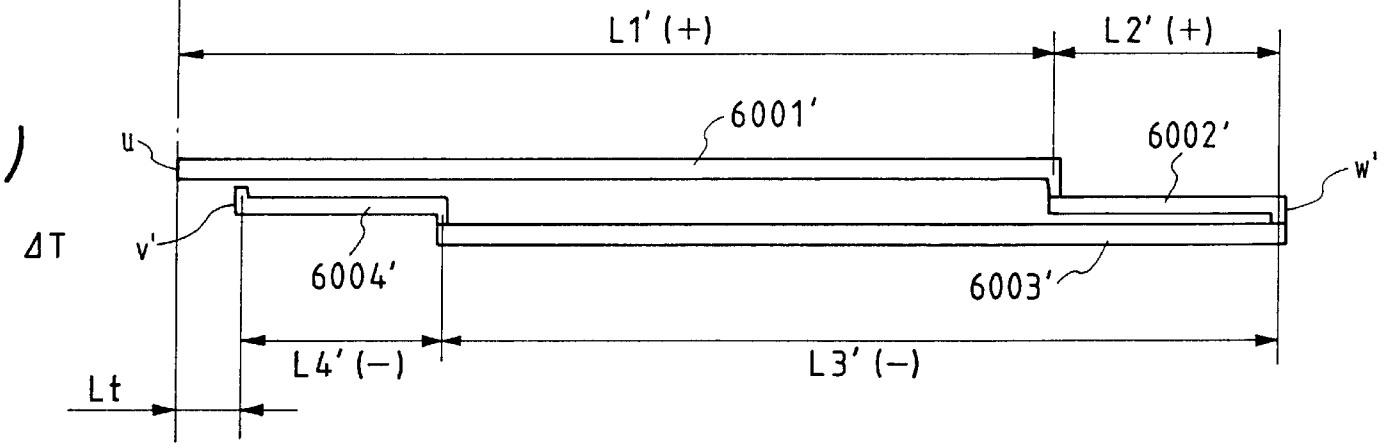

FIG. 29(*a*) and FIG. 29(*b*) are explanatory diagrams for explaining thermal expansion occurred in structures such that members are coupled to each other, whose lengths and thermal expansion coefficients are different from each other.

In FIG. 29, members 1, 2, 3, and 4 are defined as follows: The lengths thereof are L1, L2, L3, and L4. The thermal expansion coefficients are α1, α2, α3, and α4.

It should be understood that the lengths of this case are equal to the lengths among the coupling portions (junction portions) of the members.

Considering now the thermal expansion, positive/negative symbols of the lengths are defined as follows:

First, a certain coupling point of coupled structure is set as a starting point and an end point. In FIG. 29 (*a*), while a coupling point "u" of the member 1 at the leftmost coupling point is set as a starting point, another coupling point "v" on the side of the member 4 is set as an end point.

Next, a coupling point furthest separated from the starting point "u" is determined. In FIG. 29 (*a*), a point "W" located at the rightmost point corresponds to the coupling point furthest separated from the starting point "u".

Then, considering now such a clockwise closed loop defined from the starting point "u" via the point "w" to the end point "v", a direction from the starting point "u" to the point "w" is defined as "positive" (right direction in FIG. 29), whereas another direction from the point "w" to the end point "v" is defined as "negative" (left direction in FIG. 29).

In other words, while sequentially tracing the coupling points from the starting point "u", a decision is made of "positive/negative" based upon a direction along which the subsequent coupling point with respect to a certain coupling point is present (namely, direction from a certain coupling point to the next coupling point).

As a consequence, the "positive/negative" lengths of the members 1, 2, 3 and 4 are L1 and L2 being "+", i.e., L1 (+) and L2 (+), whereas L3 and L4 are "−", i.e., L3 (−) and L4 (−).

Referring now to FIG. 29(*b*), the implication of the above-described formula will be explained.

It is now assumed that the environmental temperature surrounding the structure is changed from a time instant when the point "u" is coupled with the point "v" (namely, at a time instant when a structure is formed), and thus a temperature difference "ΔT" ("+ΔT" is defined when temperature is increased, whereas "−ΔT" is defined when temperature is decreased) is produced. In this case, if the point "u" is not coupled to the point "v", then lengths L1', L2', L3', L4' of the respective members 1, 2, 3, 4 expanded/compressed in response to the temperature change are given as follows:

$$L1'=L1\times(1+\alpha1\times\Delta T)$$

$$L2'=L2\times(1+\alpha2\times\Delta T)$$

$$L3'=L3\times(1+\alpha3\times\Delta T)$$

$$L4'=L4\times(1+\alpha4\times\Delta T)$$

Assuming now that a summation of these lengths is not equal to "O", as indicated in FIG. 29(*b*), the point "u" is shifted from the point "v", and a shift amount "Lt" is defined as follows:

$$Lt=(L1'+L2')-(L3'+L4')$$

It should be understood that if the value of Lt is positive, as indicated in FIG. 29 (*b*), then the point "v" is shifted from the point "u" on the positive side (right side), whereas if the value of Lt is negative, then the point "v" is shifted from the point "u" on the negative side (left side). It should also be noted that the point "w" also shifts from point "u" but such is taken into account in the amount "Lt".

However, actually, since the point "u" is coupled to the point "v", the above-described shift is not produced. Accordingly, either the thermal distortion or the thermal stress will occur in the structure.

This thermal distortion, or thermal stress is exerted with respect to the weakest member existing in the structure. If the thermal stress exceeding its allowable stress of the member is produced, this member is destroyed, or permanently deformed.

In this embodiment, since the thinner cylindrical image carrier 6110' having the flexibility corresponds to the weakest member, the thermal stress will be exerted to the image carrier 6110' when the temperature is changed.

However, as previously explained, in this embodiment, the image carrier unit is arranged by that while a length between coupling portions with the fixing member in the image carrier along an axial line direction, and a coefficient of linear expansion thereof are "L1" and "α1"; a length between coupling portions with the fixing member in the image carrier, and a coefficient of linear expansion thereof are "L3" and "α3"; lengths of the fixing member between coupling portions with respect to the image carrier and the cylindrical member along an axial line direction are L2, L4, and coefficients of linear expansion are "α2", "α4";

assuming now that Young's modulus of the image carrier is "E1", and allowable stress is "δa"; the following formula is satisfied:

$$\sigma a > El\times\sum_{i=1}^{n} Li\times(1+\alpha i\cdot\Delta T)/Ll$$

As a consequence, even when the temperatures are changed in the use environment and the transport environment, and thus the thermal distortion is produced inside the image carrier unit along the axial line direction, this produced thermal stress becomes lower than, or equal to the allowable stress.

As a result, the large distortion/permanent deformation of the thinner cylindrical image carrier 6110' are prevented, and the occurrence of the vibrations is also avoided. Therefore, the intervals among the respective process members such as the developing roller are not varied by the temperature environment, and the stable/firm contact condition, or the gap management can be realized. It is therefore possible to obtain better images without any charging fluctuation, developing failure, and transferring failure.

There is no risk that the image carrier 6110' is bent, cut, or permanently deformed due to the thermal distortion. Also, there is no risk that the fixing portions of the constructive component are destroyed by receiving the thermal stress. As a result, the mechanical reliability is increased.

It should also be noted that as "δa" contained in the above-described formula, when the permanent deformation constitutes the major matter, either a proportional limit or an endurance limit (0.2% endurance limit etc.) is employed. When destruction constitutes the major matter, a tension strength is employed.

For the sake of confirmation, the corresponding relationship among the members shown in FIG. 28 (present embodiment) and the respective members shown in FIG. 29 is clarified as follows:

The image carrier 6110' corresponds to the member 6001' of FIGS. 29 (*a*) and (*b*);

The fixing member 6152' corresponds to the member 6002' of FIG. 29 (*a*) and (*b*);

The cylindrical member 6140' corresponds to the member 6003' of FIG. 29 (*a*) and (*b*);

The fixing member 6151' corresponds to the member 6004' of FIG. 29 (*a*) and (*b*);

The coupling portion 6151*a*' corresponds to the point "u" and "v" of FIG. 29 (*a*) and (*b*); and The coupling portion 6152*a* corresponds to the point "w" of FIGS. 29 (*a*) and (*b*).

The image forming device thus structured obtains the operation and effects stated below, with reference to FIGS. 10–13.

(a) Since the image carrier 1110 is structured such that it is in the form of a flexible thin cylinder, and both ends 1111 of the image carrier are supported by a pair of support members, the central portion of the image carrier 1110 which is not supported by the support members is deformable inwardly.

Therefore, because the central portion of the image carrier 1110 can be used as a so-called artificial soft material, even though the charging means or the like which is abutted against the central portion is formed of a hard roller, a firm and stable contact state can be obtained, and an image can be surely formed or carried on the image carrier 1110.

The above operation and effects will be described in more detail with reference to FIGS. 10 to 13.

Figure 10:
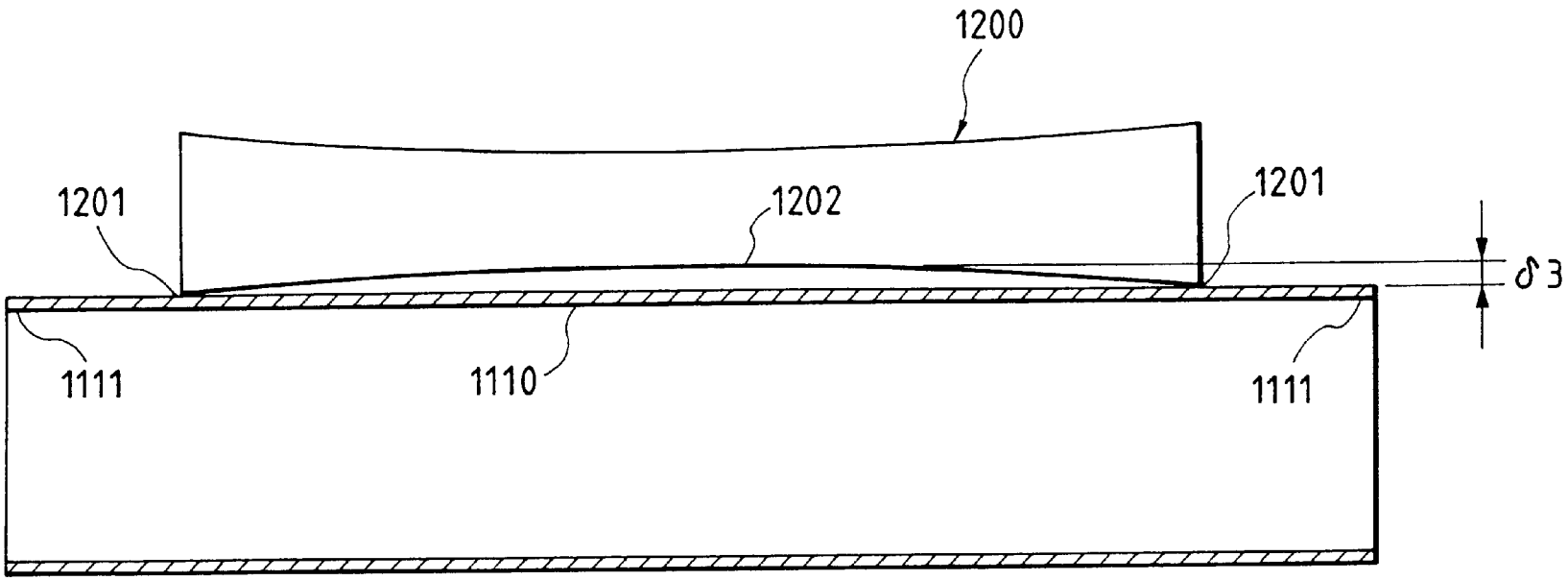
FIGS. 10 to 13 are explanatory diagrams showing the operation of the second embodiment of the present invention.

FIG. 10 shows a state in which a soft roller 1200 is softly abutted against the image carrier 1110. It should be noted that for facilitation of description, a roller 1200 of an inverse crown shape is used as an example of a hard roller which is not completely columnar.

The image carrier 1110 is supported at both ends 1111 thereof by the above-described paired support members, but those paired support members are not shown for the prevention of complicated drawing.

As shown in FIG. 10, in the case where the hard roller 1200 is merely softly abutted against the image carrier, only both the ends 1201 thereof are simply in contact with the image carrier 1110, and its central portion 1202 is not in contact with the image carrier 1110. Hence, in such a state, an excellent charging state, developing state, transfer state and so on are not obtained.

Figure 11:
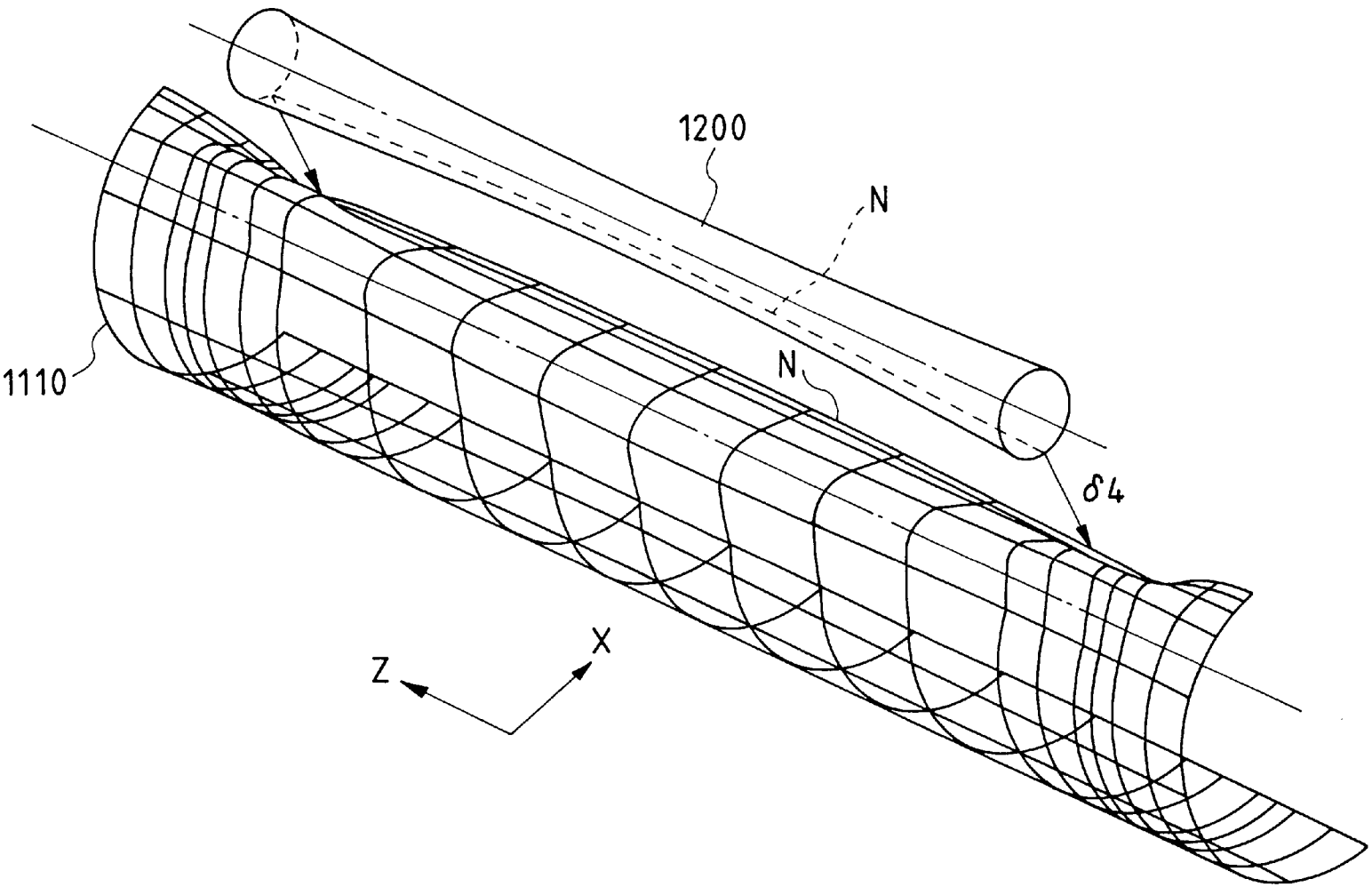

FIG. 11 is a perspective view showing a wire frame in the case where the state of deformation of the image carrier 1110 when the hard roller 1200 is further pressed toward the image carrier 1110 from a state shown in FIG. 10 by a quantity δ4 larger than a crown quantity δ3 (refer to FIG. 10) of the hard roller is analyzed through the finite element method, and the amount of deformation of the image carrier is made 50 magnifications. Since the image carrier 1110 is deformed symmetrically with respect to its axis, only a half of the wire frame is shown for prevention of a complicated drawing.

Figure 12:
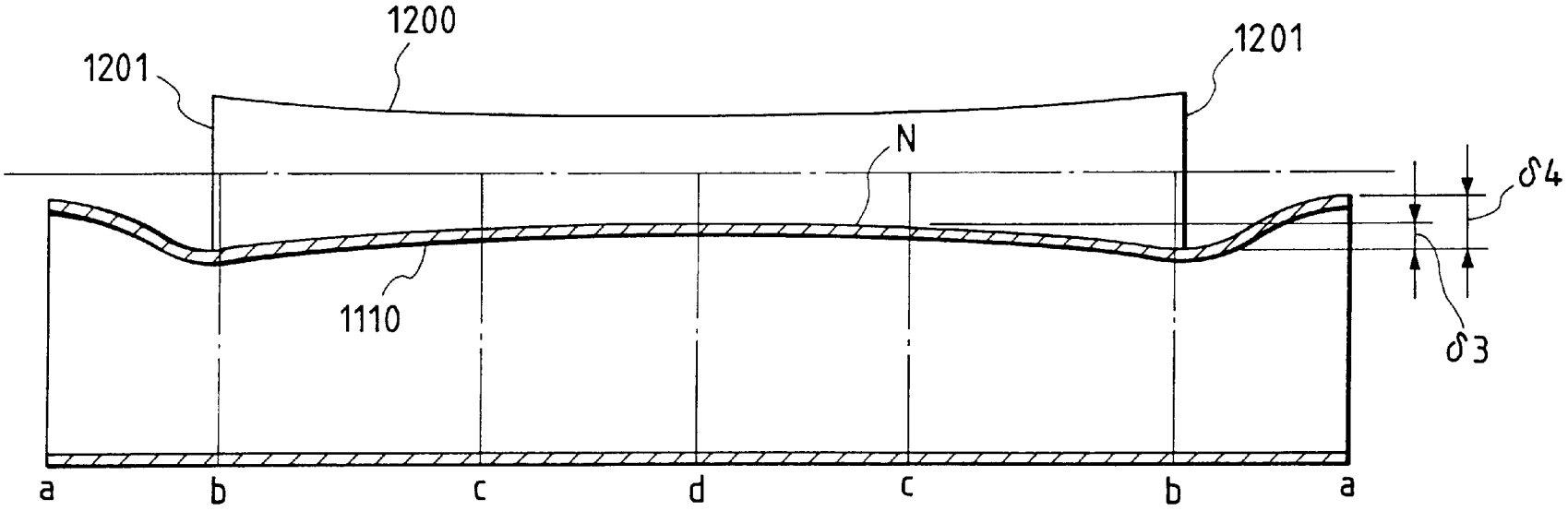
Figure 13:
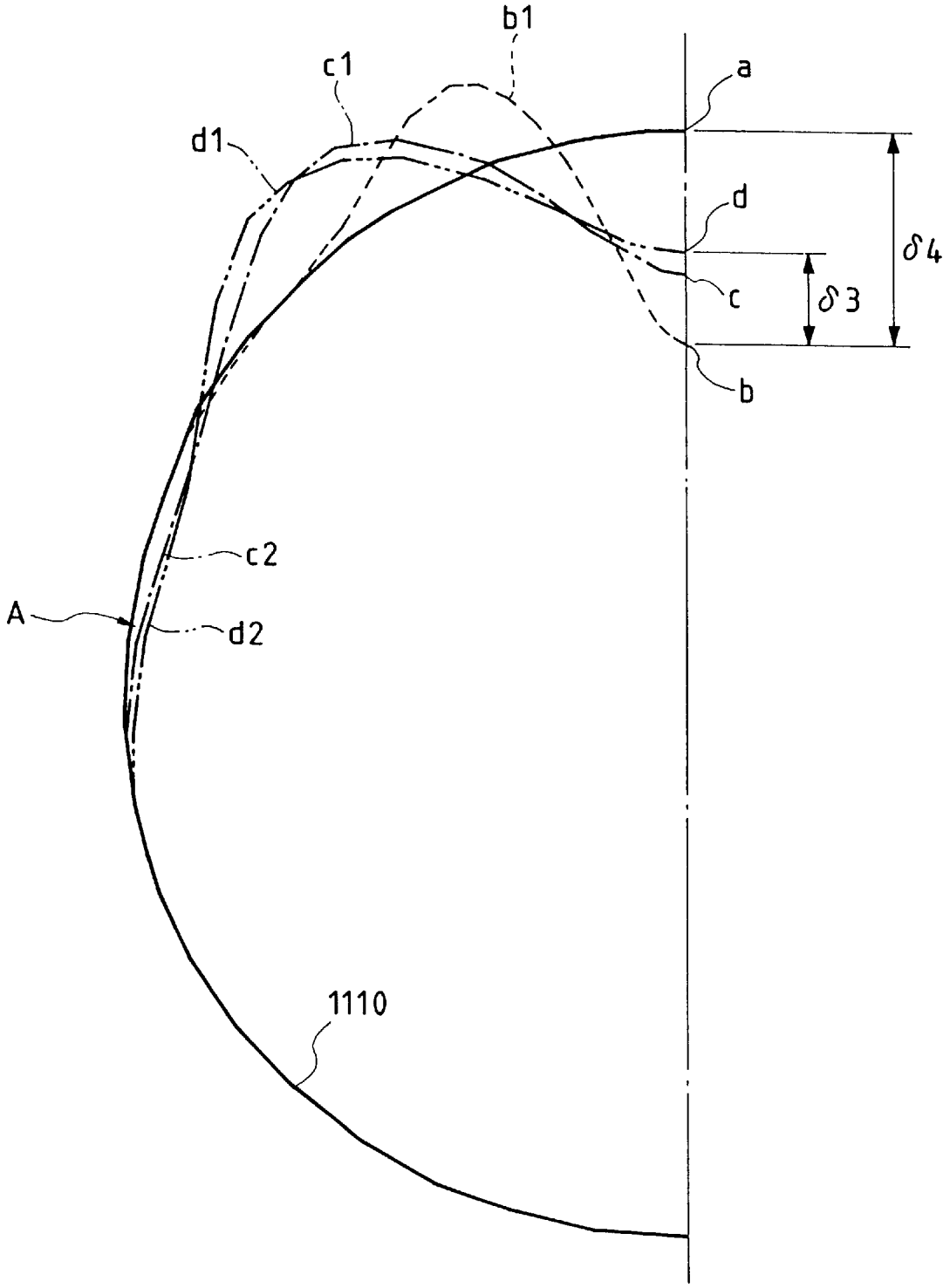

FIG. 12 is a diagram viewed from a direction indicated by an arrow X in FIG. 11. FIG. 13 is a diagram showing the outer peripheral surfaces of the image carrier 110 in a cross section a, a cross section b, a cross section c and a cross section d of FIG. 12 are superimposed on each other viewed from a direction indicated by an arrow z in FIG. 11. In the figure, a solid line represents the outer peripheral surface of the image carrier 1110 in the cross section a; a dotted line b is the outer peripheral surface of the image carrier 1110 in the cross section b; an alternate long and short dash line c is the outer peripheral surface of the image carrier 1110 in the cross section c; and an alternate long and two-short dashes line d is the outer peripheral surface of the image carrier 1110 in the cross section d, respectively.

As is apparent from FIGS. 11 to 13, when the hard roller 1200 of the crown quantity δ3 is pressed toward the image carrier 1110 by a quantity δ4 larger than the crown quantity δ3, the image carrier 1110 is deformed faithfully along the shape of the hard roller 1200 on its pressed portion (a so-called nip portion) N so that it is in firm contact with the hard roller 1200 over all the area of the nip portion N.

This is a function caused by the image carrier 1110 being in the form of a flexible thin cylinder. The thin cylindrical image carrier 1110 is very flexible in a plane direction orthogonal to the axial direction, and changes its shape of deformation continuously axially in such a manner that the image carrier 1110 follows the surface of the hard roller of the inverse crown shape. Similarly, the thin cylindrical image carrier 1110 is very finely deformed axially with the limits of the elasticity of metal. However, the rigidity of the thin cylindrical image carrier 1110 in the axial direction is very high in comparison with the rigidity thereof in a cross-sectional direction orthogonal to the axial direction so that it does not contribute to the flexibility so much. Therefore, the deformation of the image carrier very greatly depends on the flexibility of the thin cylindrical image carrier in the cross-sectional direction orthogonal to the axis. This is a deformation mode inherent to the thin cylinder, and the image carrier is deformed using such deformation, thereby being capable of ensuring a stable contact while following the irregularity of the hard roller.

Referring to FIGS. 12 and 13, the state of deformation of the image carrier will be described in more detail. On a portion a of FIG. 12, where both end portions of the image carrier are supported by the support member, as indicated by a solid line a in FIG. 13, the image carrier 1110 is basically held in a circular state.

On a portion b (immediately close to end portions of the roller 1200), as shown in a dotted line b in FIG. 13, the image carrier is deformed inwardly by δ4 which is the largest amount of deformation, but on a point b1 close to the point b (nip portion) circumferentially, the image carrier is deformed such that it is swelled greatly outwardly.

On a portion d which is the central portion of the roller 1200, the image carrier is deformed δ4−δ3, but on a point d1 close to the point d circumferentially, the image carrier is deformed such that it is swelled outwardly.

Reversely, on a point d2 slightly apart from the point d1, the image carrier is deformed such that it is slightly inwardly depressed.

On a portion extending from the portion b to the portion d, the state of deformation on the portion b is continuously changed to the state of deformation on the portion d. As one example, the state of deformation on the portion c is indicated by an alternate long and short dash line c. The image carrier on a point c1 is swelled in the vicinity of the point b1 rather than the point d1, and the amount of depression on the point c2 is smaller than that on the point d2.

As is apparent from the above, the image carrier 1110 which is in the form of a thin cylinder is very flexible in a plane direction orthogonal to the axial direction, and changes its shape of deformation continuously axially in such a manner that the image carrier 1110 follows the surface of the hard roller of the inverse crown shape.

In the above description, for facilitation of description, the roller 1200 of the inverse crown shape is used as an example of the hard roller which is not completely columnar for description. However, a roller having a slight irregularity is equivalent to a structure in which a plurality of inverse-crown shaped rollers are made continuous, and a roller which is slightly tapered is equivalent to a part of the roller of the inverse crown shape (or crown shape). Therefore, the image carrier 1110 is in contact with the hard roller which is not completely columnar (a roller having the irregularity or a taper with the limits of a manufacturing error) in an excellent, firm and stable state.

In the image forming apparatus according to this embodiment, since the charging means 1210 and the transfer means 1240 are formed of a hard roller which is in contact with the image carrier 1110 so that the image carrier 1110 is bent inwardly until the inner peripheral surface 1113 of the image carrier 1110 is abutted against the outer peripheral surface 1145 of the cylindrical member 1140, the image carrier 1110 and those hard rollers 1210, 1240 can be brought in contact with each other on the charging position and the transfer position in a firm and stable state. As a result, the image carrier 1110 can be surely charged, or an image can be surely transferred.

When the hard roller is in contact with the image carrier 1110 so that the image carrier 1110 is bent inwardly until the inner peripheral surface 1113 of the image carrier 1110 is abutted against the outer peripheral surface 1145 of the cylindrical member 140, the image carrier 1110 comes to a state in which it is held between the hard roller and the cylindrical member 1140. In this state, the image carrier 1110 is in contact with the hard roller in a firm and stable state under an appropriate pressure contact force.

(B) Since the charging roller 1210 and the transfer roller 1240, which are hard rollers, rotate at the peripheral velocity identical with the peripheral velocity of the image carrier 1110, no difference in relative velocity occurs between the image carrier 1110 and the respective rollers 1210, 1240 on the contact portions of the charging roller 1210 and the transfer roller 1240 with the image carrier 1110, that is, on the 15 charging position and the transfer position. Hence, since no friction occurs on the contact portion, and no vibrating movement caused by the friction also occurs, a stable contact rotation can be obtained, and also stable charging operation and transfer operation can be obtained.

Also, the damage on the image carrier caused by the above vibrating movement is difficult to generate, thereby improving in the reliability.

When the rotating velocity of the developing roller 1231 is different from the peripheral velocity of the image carrier 1110, the image carrier 1110 receives a frictional force from the developing roller 1231 on the contact portion of the image carrier 1110 with the developing roller 1231.

However, since the both the members are abutted against each other to the extent that an interval S1 is defined between the inner peripheral surface 1113 of the image carrier 1110 and the outer peripheral surface 1145 of the cylindrical member 1140, the abutting force of the developing roller against the image carrier 1110 is small. For that reason, the frictional force between both the members is also small with the results that the developing roller 1231 and the image carrier 1110 rotate while they are in contact with each other in a relatively stable state.

Since the developing roller 1231 is made in contact with the image carrier 1110 in such a manner that this developing roller 1231 flexes the image carrier 1110 inwardly within such a range that the inner circumferential surface 1113 of the image carrier 1110 does not abut against the outer circumferential surface 1145 of the cylindrical member 1140, this developing roller 1231 can be made in contact with the image carrier 1110 under firm and stable conditions. Thus, the image can be firmly formed on the image carrier 1110, or the image can be surely carried on the image carrier 1110.

In general, when toner is applied to a latent image formed on an image carrier to develop this latent image, a circumferential speed of a developing roller is set to be higher than that of the image carrier in order to firmly apply the toner.

Under such a circumstance, if the developing roller 1231 abuts against the image carrier 1110 until the inner circumferential surface 1113 of the image carrier 1110 abuts against the outer circumferential surface of the cylindrical member 1140, then the image carrier 1110 will cause heavy vibration behavior at the abutting point. Accordingly, there are risks that not only the images are deteriorated, but also the image carrier 1110 is destroyed.

To the contrary, according to this embodiment, the developing roller 1231 is made in contact with the image carrier 1110 in such a manner that this developing roller 1231 flexes the image carrier 1110 inwardly within such a range that the inner circumferential surface 1113 of the image carrier 1110 does not abut against the outer circumferential surface 1145 of the cylindrical member 1140, so that this contact force is small. As a consequence, friction force exerted between both members becomes small. Therefore, even when the circumferential speed of the developing roller 1231 is made faster than that of the image carrier 1110, the vibration behavior caused by the variations of the above-described friction force, and thus the developing roller 1231 is made in contact with the image carrier 1110 under relatively stable condition, which are rotated.

Moreover, since the interval defining members 1234 are provided on both end portions of the shaft 1233 of the developing roller 1231, the developing roller 1231 can abut against the image carrier 1111 under more stable condition while the deformation amount of the image carrier 1110 caused by the abutment by this roller 1231 is maintained constant. The interval defining members 1234 may define the interval between the shaft line of the roller 1231 and the axial line of the image carrier 1110, and directly abut against the outer circumferential surface 1145 of the projection portion toward both sides of the image carrier 1110 in the cylindrical member 1140. As a result, it is possible to form the image more stably.

In other words, since the interval defining members 1234 are provided at both end portions of the shaft 1233 of the roller 1231 and directly abut against the outer circumferential surface 1145 of the cylindrical member 1140, the accumulated tolerance between the roller 1231 and the cylindrical member 1140 can be reduced. As a consequence, the image carrier 1110 can be flexed under sable condition. As a result, the positional precision of the image can be improved, and in particular, the precision in the color overlapping process in the color image can be improved. Thus, it is possible to produce the image having the high resolution and uniform qualities without the color fluctuations and also concentration fluctuations.

Also, this photoreceptor unit 1100 may be arranged by that the cylindrical member 1140 is arranged inside the image carrier 1110, and thus the both end portions 1111 of the image carrier 1110 are supported by one pair of supporting members 1120. Since there is no need to fill therein the elastic material layer as in the photosensitive drum 1 (see FIG. 1 to FIG. 3) of the above-described Japanese patent Publication No. 4-69383, it is possible to simply manufacture the image carrier unit.

This photoreceptor unit 1100 can be manufactured with the supporting member 1120 arranged inside the image carrier 1110, and the both end portions 1111 of the image carrier 1110 and the supporting member 1120 are fixed by using the adhesive fixing member 1121 functioning as the fixing means. Since the elastic material layer is no longer filled as in the photosensitive drum 1 (see FIGS. 1 to 3) as described in the above-mentioned Japanese Patent Publication No. 4-69383, this photoreceptor unit 1100 can be manufactured in a simple manner.

In the image carrier unit 5110, since the burrs 5111*b* are formed on the both edges of this image carrier 5110, and the both end portions 5111 of the image carrier 5110 and the cylindrical member 5140 are adhered to each other by the adhesive agent 5121 while using this burr 5111*b* as the adhesive base, the adhesive area is increased. As a result, since the adhesive strength is increased, the durability and the reliability are improved.

(c) Since the image carrier 1110 is structured such that the cylindrical member 1140 is disposed inside of the image carrier 1110, and both ends of the image carrier 1110 are supported by a pair of support members 1120, it is unnecessary that the elastic material layer fills as in the photosensitive drum 1 disposed in the above-mentioned Japanese Patent Examined Publication No. Hei 4-69383 (refer to FIGS. 1 to 3), thereby being capable of simply manufacturing the image forming apparatus.

The charging means 1210 and the transferring means 1240 are rotated at the same circumferential speed as that of the image carrier 1110, and also are constituted by the hardness rollers which are made in contact with the image carrier 1110, and flex the image carrier member 1110 inwardly until the inner circumferential surface 1113 of the image carrier 1110 abuts against the outer circumferential surface 1145 of the cylindrical member 1140. As a consequence, at the charging position and the transferring position, the image carrier 1110 can be firmly made in contact with these hardness rollers 1210 and 1240 under stable condition, so that the image carrier member 1110 can be firmly charged, or the image can be firmly transferred.

When the hardness rollers flex the image carrier 1110 inwardly until these rollers are made in contact with the image carrier 1110 and the inner circumferential surface 1113 abuts against the outer circumferential surface 1145 of the cylindrical member 1140, the image carrier 1110 is brought into such a sandwiching condition established between the hardness rollers and the cylindrical member 1140. Under such a sandwiching condition, as previously explained, if the circumferential speeds of the hardness rollers are different from the circumferential speed of the image carrier, then the vibration behavior will occur, resulting in the difficulty. In this embodiment, since the circumferential speeds of both members are equal to each other, no vibration behavior can occur. Since the image carrier 1110 is brought into the sandwiching condition established between the hardness rollers and the cylindrical member 1140, the image carrier 1110 is made in contact with the hardness rollers under proper friction force and also under stable and firm states. As a result, the image carrier 1110 can be surely charged, or the image can be surely transferred. In other words, the stable charging operation and the stable transferring operation can be achieved.

Figure 4:
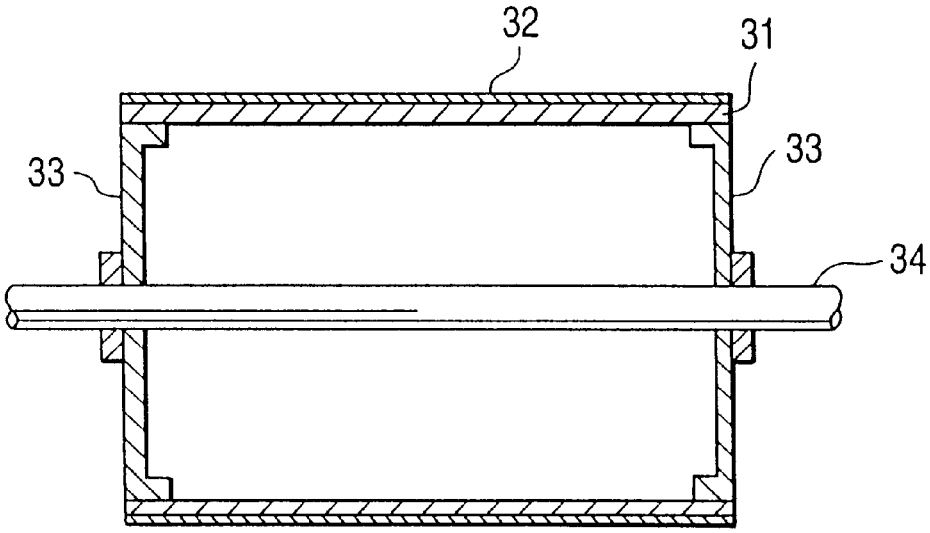
FIG. 4 PRIOR ART
FIG. 4 is an explanatory diagram showing another conventional apparatus.

Moreover, the supporting member 1120 includes the spacer 1130 having the elastic portion for elastically and uniformly supporting the image carrier 1110 from an inside thereof; and the fixing member 1121 for fixing the image carrier 1110 supported by this spacer 1130 and the cylindrical member 1140. Accordingly, this image carrier unit can be easily manufactured, as compared with the drum-like image carrier member (FIG. 4) of Unexamined Japanese Patent Application No. 58-86550. Also, the image carrier 1110 supported by the spacer 1130 is fixed by the fixing member 1121 under such a condition that the intervals "S" with respect to the cylindrical member 1140 are made equal to each other, namely substantially roundness condition. As a consequence, it is possible to obtain such a stable rotation condition that the deviation and the vibrations of the image carrier 1110 are very low.

Since the photoreceptor unit 1100 is arranged by any one of the above-described items (1) and (2), even when the temperatures are changed in the use environment and the transport environment, the thermal distortion caused by the temperature expansion difference will not occur inside the image carrier unit. Even when the thermal distortion will occur, this distortion is very low.

As a result, the distortion/deformation of the thinner cylindrical image carrier 1110 are prevented, and the occurrence of the vibrations is also avoided. Therefore, the intervals among the respective process members such as the developing roller 1231 are not varied by the temperature environment, and the stable/firm contact condition, or the gap management can be realized. It is therefore possible to obtain better images without any charging fluctuation, developing failure, and transferring failure.

There is no risk that the image carrier 1110 is bent, cut, or permanently deformed due to the thermal distortion. Also, there is no risk that the fixing portions of the constructive component are destroyed by receiving the thermal stress. As a result, the mechanical reliability is increased.

(d) Further, the rigid cylindrical member 1140 is disposed inside of the image carrier 1110 so that the outer peripheral surface 1145 of the cylindrical member 1140 and the inner peripheral surface 1113 of the image carrier 1110 are apart from each other at an interval smaller than the allowable deformation $\delta 2$ of the image carrier 1110. With this structure, for example, even though an operator erroneously strongly presses the central portion 1114 of the image carrier 1110 during an exchange work of the image carrier 1110, etc., the image carrier 1110 is supported by the cylindrical member 1140 before the image carrier 1110 is damaged, with the result that the image carrier 1110 is not damaged. Therefore, the image forming apparatus is excellent in handling in comparison with the drum-shaped image carrier member disclosed in the above-mentioned Japanese Patent Unexamined Publication No. Sho 58-86550 (refer to FIG. 4).

(e) Since the charging means 1210, the developing means 1231 and the transfer means 1240 are formed of the hard rollers, the apparatus can be reduced in price. In comparison with the charging means is formed of the charging charger 7, and the transfer means is formed of the transfer charger 13 as in the conventional art shown in FIG. 1, those means are formed of metal rollers, thereby being capable of reducing the price.

Also, since the image carrier 1110 is cylindrical, the apparatus can be downsized in comparison with the structure in which the belt is supported by two rollers as in the conventional art.

Further, even when the image carrier 1110 is strongly depressed, since this image carrier 1110 is not destroyed, the abutting member such as the hardness rollers and the cleaning blade can abut against the image carrier 1110.

(e). Since this image carrier unit 1100 is equipped with the spacer 1130 interposed between the image carrier 1110 and the supporting member 1120 and having the elastic portion 1132 for elastically and equally supporting the image carrier 1110 inwardly, this image can be more simply manufactured.

As explained more in detail, it is also possible to manufacture an image carrier unit not equipped with the spacer 1130. For instance, the image carrier unit may be manufactured by that, for example, while the cylindrical member 1120 and the image carrier 1110 are properly held in the coaxial manner by a jig and the like, the adhesive fixing member 1121 is injected into the space between the end portions 1111 of the image carrier 1110 and the cylindrical member 1120. However, in this case, the relatively cumbersome work is required to hold the cylindrical member 1120 and the image carrier 1110 in the coaxial manner by properly using the jig.

To the contrary, in accordance with the image carrier unit 1100 according to this embodiment, the image carrier unit is equipped with a spacer interposed between the image carrier 1110 and the supporting member 1120 and having an elastic portion 1132 for elastically and uniformly supporting said image carrier 1110 inwardly. Accordingly, when the image carrier 1110 is mounted on the cylindrical member 1120, this image carrier 1110 is held on the supporting member 1120 in the coaxial manner (see FIG. 8*c*). At this time, since the burrs 1111*b*, are formed on the outer circumferential surface of the thinner cylindrical member for constructing the image carrier 1110, the image carrier 1110 can be uniformly supported without being adversely influenced by the burrs 1111*b*.

As a consequence, according to the image carrier unit 1100, no specific tool, i.e., jig is required. The image carrier 1110 is mounted on the supporting member 1120 and the end portion 111 of the image carrier 1110 and the supporting member 1120 are fixed by using the adhesive agent, so that the image carrier unit 1100 can be more simply manufactured.

Moreover, the image carrier 1110 supported by the spacer 130 is fixed by the adhesive fixing member 1121 under such a condition that the interval "S" becomes the equiinterval, namely under roundness state along the circumferential direction with respect to the cylindrical member 1140. Therefore, it is possible to obtain such a stable rotation condition that the deviation of the image carrier 1110 and the vibrations thereof along the axial line direction are very small.

(f) The cleaning blade 1251 is in contact with and presses the image carrier 1110 until the inner peripheral surface 1113 of the image carrier 1110 is abutted against the outer peripheral surface 1145 of the cylindrical member 1140 so that it removes the toners on the outer peripheral surface of the image carrier 1110. As a result, the image carrier 1110 can be more surely cleaned by a relatively large abutting force.

When the cylindrical member 1140 is arranged inside the image carrier 1110, the spacer 1130 is compressed by the cylindrical member 1140 and the image carrier 1110 to thereby elastically support the image carrier 1110. Therefore, the image carrier unit can be more simply manufactured by previously mounting this spacer 1130 on either the cylindrical member 1140 or, the image carrier 1110.

Since the spacer 1130 is so positioned slightly at the center side from the edge portion lilla of the image carrier 1111, consequently, the image carrier 1110 is more uniformly supported with respect to the cylindrical member 1140, so that the vibration precision can be further improved.

Precisely speaking, for example, when the base member of the image carrier 1110 is constructed by way of the electroforming method and is cut out, the burr 1111*b* may be produced in the edge portions 1111*a* thereof. If the edge portions 1111*a* of the image carrier 1110 are supported by the spacer 1130 without eliminating the burr 1111*b* and the like, then there is a risk that the intervals "S" of the image carrier 1110 with respect to the cylindrical member 1140 becomes unequal, which is caused by the adverse influences of the burr 1111*b* and the like. On the other hand, when the burr 1111*b* and the like are removed, there are problems that distortion is newly applied to the cylindrical image carrier 1110 made of the thin body, the deformation is increased, but also a large number of manufacturing stages are required.

To the contrary, in accordance with the image carrier unit according to this embodiment, the spacer 1130 is located slightly at the center side from the edge portion 1111*a* of the image carrier 1110. Accordingly, even when the burr 1111*b* is produced on the image carrier 1110, the image carrier 1110 can be uniformly supported with respect to the cylindrical member 1140 without being adversely influenced. Then, the vibration precision can be further improved. Moreover, as previously, the burr 1111*b* can be utilized as the adhesive base.

(g) Since the charging means 1210, the developing means 1231 and the transfer means 1240 are formed of not soft rubber rollers, but rollers made of a hard metal or synthetic resin, the following operation and effects can be obtained.

The spacer 1130 elastically supports said image carrier 1110 in such a manner that an inside of said image carrier 1110 is supported at plural portions thereof in an equiinterval along a circumferential direction. Accordingly, the elastic force made by the spacer 1130 is distributed under better conditions over the circumferential direction of the image carrier 1110, so that the image carrier 1110 can be more uniformly supported with respect to the cylindrical member 1140.

(h) Since the cylindrical member 1140 and the supporting member 1120 have electroconductivity, the electroconductivity required to form the image with respect to the image carrier 1110 can be obtained by way of these cylindrical member 1140 and supporting members 1120. As a consequence, there is no need to separately employ the conducting means.

Since the supporting member 1120 and the adhesive fixing member 1121 have the electroconductivity, the electroconductivity required to form the image with respect to the image carrier can be obtained via these supporting member 1120 and adhesive fixing member 1121. As a result, no separate conducting means is employed.

(i) Since the supporting member 1120 is positioned slightly near center side, rather than an edge portion 1111*a* of the image carrier 1110, the image carrier 1110 can be more uniformly supported with respect to the cylindrical member 1140, higher vibration precision can be achieved.

In this image carrier unit 1100, since the burrs 1111*b* are formed on the outer circumferential surface of the thinner cylindrical member when the member 1110A (see FIG. 8*b*) whose length is longer than that of the thinner cylindrical member is cut out to obtain this thinner cylindrical member for constituting this image carrier 1110 is supported inwardly by the supporting member 1120, these burrs 1111*b* do not cause cumbersome works. When the image carrier 1110 is supported by the supporting member 1120 inwardly.

As a consequence, the image carrier 1110 can be readily supported on the supporting member 1120 in the roundness manner.

Precisely speaking, for example, when the image carrier is constructed by way of the electroforming method, the burr may be produced in the edge portions 1111*a* thereof due to the cutting work. If the edge portions of the image carrier are supported by the supporting members 1120 without eliminating the burr and the like, then there is a risk that the intervals "S" of the image carrier with respect to the cylindrical member 1140 becomes unequal, which is caused by the adverse influences of the burr and the like. On the other hand, when the burr and the like are removed, there are problems that distortion is newly applied to the cylindrical image carrier 1110 made of the thin body, the deformation is increased, but also a large number of manufacturing stages are required.

To the contrary, in accordance with the image carrier unit according to this embodiment, since the supporting member 1120 is positioned slightly near a center side, rather than the edge portion 1111*a* of the image carrier 1110 even when the burr and the like are present on the image carrier 1110, there is no adverse influence. Also, the image carrier 1110 can be uniformly supported with respect to the cylindrical member 1140, and thus higher vibration precision can be achieved.

To the contrary, in accordance with the image carrier unit according to this embodiment, since the burr 1111*b* is produced on the outside, even when the burr 1111*b* and the like are present on the image carrier 1110, there is no adverse influence. Also, the image carrier 1110 can be uniformly supported with respect to the cylindrical member 1140, and thus higher vibration precision can be achieved.

(j). In the above-described image forming apparatus, since the charging roller 1210 and the transferring roller 1240, which correspond to the hardness roller, are rotated at the same circumferential speed as that of the image carrier 1110, at the contact portion among the charging roller 1210, the transfer roller 1240, and the image carrier 1110, namely at the charging position and the transferring position, there is no relative speed difference between the image carrier and the respective rollers. As a consequence, no friction force is produced in the contact portion, but also no vibration behavior occurs. As a result, the stable contact rotation can be realized, so that the stable charging operation and the stable transferring operation can be realized.

Also, the destruction of the image carrier 1110 caused by the above-described vibration behavior can hardly occur, so that the reliability can be increased.

It should be noted that when the circumferential speed (rotation speed) of the developing roller 1231 is made different from the circumferential speed of the image carrier 1110, the image carrier 1110 receives the friction force from the developing roller 1231 at the contact portion between the developing roller 1231 and itself. However, since the image carrier 1110 abuts against the developing roller 1231 to such an extent that the space "S1" is formed between the inner circumferential surface 1113 of the image carrier 1110 and the outer circumferential surface 1145 of the cylindrical member 1140, the abutting force exerted between the image carrier member 1110 and the developing roller 1231 is small. As a consequence, the friction force exerted between both members is also small. Therefore, the vibration behavior caused by this variation is also reduced, and then the developing roller 1231 is made in contact with the image carrier 1110 under relatively stable condition, and thus are rotated.

1) Since there is no elastic rubber layer, there is no case in which the plasticizer added to rubber is exuded from the surface of the roller, whereby the photoreceptor is changed in characteristics or the surface of the photoreceptor is peeled off.

2) In the case of using a metal roller as the hard roller, because of no influence of humidity, the environment-resistant characteristics of charging, developing and transfer are stabilized.

3) The hardness of the roller is little dispersed, and the stable contact state of the hard roller with the image carrier can be maintained.

4) In the case of using a metal roller as the hard roller, the electric conductivity is hardly dispersed, thereby being capable of obtaining the uniformity of quality and the stable charging characteristic, developing characteristic and transfer characteristic.

5) The roller made of hard metal or synthetic resin has its surface reduced in irregularity by processing such as grinding, thereby being capable of obtaining the contact state in which the roller is in close contact with the image carrier 1110.

7) In the above-mentioned embodiments, the image carrier unit was described as the photoreceptor unit, however, the image carrier unit of the present invention is not limited by or to this and can be structured as an intermediate transfer medium unit. In this case, the image carrier is made up of a cylindrical thin intermediate transfer body.

8) In the above-mentioned embodiments, the cleaning means is made up of the cleaning blade 251, however, if it is made up of a cleaning brush, the cylindrical member 140 may not be always provided.

9) In the above-mentioned embodiments, nickel is recited as an example of the base substance of the image carrier 1110, however, an appropriate material, for example, stainless steel, synthetic resin or the like can be applied.

Specific Examples

Hereinafter,specific concrete examples will be described.

It should be understood that specific examples 1 to 5 correspond to the embodiment of the above-explained structure (B), specific examples 6 to 7 correspond to the embodiment of the above-explained structure (A), and example 8 corresponds to the fifteenth embodiment.

Specific Example 1

(Image carrier 1110)

The base member of the image carrier 1110 was selected to be a nickel electroforming tube having a thickness of 50 μm, an inner diameter of 85.36 mm, and a length of 400 mm. In this case, after the electroforming tube having a length longer than, or equal to 400 mm had been formed, both end portions thereof were cut out by the slitter to make the electroforming tube with the length of 400 mm. This is because when the nickel electroforming tube is electroformed, the thicknesses of the both end portions become considerable ununiform and also the surface thereof becomes concave/convex, and thus these portions are disposed.

The photosensitive layer was formed by forming an under layer on the base substance, and dipping OPC (organic photosensitive layer) 20 μm in thickness.

The base substance may be formed of a thin metal pipe which is made of an alloy consisting of stainless steel, steel, aluminum, brass, copper or the like, other than the nickel electro-forming tube.

Also, as a base substance, a structure in which an electrically conductive layer for moving charges from the photosensitive layer is formed on the surface of a thin resin pipe can be used. The thin resin pipe can be formed by extrusion-molding, common extrusion-molding, blow-molding polyester, polyethylene terephthalate (PET), polycarbonate (PC), polyimide (PI), polyamide (PA), polyphenylene sulfite (PPS), polyethylene (PE), polypropylene (PP), polystyrene (PS), nylon (NY) or the like. The electrically conductive layer can be formed by depositing, sputtering or plating a thin metal layer. It should be noted that an electrically conductive material is diffused in the thin resin pipe to bring electrical conductivity to the base substance.

(Cylindrical member 1140)

As a pipe-shaped cylindrical member, there was used a steel hollow cylinder which is 84.91 mm in diameter, 440 mm in length and 2 mm in thickness.

The disc-shaped side plates 1142 and 1143 were made up of steel cut parts.

The cylindrical member 1140 was plated with nickel for corrosion prevention after the above members are integrated by press fitting, press contact, adhesive or the like.

The cylindrical member 1140 can be formed by cutting the member as a whole.

In the case where the cylindrical member 1140 is made of synthetic resin, metal such as aluminum, nickel or copper is deposited on the cylindrical member 1140, an electrically conductive layer is formed on the cylindrical member 1140 by plating, or an electrically conductive material such as carbon is inserted in a resin to provide conductivity.

(Support member 1120)

As the spacer 1130, a metal tape was used as its base portion 1131, and elastic protrusions 1132 were formed on the outer peripheral surface of the metal tape by elastic printing.

An electrically conductive adhesive was used as the fixing member 1121.

The interval S between the outer peripheral surface 1145 of the cylindrical member 1140 and the inner peripheral surface 1113 of the image carrier 1110 was set to 0.225 mm.

(Hard roller)

The hard roller can be specifically structured as follows:

That is, the hard roller is structured by the provision of a resistant layer on the surface of the hard roller-shaped base substance.

The roller-shaped base substance is machined by cutting or grinding metal such as aluminum, aluminum alloy, iron, copper, etc., with an excellent vibrating accuracy and surface accuracy. The surface of the roller-shaped base substance is subjected to a specular finishing by buff machining, polish machining, super finish machining, diamond grinding, centerless grinding, etc.

Alternatively, a synthetic resin, for example, polyester, polyethylene terephthalate (PET), polycarbonate (PC), polyimide (PI), polyamide (PA), polyphenylene sulfite (PPS), polyethylene (PE), polypropylene (PP), polystyrene (PS), nylon (NY) or the like is molded in the form of a roller, and metal such as aluminum, nickel or copper is deposited on the above synthetic resin, an electrically conductive layer is formed on the synthetic resin by plating, or an electrically conductive material such as carbon is inserted in a resin to provide conductivity as the electrically conductive resin.

As the resistant layer, a resistant resin $10^8$ to $10^{14}$ Ωcm in volume resistance is formed in the thickness of about 2 μm to 1 mm, to form the surface layer of middle or high resistance. As the resistant resin, a resin in which electrically conductive particles made of carbon, aluminum, nickel or the like are diffused in a thin film resin such as nylon, polyurethane, polyethylene can be applied. Also, an electrically conductive resin such as polyvinyl aniline or an ion conductive resin may be used instead.

The hard roller described above can be subjected to a specular finishing because the roller-shaped base substance is hard, and the surface of the thin film resin formed on the roller is also extremely smooth.

Also, because its surface is made of a thin film resin, the hardness and the conductivity are little dispersed. (Respective members, etc., used for analyzing the state of deformation of the image carrier through finite element method)

Parameters of respective members, etc., used for analyzing the state of deformation of the image carrier shown in FIGS. 11 and 13 through finite element method are as follows:

Parameters

The amount δ3 of inverse crown of the hard roller 1200 =0.132 mm

The length of the hard roller 1200 =223 mm

The inner diameter of the image carrier 1110 =ϕ60 mm

The base substance of the image carrier=nickel electroforming tube

Young's modulus of the base substance of the image carrier= 21000 Kg/mm$^2$

The thickness of the base substance of the image carrier= 0.05 mm

The length of the image carrier=300 mm

The amount δ4 of pushing the hard roller=0.234 mm

Display form=wire frame

Magnification of deformation of the image carrier=50 magnifications finite element program as used: Promechanica (Japan parametric technology Inc.)

Specific Example 2

Both the base material of the image carrier 110 and the cylindrical member 140 were made of stainless steel. Other structures are identical to those of the example 1.

Specific Example 3

Both the base member of the image carrier 1110 and the cylindrical member 1140 were constituted by polyethyleneterephthalate(PET). A metal such as aluminum, nickel, and copper was vapor-deposited on the base member of the image carrier 1110 and the cylindrical member 1140. Otherwise, an electroconductive layer was formed by way of plating on these members, or the electroconductive material such as carbon was entered into the resin the apply the electroconductivity.

Other components are the same as those of specific example 1.

Specific Example 4

The base member of the image carrier 1110 and the cylindrical member 1140 were made of any one of aluminum, duralumin, and magnesium.

Other components are the same as those of the specific example 1.

Specific Example 5

The base member of the image carrier 1110, and the cylindrical member 1140 were made of any one of brass, copper, and phosphor bronze.

Other components are the same as those of the specific example 1.

Specific Example 6

The cylindrical member 1140 was made of PET (polyethyleneterephthalate) of a glass fiber containing rate of 55% (weight ratio). A metal such as aluminum,nickel, and copper was vapor-deposited on the cylindrical member 1140. Otherwise, an electroconductive layer was formed by way of plating on these members, or the electroconductive material such as carbon was entered into the resin to apply the electroconductivity.

Other components are the same as those of specific example 1.

Specific Example 7

The base material of the image carrier 1110 was an aluminum tube (linear expansion coefficient is $23.1\times10^{-6}$/° C.), the cylindrical member 1140 was constituted by PET (polethyleneterephthalate) containing an inorganic material (mineral) such as a fiber or mica. When the glass containing rate is selected to be 45% (weight ratio), the linear expansion coefficient was $23.0\times10^{-6}$/° C. A metal such as aluminum, nickel, and copper was vapor-deposited on the base member of the image carrier 1110 and the cylindrical member 1140. Otherwise, an electroconductive layer was formed by way of plating on these members, or the electroconductive material such as carbon was entered into the resin the apply the electroconductivity.

Other components are the same as those of specific example 1.

Specific Example 8

The base member of the image carrier 6110' was constituted by a nickel electroforming tube, and the length of which was L1=300 mm. The thermal expansion coefficient is $\alpha1=13.4\times10^{-6}$/° C., and Young's modulus is E1=2000 kg/mm$^2$. As the allowable stress, 0.2% endurance force was introduced. That is, σa=50 kg/mm$^2$ As the right/left fixing members 6151' and 6152', nylon 610 was employed, and a length thereof was L2=L4=5 mm. The thermal expansion coefficient was $\alpha2=\alpha4=90\times10^{-6}$/° C.

The cylindrical member 6140' was made of carbon steel, and a length thereof was L3=290 mm. The thermal expansion coefficient was $\alpha3=10.7\times10^{-6}$/° C.

Then, usually, since the image carrier unit is assembled under environment of the room temperature (approximately 20 to 25° C.), and the actually used (or under transport) environmental temperature is normally selected from 0 to 45° C., ΔT=20° C. was employed as the temperature difference.

When the above-explained shift amount "Lt" is calculated under the above-explained condition, Lt=0.00034 mm.

Accordingly, the thermal distortion "∈t" of the image carrier 6110' is expressed as $$\in t=Lt/L1=1.13\times10^{-6}$$

The thermal stress at is given by:

$$\sigma t=E1\times\in t=0.02267\ \text{kg/mm}^2$$

Thus, this thermal stress becomes a very small value, as compared with the allowable stress aa $\sigma$=50 kg/mm$^2$ As a consequence, the conditions during the assembling work can be maintained, while the distortion and vibrations of the image carrier 6110' caused by the thermal expansion are not increased, and thus, the image carrier unit can be manufactured in very high precision.

The embodiments and examples of the present invention have been described, but the present invention is not limited to or by the above embodiments or examples, but can be appropriately implemented with modifications with the limits of the subject matter of the present invention.

1) Although in the above-mentioned embodiment, the developing roller 1231 is structured so as not to be abutted against the cylindrical member 1140, it can be structured such that the image carrier 1110 is bent inwardly until the inner peripheral surface 1113 of the image carrier 1110 is abutted against the outer peripheral surface 1145 of the cylindrical member 1140 as in the charging roller 1210. In this case, it is desirable that the rotating velocity of developing roller 1231 is set such that its peripheral surface is identical with the peripheral velocity of the image carrier 1110.

2) In the above-mentioned embodiment, the charging roller 1210 is designed to be driven by the motor 1212, but it may be driven by the image carrier 1110.

3) in the above-described embodiment, both the charging roller 210 and the transferring roller 240 are so arranged that the image carrier 110 is flexed inwardly until the inner circumferential surface 113 of the image carrier 110 abuts against the outer circumferential surface 145 of the cylindrical member 140. Alternatively, similar to the developing roller 231, the image carrier 110 may be arranged in such a way that this image carrier does not abut against the cylindrical member 140, but is flexed.

4) In the above-described embodiment, the image carrier unit has been explained as the photosensitive member unit. The image carrier unit of the present invention is not limited thereto, but may be arranged as an intermediate transfer medium unit. In this case, the image carrier is constituted by a cylindrical intermediate transfer member made of a thin body.

5) The quantities of the elastic projections 1132, the elastic ridges 2133*b*, 3134*b*, and the flexible pieces 4135 functioning as the elastic portions may be arbitrarily selected from plural numbers, e.g., desirably more than 4, preferably more than 8, and further preferably more than 12. Also, the elastic portion need not be these subdivided portions, but may be continued.

Also, the image carrier unit of the present invention may be arranged as a transfer drum unit for carrying a recording medium (paper and the like) on an outer circumferential plane. In this case, the paper and the like are attached (carried) by the electrostatic absorption on the outer circumferential plane of the thinner cylindrical image carrier.

What is claimed is:

1. An image carrier device, comprising:

a flexible cylindrical thin image carrier;

a pair of support members, each support member supporting a respective end of said image carrier; and a cylindrical member having an outer diameter smaller than an inner diameter of said image carrier, which is disposed inside of said image carrier, wherein an interval is defined between an outer peripheral surface of said cylindrical member and an inner peripheral surface of said image carrier, such that said interval is smaller than an allowable deformation of said image carrier.

2. An image carrier device as claimed in claim 1, wherein said support members each include a tapered surface to support a respective end of said image carrier.

3. An image carrier device as claimed in claim 1, wherein one of said support members fixedly supports one end of said image carrier and one end of said cylindrical member, and the other support member is slidable axially with respect to the other end of said cylindrical member.

4. An image forming carrier device as claimed in claim 1, wherein each of said support members includes a spacer having an elastic portion for elastically and uniformly supporting said image carrier from an inside thereof and a fixing member for fixing the image carrier supported by the spacer and the cylindrical member, and said image carrier is supported by said pair of support members such that said interval between the inner circumferential surface of said image carrier and the outer circumferential surface of said cylindrical member is maintained smaller than an allowable deformation amount of the image carrier.

5. An image carrier device as claimed in claim 4 wherein when said cylindrical member is positioned inside the image carrier, said spacer is compressed by the cylindrical member and the image carrier to elastically support said image carrier.

6. An image carrier device as claimed in claim 1, wherein: said support members elastically support said image carrier in such a manner that an inside of said image carrier is supported at plural portions thereof which are at equal intervals along a circumferential direction.

7. An image carrier device as claimed in claim 1, wherein said cylindrical member and said support members have electroconductivity.

8. An image carrier device as claimed in claim 1, wherein each of said support members is positioned slightly inward of an edge portion of said image carrier.

9. An image carrier device as claimed in claim 1, wherein an outer circumferential surface of the image carrier includes a burr.

10. An image carrier device as claimed in claim 9, wherein each of said support members includes a spacer interposed between the image carrier and the cylindrical member and having an elastic portion for elastically and uniformly supporting said image carrier; and an adhesive agent for adhering the image carrier to each support member.

11. An image carrier device as claimed in claim 10, wherein said adhesive agent adheres both said spacer and an end portion of the image carrier to the cylindrical member.

12. An image carrier device as claimed in claim 9, wherein said cylindrical member has a taper surface for supporting both end portions of the image carrier.

13. An image carrier device as claimed in claim 9, wherein one of said support members includes an adhesive agent for adhering a respective end portion of the image carrier to the one support member while covering said burr.

14. An image carrier unit as claimed in claim 9, wherein said cylindrical member includes a rigid cylindrical member whose length along an axial line direction is made longer than that of said image carrier.

15. An image carrier unit as claimed in claim 9, wherein each of said support members includes a rigid cylindrical member having an outer diameter smaller than an inner diameter of the image carrier and arranged inside the image carrier.

16. An image carrier unit as claimed in claim 1, wherein each support member includes means for mounting a shaft thereon.

17. An image carrier unit as claimed in claim 1, wherein said cylindrical member is longer than said image carrier.

18. An image carrier device, comprising:

a flexible cylindrical thin image carrier, having an inner and an outer peripheral surface;

a pair of support members, each having a tapered surface, which support respective ends of said image carrier, wherein said tapered surfaces contact said image carrier; and a cylindrical member, having an outer peripheral surface, extending between said support members.

19. An image carrier device as claimed in any one of claims 1 or 18, wherein each of said support members includes a flange having an outer diameter larger than an outer diameter of said image carrier.

20. An image carrier device as claimed in any one of claims 1 or 18, wherein an air vent is defined in at least one of said support members.

21. An image forming carrier device as claimed in any of claims 1 or 18, further comprising:

charging means for uniformly charging an outer peripheral surface of said image carrier;

exposing means for selectively exposing the outer peripheral surface of said image carrier which has been uniformly charged by said charging means to form an electrostatic latent image; developing means for developing the electrostatic latent image formed by said exposing means; and transfer means for transferring an image developed by said developing means to a transfer medium.

22. An image forming carrier device as claimed in claim 21, wherein at least one of said charging means, said developing means and said transfer means is made up of a hard roller which is in contact with said image carrier and bends said image carrier inwardly.

23. An image forming carrier device as claimed in claim 21, wherein at least one of said charging means, said developing means and said transfer means is made up of a hard roller which is in contact with said image carrier and bends said image carrier inwardly within a range in which the inner peripheral surface of said image carrier is not abutted against the outer peripheral surface of said cylindrical member.

24. An image forming carrier device as claimed in claim 23, wherein interval defining members are provided at both end portions of a shaft of the hard roller, and said interval defining members directly abut against the outer circumferential surface of said cylindrical member, whereby the interval defining members define an interval between a shaft line of said roller and an axial line of said image carrier.

25. An image forming carrier device as claimed in claim 21, wherein said support members each include a flange, and wherein at least one of said charging means, said developing means and said transfer means is made up of a hard roller which is in contact with said image carrier and bends said image carrier inwardly; and wherein the flanges of said support members constitute interval regulating means for regulating an interval between an axis of said roller and an axis of said image carrier.

26. An image forming carrier device as claimed in claim 21, further comprising:

cleaning means for removing the developer which remains on the outer peripheral surface of said image carrier after the image has been transferred onto the transfer medium by said transfer means;

wherein said cleaning means includes a cleaning member which is in contact with said image carrier and presses said image carrier until the inner peripheral surface of said image carrier is abutted against the outer peripheral surface of said cylindrical member to remove the developer on the outer peripheral surface of said image carrier.

27. An image forming carrier device as claimed in claim 21, wherein at least one of said charging means, said developing means and said transfer means is in contact with said image carrier so that said image carrier is bent inwardly until the inner peripheral surface of said image carrier is abutted against the outer peripheral surface of said cylindrical member, and is formed of a hard roller that rotates at a peripheral velocity identical with a peripheral velocity of said image carrier.

28. An image carrier unit as claimed in claim 18, wherein each support member includes means for mounting a shaft thereon.

29. An image carrier unit as claimed in claim 18, wherein a space is defined between the outer peripheral surface of said cylindrical member and the inner peripheral surface of said image carrier such that a distance across said space is greater than zero but less than an allowable deformation of said image carrier.

30. An image carrier device comprising:

a thin flexible cylindrical image carrier, in which burrs are formed inwardly at each end portion thereof;

a supporting member having an outer diameter smaller than an inner diameter of the image carrier by at least a value equal to a height of said burrs and arranged inside said image carrier, for inwardly supporting both end portions of the image carrier; and fixing means, wherein said fixing means is an adhesive agent adhered to each end portion of the image carrier, said supporting member, and a respective one of said burrs as an adhesive base.

31. An image carrier device as claimed in claim 30 further comprising:

a spacer interposed between said image carrier and said supporting member, said spacer having an elastic portion for elastically and uniformly supporting the image carrier at a portion thereof inward of said burrs along an axial direction.

32. An image carrier device comprising:

a thin flexible cylindrical image carrier having burrs formed inwardly at both end portions thereof;

a supporting member having tapered surfaces for supporting the end portions of the image carrier inward of the burrs along an axial direction; and adhesive agent adhered to each end portion of the image carrier, said supporting member, and a respective one of said burrs as an adhesive base.

33. An image carrier unit as claimed in claim 32, wherein:

said supporting member includes a rigid cylindrical member having an outer diameter smaller than an inner diameter of the image carrier and arranged inside the image carrier; and said image carrier is arranged at an interval between an inner circumferential surface thereof and the outer circumferential surface of said supporting member, wherein said interval is smaller than an allowable deformation amount of the image carrier.

34. An image carrier device comprising:

a thin flexible cylindrical image carrier, in which burrs are formed inwardly at each end portion thereof;

a supporting member having an outer diameter smaller than an inner diameter of the image carrier by at least a value equal to a height of said burrs and arranged inside said image carrier, for inwardly supporting both end portions of the image carrier; and fixing means for fixing both end portions of said image carrier to the supporting member;

wherein said fixing means includes a ring-shaped elastic member interposed between said image carrier and said supporting member, into which said burrs are embedded.

35. An image carrier unit comprising:

a thin flexible cylindrical image carrier, in which burrs are formed inwardly at each end portion thereof; and a supporting member having an outer diameter smaller than an inner diameter of the image carrier by a value less than a height of said burrs and arranged inside said image carrier, thereby creating deformed burr portions which comprise a fixing means, for inwardly supporting both end portions of the image carrier;

wherein said image carrier and side supporting member are fixed by recovery force of the deformed burr portions.

36. An image carrier unit as claimed in claim 35, further comprising:

a spacer interposed between said image carrier and said supporting member, said spacer having an elastic portion for elastically and uniformly supporting the image carrier on a portion thereof inward of said deformed burr portions along an axial direction.

37. An image carrier unit as claimed in claim 35, wherein said deformed burr portions are further adhered to said supporting member by adhesive agent.

38. An image carrier unit as claimed in any one of claims 30, 34 or 35 wherein:

said supporting member includes a rigid cylindrical member whose length along an axial direction is made longer than that of said image carrier; and said image carrier is arranged at an interval between an inner circumferential surface thereof and an outer circumferential surface of said cylindrical member such that said interval is maintained smaller than an allowable deformation amount of the image carrier.

39. An image carrier unit as claimed in any one of claims 30, 34 or 35 wherein both said supporting member and said fixing means have electroconductivity.

40. An image carrier unit comprising:

a thin flexible cylindrical image carrier;

a rigid cylindrical member having an outer diameter smaller than an inner diameter of the image carrier, and arranged inside the image carrier; and a pair of fixing members each fixing a respective end portion of said image carrier on the cylindrical member; wherein:

a coefficient of linear expansion of said image carrier is substantially equal to that of said cylindrical member.

41. An image carrier unit as claimed in claim 40, wherein said cylindrical member is longer than said image carrier.

42. An image carrier unit comprising:

a thin flexible cylindrical image carrier;

a rigid cylindrical member having an outer diameter smaller than an inner diameter of the image carrier, and arranged inside the image carrier; and a fixing member for fixing both end portions of said image carrier on the cylindrical member; wherein:

both said image carrier and said cylindrical member are made of the same metal.

43. An image carrier unit as claimed in claim 42, wherein said cylindrical member is longer than said image carrier.

44. An image carrier unit comprising:

a thin flexible cylindrical image carrier;

a rigid cylindrical member having an outer diameter smaller than an inner diameter of the image carrier, and arranged inside the image carrier; and first and second fixing members for fixing a respective end portion of said image carrier on the cylindrical member, each said fixing member including a first portion coupled to said image carrier and a second portion coupled to said cylindrical member; wherein:

a length of said image carrier along an axial line direction between said first coupling portions, and a coefficient of linear expansion of said image carrier are "L1" and "α1"; a length of said cylindrical member between said second coupling portions, and a coefficient of linear expansion of said cylindrical member are "L3" and "α3"; lengths of said first and second fixing members between said first and second coupling portions of each along an axial direction are "L2", "L4", respectively, and coefficients of linear expansion of said first and second fixing members are "α2", "α4", respectively;

Young's modulus of said image carrier is "E1", and allowable stress is "σa"; the following formula is satisfied:

$$\sigma a > E1 \times \sum_{i=1}^{n} Li \times (1 + \alpha i \cdot \Delta T) / L1$$

wherein Li: length of i-th member; αi: i-th linear expansion coefficient; and ΔT: temperature difference.

45. An image carrier unit as claimed in any one of claims 40, 42, or 44 wherein said image carrier is supported by said fixing members such that an interval between said image carrier and said cylindrical member remains smaller than an allowable deformation amount of said image carrier.

46. An image carrier unit as claimed in any one of claims 40, 42, or 44 wherein both said cylindrical member and said fixing member have electroconductivity.

* * * * *